US012280288B2

(12) United States Patent
Klassen et al.

(10) Patent No.: US 12,280,288 B2
(45) Date of Patent: Apr. 22, 2025

(54) LOW JOINT STRAIN FITNESS SYSTEM

(71) Applicant: Genesis Advanced Technology Inc., Surrey (CA)

(72) Inventors: James Brent Klassen, Osoyoos (CA); David Michael Bernhardt, White Rock (CA); Javier Peter Fernandez-Han, Burnaby (CA)

(73) Assignee: Genesis Advanced Technology Inc., Surrey (CA)

( * ) Notice: Subject to any disclaimer, the term of this patent is extended or adjusted under 35 U.S.C. 154(b) by 0 days.

(21) Appl. No.: 18/503,178

(22) Filed: Nov. 6, 2023

(65) Prior Publication Data

US 2024/0149101 A1 May 9, 2024

Related U.S. Application Data

(60) Provisional application No. 63/477,174, filed on Dec. 23, 2022, provisional application No. 63/422,922, filed on Nov. 4, 2022.

(51) Int. Cl.

| | |
|---|---|
| ***A63B 21/00*** | (2006.01) |
| ***A63B 21/055*** | (2006.01) |
| ***A63B 21/16*** | (2006.01) |

(52) U.S. Cl.

CPC ..... *A63B 21/156* (2013.01); *A63B 21/0552* (2013.01); *A63B 21/169* (2015.10)

(58) Field of Classification Search

CPC . A63B 21/156; A63B 21/0552; A63B 21/169; A63B 21/02; A63B 21/028; A63B 21/04; A63B 21/0407; A63B 21/0414; A63B 21/0421; A63B 21/0428; A63B 21/0435; A63B 21/0442; A63B 21/05; A63B 21/055; A63B 21/0555;

(Continued)

(56) References Cited

U.S. PATENT DOCUMENTS 325,404 A * 9/1885 Forest ..... A63B 21/062 482/102
931,699 A * 8/1909 Medart ..... A63B 21/062 482/102

(Continued)

FOREIGN PATENT DOCUMENTS

DE 20 2009 006 018 U1 7/2009

OTHER PUBLICATIONS

International Search Report and Written Opinion for International Application No. PCT/CA2023/051479, mailing date Feb. 8, 2024, 13 pages.

(Continued)

*Primary Examiner* — Joshua Lee
*Assistant Examiner* — Catrina A Letterman
(74) *Attorney, Agent, or Firm* — Seed IP Law Group LLP

(57) ABSTRACT

An exercise device is provided using, for example, handles, connected to cords that increase in tension as the handles are pulled. The tension may be provided using elasticity of the cords or by an actuator, for example powered by an electric motor. Pulleys allow adequate extension while remaining compact enough to fit in a standard height room and allowing accessibility to components. Upper and forward pulleys may be used. The upper pulleys may be displaced from potential obstacles, including the forward pulleys.

15 Claims, 77 Drawing Sheets

(58) Field of Classification Search
CPC ... A63B 21/0557; A63B 21/15; A63B 21/151; A63B 21/153; A63B 21/154; A63B 21/155; A63B 21/16; A63B 21/1618; A63B 21/1627; A63B 21/1636; A63B 21/1645; A63B 21/1654; A63B 21/1663; A63B 21/1681; A63B 21/28
See application file for complete search history.

(56) References Cited

U.S. PATENT DOCUMENTS 4,431,181 A * 2/1984 Baswell ..... A63B 21/4043 482/102
4,521,013 A 6/1985 Dofel
4,779,867 A 10/1988 Hinds
5,468,205 A 11/1995 McFall et al.
5,556,369 A 9/1996 Roberts
5,795,274 A 8/1998 Kasbohm
6,908,418 B2 6/2005 Sauré
7,270,628 B2 9/2007 Campanaro et al.
7,354,384 B2 * 4/2008 Martin ..... A63B 21/1609 482/92
7,625,321 B2 * 12/2009 Simonson ..... A63B 21/4047 482/138
7,682,287 B1 * 3/2010 Hsieh ..... A63B 21/153 482/4
8,033,960 B1 * 10/2011 Dalebout ..... A63B 23/03541 482/130
8,192,337 B2 6/2012 Birch et al.
8,303,472 B2 11/2012 Bowser
8,517,899 B2 8/2013 Zhou et al.
8,672,817 B2 3/2014 Bowser et al.
8,840,075 B2 * 9/2014 Dalebout ..... A63B 21/00065 482/904
8,858,408 B2 10/2014 DeMeo
9,138,607 B2 9/2015 Miranda et al.
9,295,871 B2 3/2016 Luedeka
9,345,922 B2 5/2016 Allison et al.
9,409,053 B1 * 8/2016 Todd ..... G16H 20/30
9,427,622 B2 8/2016 Thrasher-Rudd et al.
9,707,435 B1 7/2017 Ferlito et al.
10,143,881 B2 * 12/2018 Lalaoua ..... A63B 23/03541
10,279,212 B2 * 5/2019 Dalebout ..... A63B 23/03525
10,335,626 B2 7/2019 Orady et al.
11,938,365 B1 * 3/2024 Dorsey ..... A63B 21/00065
2004/0138033 A1 * 7/2004 Van Straaten ..... A63B 21/156 482/138
2009/0181833 A1 * 7/2009 Cassidy ..... A63B 21/156 482/92
2011/0224057 A1 * 9/2011 Wu ..... A63B 23/1245 482/130
2012/0083395 A1 * 4/2012 Carson ..... A63B 21/154 482/129
2012/0277068 A1 * 11/2012 Zhou ..... A63B 21/157 482/71
2013/0109543 A1 5/2013 Reyes
2013/0288861 A1 * 10/2013 Cole ..... A63B 21/0618 482/102
2015/0024911 A1 1/2015 Ross
2019/0126089 A1 * 5/2019 Schmidt ..... A63B 71/0054
2020/0139187 A1 * 5/2020 Kennington ..... A63B 71/0622
2023/0338770 A1 * 10/2023 Chen ..... A63B 21/0058

OTHER PUBLICATIONS

Anthropometric Data, Apr. 21, 2006; p. 1-52.
Tonal "A Home Gym Built to Work as Hard as You" p. 1-7; Dec. 2022, www.tonal.com.
AliExpress "TWTOPSE Pro Pulley Resistance Bands Training Fitness Yoga Pull Rope Universal Door Exercise Tubes Fitness Body Building 210lbs" Feb. 2023; p. 1-10, www.aliexpress.com.
Amazon "Brayfit Flex 400 Home Gym Equipment, Full Body Workout Door Gym, Padded Handles, Heave Resistance" Feb. 2023; p. 1-6, www.amazon.ca.
Facebook "Recoil Challenge—2020 Let's kick off the Year with a Challenge!!! Exercise: Recoil Squat Assisted Pull-ups (detailed description below) Time: 3min best effort"; Recoil Training; Jan. 2020; p. 1, www.facebook.com.
Recoil "Recoil—Premium Suspension Trainer"; Dec. 2022; p. 1-11, www.recoiltraining.com.
"Learn to Squat Properly with High Pulley Assisted Squats"; Nick Nilsson; Dec. 2012; p. 1, www.youtube.com.

* cited by examiner

| Cord 1 Disp. (mm) | Cord 2 Disp. (mm) | Cord 1 Tension k1 kg/m | Cord 2 Tension k2 kg/m | Cord 1 Tension T1 (Kg force) | Cord 2 Tension T2 (Kg force) | Total Resulting Tension (Kg force) |
|---|---|---|---|---|---|---|
| 100 | 0 | 20 | 40 | 2 | 0 | 2 |
| 200 | 0 | | | 4 | 0 | 4 |
| 300 | 0 | | | 6 | 0 | 6 |
| 400 | 0 | | | 8 | 0 | 8 |
| 500 | 0 | | | 10 | 0 | 10 |
| 600 | 0 | | | 12 | 0 | 12 |
| 700 | 0 | | | 14 | 0 | 14 |
| 800 | 0 | | | 16 | 0 | 16 |
| 900 | 100 | | | 18 | 4 | 22 |
| 1000 | 200 | | | 20 | 8 | 28 |

LOW JOINT STRAIN FITNESS SYSTEM

TECHNICAL FIELD

Exercise apparatus and methods.

BACKGROUND

Weight training with heavy weights can result in injuries and can be dangerous without a spotter. People recovering from injuries may be especially prone to further injury. Certain exercises such as squats subject the muscles and tendons of the exerciser to very high joint strain, especially at the extremes of the person's range of motion.

Additionally, joints and muscles may be at greater risk of injury when an exerciser is standing up from a squat than when they are lowering down into a squat, because the exerciser's muscles, joints, and tendons are under higher load when standing up from a squat than when lowering down into a squat. In order to stand up from a squat, the exerciser's muscles must exert enough force to exceed the force of gravity. Conversely, when the exerciser is lowering into a squat the muscles exert a force which is less than the opposing force of gravity.

Workout devices are known that use one or more elastic cords which are fixed to an overhead structure to provide resistance training to a human with an overhead handle that is pulled downward by the user in a direction with a large vertical component to the movement. Other elastic band workout devices use elastics or pulleys and elastics that are mounted to a wall or other structure in front of the user with a handle that is pulled, by the user, with a large horizontal component to the movement.

Common exercise equipment will use cables that allow the user to pull horizontally or downward, or some combination of horizontally and downward, against the force of gravity by weights on the other end of cable. This allows exercise of different muscle groups than if the user were to just lift the weights vertically against the force of gravity. These systems have the disadvantage of being heavy, expensive, and requiring a lot of space. Other exercise equipment simulates the force of gravity with resistance provided by an electric motor and cable reel. The cable can then pass through a pulley that can be pulled in any direction as if the user were lifting a weight on a traditional cable machine. These systems will typically exert a near-constant force in the direction of the cable pull to simulate the force of gravity acting on a weight being lifted by a cable.

SUMMARY

There is disclosed an exemplary exercise apparatus having one or more forward pulleys or one or more overhead pulleys. In an exemplary embodiment both forward and overhead pulley(s) are present, but in other embodiments only forward or only overhead pulley(s) may be present. All features that do not clearly require both forward and overhead pulleys may be included in embodiments with only one or the other. In some cases, pulleys may be movable such that a pulley, including perhaps all pulleys, may be a forward pulley or an overhead pulley depending on its position. Where present, the forward pulleys are arranged to be connected to a support structure. Where present, the overhead pulleys are arranged to be supported in use of the apparatus in an overhead pulley position. In order to obtain adequate clearance from other parts of the apparatus, the overhead pulley position may be displaced horizontally 16" or more, 17" or more, 18" or more, 19" or more, 20" or more, 21" or more, 22" or more, 23" or more, 24" or more, 25" or more, 26" or more, 27" or more, 28" or more, or 29" or more from the one or more forward pulleys. The forward pulleys may be positioned high enough to make them easy to reach, for example not requiring much or not requiring any bend at the waist. The forward pulleys may be low enough to allow for enough cord length, when the handles are docked, to avoid cords from being overstretched during use of the device. In an embodiment, they may be knee height or higher. In an example, the forward pulleys may be 16" or more, 17" or more, 18" or more, 19" or more, 20" or more, 21" or more, 22" or more, 23" or more, 24" or more, 25" or more, 26" or more, 27" or more, 28" or more, or 29" or more vertically lower than the overhead pulleys.

There may be one or more forward user interfacing elements, for example handles. They may have various shapes, including for example, a cylindrical single hand grip, a ball or a bar. Another option for a forward user interfacing element is a foot harness. Each of the forward user interfacing elements may be connected to a respective cord carried by a respective forward pulley of the one or more forward pulleys, the respective cord here referred to as a forward pulley cord. Each of these forward user interfacing elements may be biased in use of the apparatus toward the respective forward pulley by tension of the respective forward pulley cord. In use of the apparatus, displacement of each of the one or more forward user interfacing elements away from the respective forward pulley may increase the tension of the respective forward pulley cord. The increase in tension may be supplied by, for example, the respective forward pulley cord being elastic. In another example, the tension is supplied by an actuator in respect of each cord. The actuators could be powered by, for example, separate electric motors or a common electric motor. In an embodiment, displacement of the forward user interfacing elements from halfway to the floor, from a docked position, to all the way to the floor increases the tension of the respective forward pulley cord by at least 10%, 20%, 30%, 40%, 50%, 60%, 70%, 80%, 90% or 100%. In an embodiment, the rate at which displacement of each of the forward user interfacing elements increases the tension of the respective forward pulley cord increases with displacement from halfway to the floor to all the way to the floor. There may also be one or more further respective forward pulley cords, for example one or more, to or more, or three or more further respective forward pulley cords, respective to each of the forward user interfacing elements. These may have different lengths and k values than each other or than the respective forward pulley cord.

There may be one or more overhead user interfacing elements, for example handles. They may have various shapes, including for example a cylindrical hand grip, a ball or a bar. Each of the overhead user interfacing elements may be connected to a respective cord carried by a respective overhead pulley of the one or more overhead pulleys, the respective cord here referred to as an overhead pulley cord. Each of these overhead user interfacing elements may be biased in use of the apparatus toward the respective overhead pulley by tension of the respective overhead pulley cord. In use of the apparatus, displacement of each of the one or more overhead user interfacing elements away from the respective overhead pulley may increase the tension of the respective overhead pulley cord. The increase in tension may be supplied by, for example, the respective overhead pulley cord being elastic. In another example, the tension is supplied by an actuator in respect of each cord. The actuators could be powered by, for example, separate electric motors or a common electric motor. Increasing extension may lead to increasing tension throughout a range of motion encountered by the user in an exercise routine. In any of these embodiments, displacement of the overhead user interfacing elements from halfway to the floor, from a docked position, to all the way to the floor may optionally increase the tension of the respective overhead pulley cord by at least 10%, 20%, 30%, 40%, 50%, 60%, 70%, 80%, 90% or 100%. In an embodiment, the rate at which displacement of each of the overhead user interfacing elements increases the tension of the respective overhead pulley cord increases with displacement from halfway to the floor to all the way to the floor. There may also be one or more further respective overhead pulley cords, for example one or more, two or more, or three or more further respective overhead pulley cords, respective to each of the overhead user interfacing elements. These may have different lengths and k values than each other or than the respective overhead pulley cord.

Different cords in the same system could have tension supplied differently, for example, some by elasticity and others by actuators.

The user interfacing elements, including the overhead and forward ones if present, may be connected to the respective cords by respective carabiners of the user interfacing elements. The carabiners may be connected to the user interfacing elements using attachment points. The carabiners may connect to loops at ends of the cords.

The forward pulley cords may be the same cords as the overhead pulley cords, or different cords. Regardless of whether they are the same or different, they may be fixed against shortening at an end distal to the forward user interfacing element in the case of the forward pulley cords, or at an end distal to the overhead user interfacing element in the case of the overhead pulley cords. Where they are the same cords, they may be fixed against shortening at both ends, for example by the user interfacing elements not being able to be pulled back past the pulleys by the cords. Where different, the distal ends may be fixed by being connected to, for example, some part of the support structure or other fixed structure, including for example at the opposite pulley (forward for the overhead cords and overhead for the forward cords).

The cords may be aligned with the pulleys using a transverse feature of each of the cords positioned within a channel of the respective pulley.

The term "cord" should not be interpreted to require, for example, that the cord is formed of twisted fibers, or that the cord is elastic unless stated to be so. The terms "cord" and "cable" may be used interchangeably. The term "floor" refers to an underfoot surface and is not restricted to artificial surfaces.

The support structure may be a wall. The one or more overhead pulleys may be arranged to be supported by an overhead structure, for example a ceiling connected to a wall where the support structure is a wall. The support structure may also be a freestanding structure, the one or more overhead pulleys being arranged to be supported by the support structure. For example, the support structure may be a squat rack.

The apparatus may comprise the support structure. In an example, the support structure includes a wall plate configured to be mounted to the wall (which is not by this language indicated to be part of the apparatus). The support structure may also include a hinged portion hingedly connecting to the wall plate below the height of the overhead pulleys, the one or more overhead pulleys being arranged to be supported by the hinged portion. The hinged portion may have a slidable member arranged to extend the hinged portion in length to adjust a distance between the one or more overhead pulleys and the hinged connection of the hinged portion to the wall plate. The hinged portion may be limited in range of motion by a connection to said wall, for example using a cord connected to a bolt or another wall plate.

Each of the one or more forward pulleys is arranged to be connected to the support structure, for example, at any one of multiple vertically separated respective locations on the support structure. The overhead pulley position may be above a height of the user's shoulders or head when the user is sitting on a chair or bench or wheelchair, or when the user is standing on the floor.

There may also be a shelf extending horizontally in use of the apparatus from the support structure below the one or more forward pulleys. The shelf may be retractable to add additional space for movement, or as part of stowing the apparatus.

The combination of the pivoting articulation of the assembly with the sliding extendable articulation of the assembly, allows the whole assembly to slidably retract and hinge to a vertical position for compact storage in a room with a common ceiling height such as 8 ft, and to deploy for use at an angle and an adjustable height with the sliding mechanism to accommodate a wide range of user heights from a $5^{th}$ percentile female up to a 95% percentile male.

The apparatus may include sensors for measuring various distances and forces. There may be, for example, sensors for measuring distances between the user interfacing elements and the respective pulleys. These sensors may be implemented in various ways. For example, a position sensor located on the user may be used, a rotary encoder in the respective pulley, or various other sensors including using RFID, ultrasound, etc. There may also be force sensors for measuring forces, for example on the pulleys, on the cords, or on the user interfacing elements. Forces may also be inferred from displacement of the user interfacing elements where elastic cords are used. Both the magnitude and direction of force may be measured. For any embodiment that uses sensors, a processor may be included. The processor may be physically part of the apparatus or may be a computer such as a cellphone processor utilized by an app in communication with the apparatus. The processor may collect and tabulate the data produced by the sensors, instantaneously and over time. This may include, for example, tabulating a total power expended in one or more of the user interfacing elements during a rep, set or workout, or tabulating a total time under tension for a rep, set or workout.

There is also disclosed various methods of exercise. Where "steps" are mentioned in a claim or elsewhere in this document, or are described regardless of whether the term "step" is used, the order of steps as written does not restrict what is described and claimed to that order, where the steps could be taken in another order.

In one method, a user carries out the steps of: the user supporting a first portion of the user's body weight using a first body part, the user connecting a second body part to a first end of an elastic cord, the user lowering their center of gravity by motion of the first body part, the lowering of the user's center of gravity causing the second body part to pull on the first end of the elastic cord, and causing tension in the elastic cord to suspend a second portion of the user's weight and reduce the first portion of the user's weight, the user retracting the second body part to further reduce the first portion of the user's weight; and the user raising their center of gravity by motion of the first body part. The elastic cord may be carried by a pulley suspended above a center of mass of the user, a second end of the elastic cord connected to an anchor point fixed forward of the user. Also, the second end may be carried by a second pulley connected to the anchor point. The second body part may comprise a hand, and connecting the second body part to the first end of the elastic cord may comprise grasping a handle connected to the first end of the elastic cord.

In another method, a user carries out the steps of: sitting in a seat, connecting one end of a cord to a first body part, and a second end of the cord to a second body part, the cord being carried by a least a first pulley between the first end and the second end, the user attempting to contract a first muscle of the first body part to counteract gravity on the first body part, the user contracting a second muscle of the second body part to increase tension in the cord, the increase in tension in the cord assisting the contraction of the first muscle. The contraction of the second muscle may act in conjunction with gravity on the second body part. The seat may be a wheelchair. The cord may be carried by the first pulley, the first pulley being positioned forward of the user, and a second pulley between the first end and the second end, the second pulley being positioned above the user.

Methods of exercise may also be carried out on specific embodiments of exercise apparatus as disclosed above.

In an example method where the apparatus includes overhead user interfacing elements, a user may hold with their hand the one or more overhead user interfacing elements, and lower their center of gravity relative to the floor by bending one or both legs. The user pulls the one or more overhead user interfacing elements downward by bending the user's arm/s. The user may raise the user's center of gravity relative to floor by straightening the leg/s, and the user straightening the user's arm/s to raise the one or more overhead user interfacing elements relative to the user's CG. The mention of "the one or more" need not require that every available overhead user interfacing element is used.

In another example, there are both forward and overhead user interfacing elements and at least one of the forward user interfacing elements is at least one of the overhead user interfacing elements. In this method, the user may hold with their hand the at least one of the overhead user interfacing elements, the user straightening the user's arm/s to lower the handle relative to the user's center of gravity and lengthen the overhead pulley cord and the forward pulley cord respective to the at least one of the overhead user interfacing elements; and, the user bending the user's arm/s to raise the handle relative to the user's center of gravity and shorten the overhead pulley cord and the forward pulley cord respective to the at least one of the overhead user interfacing elements.

In another example, also where at least one of the forward user interfacing elements is at least one of the overhead user interfacing elements, the user holds the at least one of the overhead user interfacing elements; the user kneels in a position facing away from the one or more forward pulleys; the user straightens the user's leg/s to lengthen the overhead pulley cord and the forward pulley cord respective to the at least one of the overhead user interfacing elements; the user straightens the user's arm/s to raise the at least one of the overhead user interfacing elements relative to the user's center of gravity (CG) and to lengthen the overhead pulley cord and the forward pulley cord respective to the at least one of the overhead user interfacing elements; the user bends the user's leg/s to shorten the overhead pulley cord and the forward pulley cord respective to the at least one of the overhead user interfacing elements; and the user bends the user's arm/s to lower the at least one of the overhead user interfacing elements relative to the user's center of gravity (CG) and to shorten the overhead pulley cord and the forward pulley cord respective to the at least one of the overhead user interfacing elements.

In another example, where both forward and overhead pulleys are present and the forward pulley cords are the overhead pulley cords, the user may enter a seated position facing toward the one or more forward pulleys, the user holding the one or more overhead pulley interface elements. The user may attach the one or more forward pulley interface elements to the user's leg/s, the user grasping the one or more overhead pulley interface elements with the user's hand/s, the user bending the user's arm/s with the one or more overhead pulley interface elements grasped to lengthen and increase tension in the respective upper pulley cord of the one or more overhead pulley interface elements, thus causing the forward pulley interface element to pull upward on the user's leg; and the user straightening the user's arm/s with the one or more overhead pulley interface elements grasped to shorten and lower tension in the respective upper pulley cord of the one or more overhead pulley interface elements, thus causing the forward pulley interface element to reduce in upward force on the user's leg.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Immaterial modifications may be made to the embodiments described here without departing from what is covered by the claims. In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

An exercise device and methods of using same which result in reduced perceived effort by providing an upper body enabled user-variable assistance to the lower body or core muscles against the force of gravity. Reduced perceived effort results from the perception that the user is assisting themselves. Other benefits include reduced stress on joints that are not working as significantly against the effect of gravity as compared to a conventional weightlifting or bodyweight workout.

Figure 1:
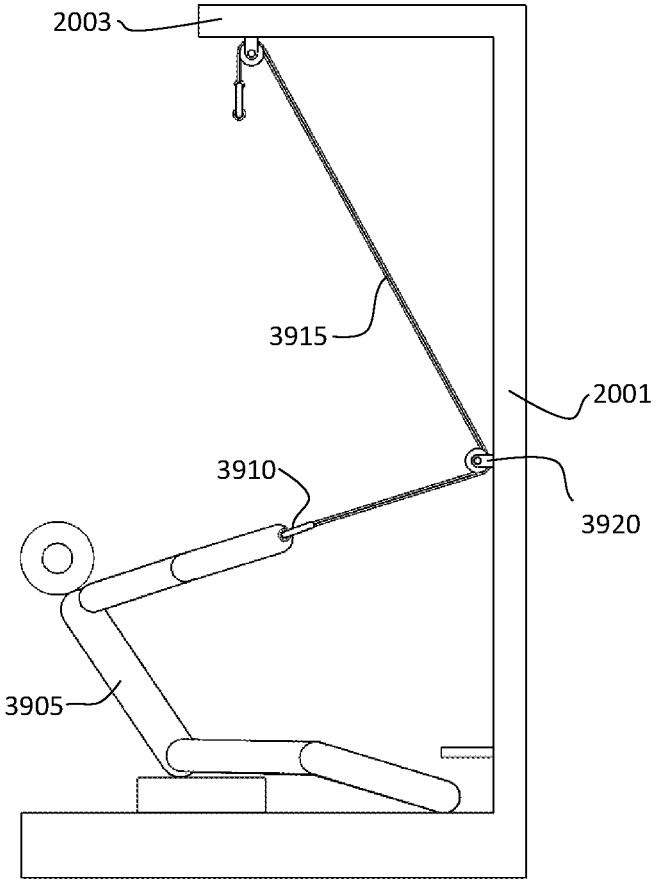
FIG. 1 is a a side view of an exemplary embodiment of an exercise apparatus in use by a person to carry out an exercise.

The inventors disclose a novel exercise apparatus, an example embodiment of which shown in FIG. 1 comprising a structure 2001 having mounting points for pulleys 2010, the pulleys 2010 attached to the structure 2001 to support cables 2015, and user-interfacing elements 2020, attached to one end of the cables 2015. In the embodiment shown in FIG. 1, a freestanding structure is used to support both overhead and forward pulleys. The user-interfacing elements are attachment points to the body of the user, which may be for example handles in a non-limiting example as shown in FIG. 1. These user-interfacing elements allow the user to practice a method of exercise enabled by the apparatus in which they recruit a first muscle group to stretch the elastics, thereby modifying the stretched length of the elastics and thereby increasing the tension in the elastics, and thereby increasing the amount of assistance provided by the elastics to support a second muscle group.

This elastic force opposing the force of gravity on the user can be adjusted in real time by the user by increasing the length of the elastics which thereby increases the force provided by the elastics. As a result, the user can, for example, assist or "self-spot" their lower body with their upper body. At the same time, their upper body muscles which are used to lengthen the elastic, are experiencing muscle tension and doing work which can be used to build muscle and fitness in those upper body muscles. If the lower body reaches a high level of fatigue, the user can decide to use more upper body muscle effort to provide more assistance to the lower body by reducing the effort required by the lower body to raise the Center of Gravity (CG) of the user. If the upper body reaches a high level of fatigue before the lower body, then the user can decide to use their lower body muscles to provide more assistance for the upper body by raising their CG. In this way, and through experimentation with the ideal elastic combination for a particular exercise, the user can adjust the system before an exercise, and adapt their movements during an exercise, to achieve a high level of fatigue in their upper and lower muscle groups simultaneously. This has the potential to enable effective rehabilitation of muscles by allowing the user to assist or "self-spot" themselves, allowing them to optimally exercise their muscles with optimal stress and reduced risk of injury. This device and method of using the device, has been shown, by the inventors, to achieve excellent fitness and strength increase results. In addition, an unexpected effect is that the perceived effort of the user has been found, by users, to seem lower than the actual exertion level because the sensation is of the user helping themselves to make the movement easier for both muscle groups. This is a surprise to people in the test group for the device because it is intuitive to expect that using major muscle groups in the upper and lower body simultaneously would result in a greater sense of exertion. On the contrary, however, the act of assisting oneself has the unexpected effect of feeling like a person is making the exercise easier for themselves.

In an embodiment, the apparatus comprises a rigid structure 2001 with a plurality of mounting points. The mounting points are capable of supporting overhead pulleys which are located vertically above the height of the user's shoulders or head while the user is standing (or above the user's shoulders or head if they are sitting, such as in a wheelchair, or if they are injured or disabled and need to sit instead of stand) and each pulley supports an elastic resistance band. The elastic resistance band or bands attach to a user-interfacing element at a first end of the aforementioned resistance band. The elastic resistance band is fixed to the rigid structure at a second end of the aforementioned resistance band after passing through the pulley. The fixed end of the bands are attached to a wall or frame structure at a lower height than the pulleys for ease of access to the user for assembly and adjustment of the mounting position of the fixed end of the elastics. In an embodiment the resistance band is designed to have a plurality of potential mounting positions, allowing the user to adjust the initial preload of the bands, or the initial height of the bands if no preload is desired and a lower initial handle height is desired.

In an embodiment the rigid frame structure has an element which holds the cord in a stretched position to set the initial location of the user-interfacing element. In an embodiment a user-interfacing element is attached to multiple elastic bands, each of which are supported by a pulley and are mounted to the rigid structure at fixed mounting points above the user's head or shoulders. The elastic bands may have different lengths, allowing the user to adjust the tension response of the user-interfacing element as the user-interfacing element is displaced in a generally downward direction. The elastic bands attached to the user-interfacing elements may have different k values, allowing the user to adjust the tension response of the user-interfacing element by attaching or detaching it to different combinations of the elastic bands. The rigid structure may feature a protrusion within 0.5 m of the floor which a user may use to secure or constrain the vertical movement of their feet during exercises. The machine's user-interfacing elements attach to, or are held by, or are otherwise held in place to a body part of the user. In a non-limiting embodiment, the user-interfacing element is a handle. In a non-limiting embodiment, the rigid structure has a plurality of mounting points for the elastic cords along the rigid structure. In a non-limiting embodiment, the rigid structure is designed to stand on a flat surface and has a first plurality of mounting points located on a roof portion above shoulder or head level of the user and a second plurality of mounting points located on a vertical surface vertically at a similar height of the first plurality of mounting points or between the first plurality of mounting points and the floor.

Embodiments of the present device use interchangeable pulley/elastic cord assemblies that allow downward stretching of the cords from generally above the center of Gravity (CG) of the user when the user pulls in the generally downward direction on handles, relative to the floor and relative to the user's CG, that are connected to one end of the cords after pass through overhead-mounted pulleys.

Figure 2:
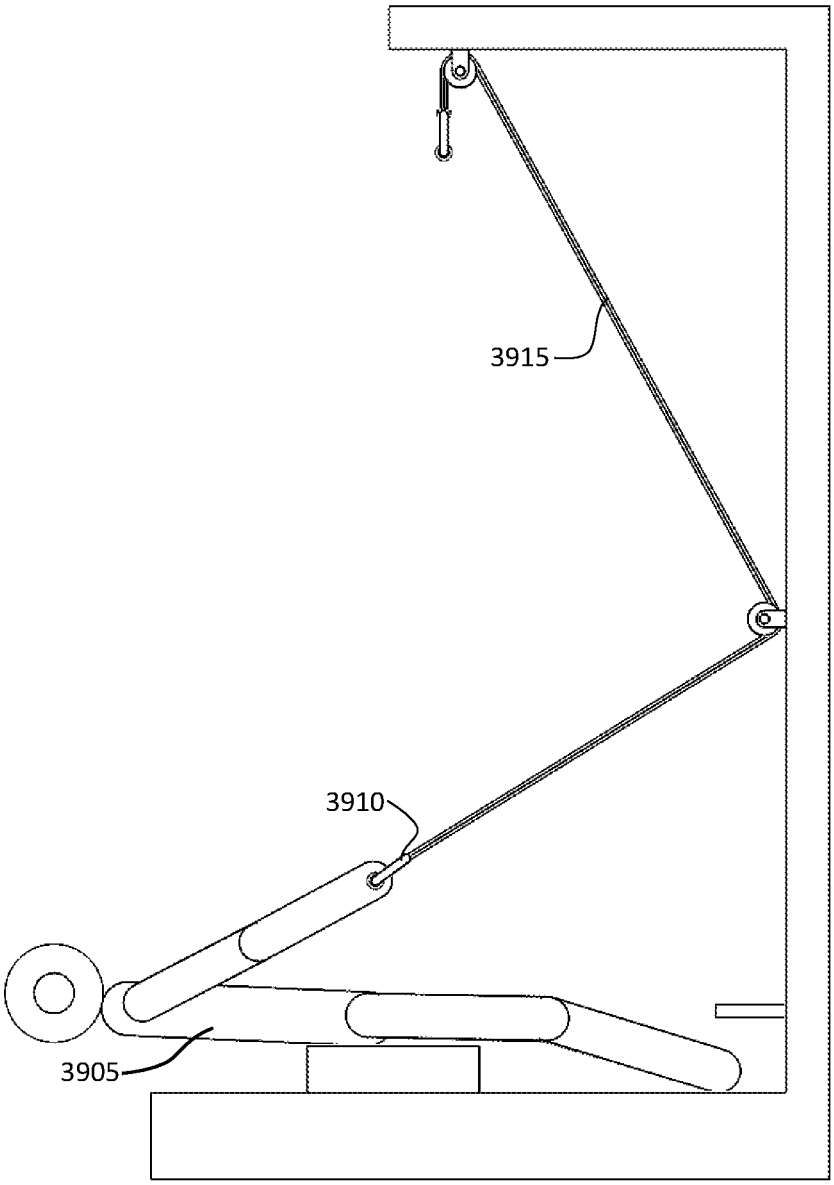
FIG. 2 is a further side view of the embodiment of FIG. 1 with the person shown in a different position of the exercise shown in FIG. 1.

Embodiments shown for example in FIG. 1 also allow primarily horizontal stretching of the same elastic cords, relative to the forward structure and relative to the user's CG. As shown in FIG. 2, when the user pulls primarily horizontally on a first set of handles 3910 that are connected to a first end of cords 3915 after the cords 3915 pass though forward-mounted pulleys 3920, cords 3915 are stretched, increasing the tension in the aforementioned cord. Several advantages of this overhead-pulley combined with the forward-mounted pulley elastic cord system include: 1) ease of exchanging the cords for different combinations of cords strengths for various user weights and different exercises by providing that the overhead-mounted pulley attachment members and forward-mounted pulley attachment members are within convenient reach of a wide range of user heights. 2) The ability to fit the complete assembly into a room with a standard ceiling height of approximately 8 ft while achieving a desired elastic cord stretch ratio of approximately 2-3× for many of the methods oof exercise disclosed here that is only possible with an elastic cord that is of adequate at-rest length. For clarity, if an elastic cord were attached vertically and directly to an 8' ceiling above the user, it would be too short when at rest (and would, therefore, have too high of a stretch ratio) and/or would not have an adequate range of motion for methods of exercise disclosed here. 3) The ability to use the primarily vertically downward motion of the end of one or more elastic cords extending through the overhead-mounted pulleys to cause a more horizontal movement via the other end of the elastic cords passing through the forward-mounted pulleys, of a disabled person's lower body members such as for rehabilitation, stroke recovery, or to promote blood flow and mind-muscle connection with injured or disabled lower body limbs. 4) The ability to use the primarily vertically downward motion of the end of one or more elastic cords extending through the overhead-mounted pulleys, while simultaneously causing a more horizontal movement of the end of another elastic cord via the other end of the elastic cords passing through the forward-mounted pulleys, to achieve a more consistent resistance load on a user's muscles using methods of exercise disclosed here in a room with a common ceiling height of approximately 8' whereby the user is able to exercise by moving the overhead handles downward relative to the user's CG at any time during the lower body vertical motion, in order to provide upper body enabled user-variable assistance to the lower body muscles against the force of gravity. In other words, if at any point during an upward or downward motion of the user's CG, relative to the floor, as the result of a lower body motion such as, but not limited to a squat, the user is able to reduce the effect of gravity on their lower body muscles by pulling primarily downward on the overhead handles, relative to their CG, and thereby add additional vertical tension to the elastic cords. It has been found, through experimentation that pulling the handles downward, relative to the user's CG and through at least 20%, 30%, 40%, 50% or more of the user's vertical arm range of motion ROM) provides two different benefits. The first is the benefit of allowing the upper body muscles to provide a user-variable assistance to the lower body muscles by adding additional tension to the cords in addition to the tension added to the cords from the user moving their CG up and down vertically. The second is the benefit of moving the arms through a ROM that is beneficial for upper body exercise of the arm and back muscles, in non-limited examples disclosed here, of methods of using the device. The greater the tension on the elastic cords resulting from vertically downward extension of the elastic cords by contraction of upper body muscles, the lower the load on the lower body muscles to support the user's mass. This has been found to be beneficial to achieve a high number of reps that are closer to a high level of exhaustion or failure of the lower body muscles, while at the same time providing muscle building stimulus to the upper body muscles by allowing the user to move through a full range of upper body exercise motion under vertical load as a result of the cord tension.

A higher number of reps near failure is believed, by many people in the fitness industry, to more effectively promote an increase in muscle hypertrophy. For example, by using embodiments of the device together with methods of exercise disclosed here, the user can choose to reduce the load on their upper body muscle group, at any time during the lower body ROM, by raising the overhead-mounted handles, relative to their CG. By doing so, the lower body muscles must support more of the bodyweight of the user creating greater muscle building stimulus to the lower body. In contrast, the user can choose to increase the load on their upper body muscle group, at any time during the lower body ROM, by lowering the handles, relative to their CG. By doing so, the upper body must support more of the bodyweight of the user, creating greater muscle building stimulus to the upper body. It has been shown through experimentation that the average user will quickly and intuitively find a coordination of upper and lower body vertical movements which shares the load between upper and lower body muscle groups in a way that both muscle groups reach a similar level of exhaustion or failure at a similar time during a set.

Figure 3:
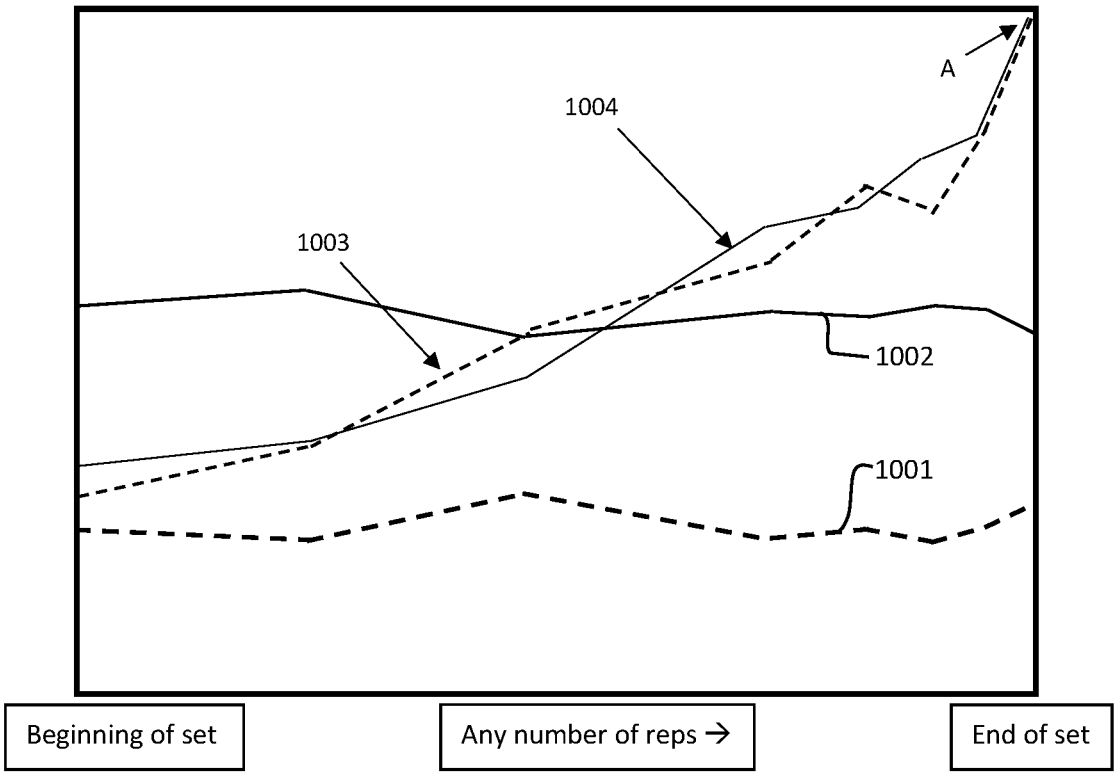
FIG. 3 is a chart showing a graph of an exemplary representation of an interpretation of a user's experience with embodiments of the apparatus.

The graph shown in FIG. 3 illustrates what the inventors believe to be a reasonable non-limiting exemplary representation of a user's experience with embodiments of the device when doing an exemplary chin-up/squat as shown in FIG. 4 through FIG. 8 as a non-limiting example of one method of using embodiments of the device. As the upper body lowers the overhead-mounted handles relative to their CG, it takes on more of the total body weight of the user, and the percentage of body weight supported by the lower body decreases, and vice versa. The portion of the user's weight supported by the user's upper body is shown by line 1001, the portion supported by their lower body is shown by line 1002. Line 1003 shows the upper body perceived muscle burn and 1004 shows the lower body perceived muscle burn. As shown at point A, both muscle groups reach a similar and maximum level of muscle burn and perceived discomfort to the user at a similar time.

Generally speaking, the perceived effort in any muscle group has an associated discomfort level (AKA "muscle fatigue" or "muscle burn") that rises at an increasing rate as the muscle gets closer to failure. The instinctive behaviour of the human body is to naturally seek to reduce the overall muscle burn being experienced by the user. This total discomfort of the user is related to the sum total of "burn" in all the muscles that are under strain at the same time. As shown in the graph, the lower body muscles are able to exert a much greater force than the upper body muscles, but the perceived burn of the user for each of these muscle groups may be similar as each muscle group gets closer to failure. To illustrate this effect, if the user wanted to use the device to train the muscles in their hand and forearm by performing a one-armed chin-up with a single finger, while self-assisting this motion with a leg squat, they could lower their CG relative to the ground into a lowered squat position using their lower body muscles, and simultaneously raise their arm to an upward extended position, relative to their torso and then pull down on the overhead-mounted handle with one finger, relative to their CG, until their finger was experiencing a high level of muscle fatigue and "burn". At the same time, the user could provide assistance to the muscles in that finger so they could perform more reps near failure of the finger muscles and preferably though 50% or more of the arm ROM, by doing an upward squat motion with the largest muscles in the lower body which will push their CG upward with their lower body. Note that pulling downward with their finger and upper body, relative to their CG, creates higher vertically upward resistance force on the handle due to the elastic cord spring rate and lengthening of the cord. Also note that moving their CG upward by pushing vertically downward against the floor with the leg muscles from the lower squat position, will reduce the vertically upward resistance force on the handle due to the elastic cord spring rate and shortening the cord. The user can, by this method of using the device, reach a level of high muscle burn in some of the largest and smallest muscles in the body simultaneously, and in such a way as to use the lower body muscles to assist the upper body muscles so both muscle groups can reach a similar level of muscle burn at a similar time. The point of this illustration is that the human brain will intuitively figure out how to reduce the discomfort from muscle burn in the finger/forearm by recruiting much larger muscle groups in the lower body. This will happen until the lower body (which is supporting the rest of the body weight which is not supported by the finger) gets to a level of perceived muscle discomfort that is similar to the finger muscles. And although the finger muscles are much smaller (and the cord tension relatively low) the pain signal to the brain from these small muscles can be just as significant as the pain signal from much larger muscles in the lower body. As a result, it is a simple and intuitive thing for a user to find a level of exertion from the finger/forearm muscles and the lower body muscles that provides a level of training stimulus that is appropriate to both muscle groups simultaneously.

The methods of exercise disclosed here provide a wide range of ways to implement this principle to bring upper body and lower body or core muscles to a similar level of exertion for an effective training stimulus to upper and lower body muscles at the same time, regardless of the relative size and strength of the upper body muscles compared to the lower body muscles.

By using embodiments of the device combined with the methods of exercise disclosed here, the human body can easily be taught to vary the assistance provided by the lower body to reduce the load on the upper body so both muscle groups are at their lowest possible perceived discomfort (or "muscle burn") at all times. Likewise, by using embodiments of the device combined with the methods of exercise disclosed here, the human body can easily be taught to vary the assistance provided by the upper body to reduce the load on the lower body so both muscle groups are at their lowest possible perceived discomfort (or "muscle burn") at all times.

At the same time, methods of using the device, as disclosed here, provide the opportunity for a full range of motion from upper and lower body muscles during the same set. This range of motion is believed, by many people in the fitness industry, to be critical to effective muscle strength, hypertrophy and muscle and joint mobility training. With regard to the full ROM training benefit of methods of using embodiments of the device, methods of training are disclosed here which allow the user to ensure a full range of motion of upper body muscles during a rep, even if the upper body muscles are fatigued to a point where they do not have the strength on a particular rep, for the user to pull the handle/s to the lowest point of the upper body ROM when the CG is at its lowest position during the motion. In this case, the user will pull the handle down as far as they are able, relative to their CG, when their CG is at the lowest point relative to the floor, and then continue to pull the handle further down if they are able, relative to their CG, as the user raises their CG relative to the floor as a result of lower body muscle contraction, thereby reducing the tension in the cords and allowing the user to pull the handle/s down further relative to their CG.

As a result, by implementing one or more methods of exercise disclosed here, together with the use of embodiments of the device disclosed here, the user can intuitively choose a combination of upper body and lower body exertion that bring both muscle groups through 50% or greater ROM and also to a high level of muscle burn/discomfort at the same time, at the end of a set. This has been shown, by the inventors to provide tremendous benefit in terms of increasing muscle strength, size and fitness. At the same time, the inventors have discovered an additional surprising effect of methods of exercise disclosed here using embodiments of the device disclosed here. Specifically, the human mind of many people tends to register or primarily focus on either the upper or lower body muscle group which is closest to failure at any moment (IE: it will focus on the most uncomfortable muscle group) as doing most of the "work" while, their mind tends to registers the upper or lower body muscle group that is less close to failure, at any moment, as "assisting" the other muscle group. It has been found by experimentation that the perception, to the user, of which muscles are "working" and which muscles are "assisting" can switch rapidly back and forth in the mind of the user depending on which group is closest to failure. It has also been found, by the inventors that it is not common for both muscle groups to register as primarily "working" at the same time until a short time before both muscle groups get to a point of complete exhaustion or failure. In this way it is possible to get two major muscle groups to reach failure with what feels, to the user, like the effort of only one of the muscle groups. It has also been found, by the inventors, that even the peak effort for either muscle group, will, for a high percentage of people, seems like it is at a lower level than would typically be felt doing a conventional (not self-assisted) weighted or body weight isolation exercise, because both the upper and lower body muscle groups are both being assisted by the other muscle group. As a result, using the device by implementing methods of exercise disclosed here has been shown to provide very high muscle fitness and growth stimulus with lower perceived effort than a user might expect. A number of users have even given the feedback that threw workout with this system is enjoyable as compared to a conventional workout because it is less painful, and the sensation of assisting one's self also gives a perception of being in a lower gravity experience.

Similar benefit can be achieved by the user for a number of methods of combined upper body/core exercise methods disclosed here. In these methods of exercise, which use embodiments of the device disclosed here, the user will be in a prone position and will provide upper body enabled user-variable assistance to the core muscles against the force of gravity by holding and moving the forward-mounted handles relative to their CG and toward their upper body through a 50% or greater ROM and at any time during a core exercise such as a sit-up, to reduce the effect of gravity on their upper body, and therefore reduce the load on their core muscles. In this case, the upper body enabled user-variable assistance to the core muscles against the force of gravity allows the user to assist or "spot" their core muscles by doing more to overcome the effects of gravity on their upper body with their upper body muscles as a result of moving the forward-mounted handles relative to their CG in a direction primarily parallel to the length of their body and toward their upper body through at least 50% of the available ROM for the upper body motion.

In summary, the result of using embodiments of the device to implement methods of exercise disclosed here allows the user to complete a significant number of combined upper/lower body exercises with a lower perceived effort than would be expected, despite the fact that they are exercising an upper body and a lower body muscle group at the same time. Intuitively, a user might expect this to feel like twice as much effort, but the inventors have demonstrated that the human body perceives the overall effort as lower than expected. The inventors believe that this is because the average user is not able to easily focus on both the upper body and the lower body muscle groups at the same time. As a result, the muscle group that is the closest to exhaustion becomes the user's focus, while the other muscle group registers, in the mind of the user, as providing assistance to the first muscle group, even though it may also be working at a similar but slightly lower level of exhaustion. It has been shown by experimentation that this effect is common to new and experienced users of the device. They feel as though they are "making it easy on themselves" when, in fact, the device and methods of using it as disclosed here, are allowing them to bring an upper body muscle group and a lower body muscle group to a high level of exhaustion or failure at the same time. It is also disclosed here, that a full range of motion from the upper and lower body muscles is preferred and made possible by methods of using configurations of the device.

The present device is ideally suited for use in a home gym where ceiling heights are commonly around 8 feet. If a person were to attach the fixed end of an elastic pulley to an 8' ceiling and pull downward on a handle attached to the other end of the elastic, the starting length of the elastic could be as short as 1 ft or even shorter for a taller person performing certain exercises as disclosed here. It has been found by experimentation that an elastic cord of 1 ft length will have to stretch too much to perform a high percentage of the exercises disclosed here. One important issue is that the elongation of the elastic may be too high for long service life. The other issue is the resistance force which will tend to increase at too high of a rate if starting from a length of around 1 ft.

The use of overhead-mounted pulleys and forward mounted pulleys allows various methods of using the device, as disclosed here by allowing either a downward resistance force, or a more horizontal resistance force, or a combination of the two forces with a resultant intermediate force that can be tuned to have a greater or lesser effect in the downward direction as compared to the horizontal direction as disclosed here. The use of a longer elastic as a result of the elastics passing through both sets of pulleys and the ends of the elastics being prevented from passing through both sets of pulleys, reduces the stress on the elastics for long service life and allows an appropriate rate of tension increase with lengthening of the elastics to perform the methods of exercising disclosed here.

The overhead-mounted pulleys in combination with the forward-mounted pulleys also allow unique movement combinations for both disabled and able-bodied user motions.

The inventors have found experimentally that a desirable length for elastic resistance bands, such as latex elastic resistance bands is about 4.5 feet in length at rest, and are ideally stretched up to double more their un-stretched length during some of the exercises. This results in a stretched length of around 9 feet or more. If the elastic bands were fixed to a ceiling (without the benefit off passing through a pulley as with the present device) and, if the handles at the non-fixed end were located, at rest, above the user's head, this would require a ceiling height roughly 4.5 feet higher than the height of the user's hands when their arms are extended above their head. This ceiling height is not as common for home gym rooms and will be unsuitable for many homes. Attaching the fixed end of the elastics to a fixed member 4 ft to 6 ft above the user is also impractical and inconvenient. The use of a pulley above the head or shoulder height of the user with the fixed end of the elastic cords being secured to a wall or structure (or constrained by a pulley that is rotatably fixed to a wall or structure, at a similar height or lower than the pulleys, allows for a drastic reduction in overall device height and allows the fixed end of the elastic cords to be easily adjusted by the user.

By contrast, if the bands were fixed above the user, to a common ceiling height of eight feet, and the handles were above the user's shoulders, and if the user is between 5 feet and 6 feet tall, the bands would have to stretch by more than three or four times their original length for many of the exercises described here. This is considered undesirable since bands may break or have stiffness that change undesirably when stretched to this degree.

In a non-limiting embodiment, the machine comprises a structure having a mounting point for pulleys located above the head or shoulders of the user. The structure has a plurality of locations located at a similar height or below the pulleys which are mounting points for the non-handle end of the cords.

Fixing the cords to mounting points located at a similar height or lower than the pulleys and fixed to a wall or structure that is horizontally forward of the upper pulleys by greater than the length of a horizontal leg and foot or greater than the horizontal upper leg of the user, allows the exercises described here to be performed without obstruction.

In a non-limiting embodiment, the wall or frame of the device has a user-adjustable feature which allows for pre-tensioning the cords so that the elastics are in tension and pulling generally downward on the handles will provide assistance to the lower body muscles that are supporting the remainder of the user's mass, immediately from their uppermost position of the handles. In another embodiment shown in FIG. 9-FIG. 12, the initial length of the elastics 4805 is unchanged but the height of the fixed end 2605 and pulley/handle ends 4810 of the elastics can be moved vertically or horizontally or tilted toward the user as one unit. This allows for ease of adjustment of the initial height of the handles relative to the height of an individual user.

The distance of the handles on a horizontal plane away from the wall or structural frame of the device should be at least far enough to allow a user to do lunge squats while facing the wall without their foot or knee contacting the wall.

For a $95^{th}$ percentile male, with regard to height, this distance will be about 25" with adequate clearance. A $5^{th}$ percentile woman, with regard to height, would need about 17" with adequate clearance. These numbers will be smaller for children and for shorter people, and larger for a small percentage of people. The device shown here has pulleys that can be spaced horizontally away from the wall by 19" or, in some figures, 29". This is considered a good range of pulley distances from the wall for a wide range of adult users, but distances of greater than 29" or less than 19" may also be used.

When a user adjusts the combined cord strength appropriately by attaching or detaching different strengths of cords from the structure and/or attaching different combinations of those cords to the handles, it is possible for the user to experience a high level of muscle tension in muscle groups of their upper and lower body in the same set. In methods of exercise described in this document, the desired level may, for example, be a high level of exhaustion or muscular failure. By providing a convenient and fast way for the user to switch the elastic cords, as described later in this document, it allows the user to conveniently fine tune the device so an upper body muscle group, in a combined exercise method, can reach a high level of exhaustion or failure at a similar number of reps as the lower body muscle group in that combined exercise method. A method of achieving this objective is as follows using a chin-up squat, as shown in FIG. 4 to FIG. 8 as a non-limiting example: 1) The user chooses a combination of cords that they believe will accomplish a similar level of muscle fatigue in the upper and lower body. 2) The user performs the exercise method as described in this document. 3) If the lower body muscles reach their desired level of fatigue in a set, but the upper body muscles do not, then the user chooses a different combination of cords for the next set which will be stronger. This will allow the upper body to provide more assistance to the lower body muscles against the force of gravity so the lower body muscles do not have to work as hard. It will also put a higher load on the upper body muscles so they have to work harder. The result, if adjusted to within the ideal range of total cord strength, is a greater level of fatigue of the upper body on the next set and a lower level of fatigue on the lower body in the next set, leading to a more similar level of fatigue in the upper and the lower body muscles by the end of the set. 4) If the upper body muscles reach their desired level of fatigue in a set, but the lower body muscles do not, then the user chooses a different combination of cords for the next set which will be less strong. This will allow the upper body to provide less assistance to the lower body muscles against the force of gravity so the lower body muscles must work harder to perform the exercise. It will also put a lower load on the upper body muscles so they have to work less hard. The result, if adjusted to within the ideal range of total cord strength, is a greater level of fatigue of the lower body on the next set and a lower level of fatigue of the upper body in the next set, leading to a more similar level of fatigue in the upper and the lower body muscles by the end of the set.

Other ways of achieving a similar level of muscle fatigue at the end of a set are discussed in this document and include ways of increasing the total work done by the upper or lower body muscle group if one of them is judged, by the user, to be fatiguing at a lower rate than the other muscle group.

It is believed by many people in the fitness industry that human growth hormone production is more pronounced as a result of using full body exercises as compared to isolation exercises. The device disclosed in this document optimizes the user's ability to conduct full-body workouts by targeting more than one muscle group at once in a manner that reduces perceived effort.

Embodiments of the device are relatively simple in construction allowing cost-effective manufacturing. Embodiments can easily be adjusted to suit people of a wide range of sizes including from a $5^{th}$ percentile female height, up to a $95^{th}$ percentile male height. Embodiments of the device are disclosed which can be adjusted by the user to adapt to this range of user sizes while also allowing the device to fold up against a wall for storage in a room with a common home-gym ceiling height of approximately 8 ft. Embodiments of the device are also disclosed which allow easy adjustment of the resistive force on the handles, provided by the elastic cords, for a wide range of methods of using it. Embodiments of the device are also disclosed which track progress and provide feedback to the user with electronic sensing and visual and audio feedback as well as instructing them on proper technique and how to effectively adjust the elastic cord tension.

Additional benefits of the device, and methods of using it, include reduced stress on the joints of the user. The inventors have found that there are many people who want to get in better shape, but the anticipated discomfort of conventional resistance exercising creates a dread that prevents them from reaching their fitness goals because of the stress on their joints and high perceived effort. Methods of using the device, disclosed here, give the user the feeling of being in a lower gravity environment, because they are providing an upper body enabled user-variable assistance against the force of gravity that reduces stress on the joints and has been shown, with various users, to be enjoyable or fun to use.

Embodiments of the device use one or more elastic cords that pass though a set of pulleys which are located vertically above a standing or sitting user and, another set of pulleys located in front of the user and below the height of the first set of pulleys. Handles can be attached to one or both ends of the cords which are pulled by the user to provide resistance training of an upper body muscle group while assisting a lower body or core muscle group against the force of gravity.

Figure 15:
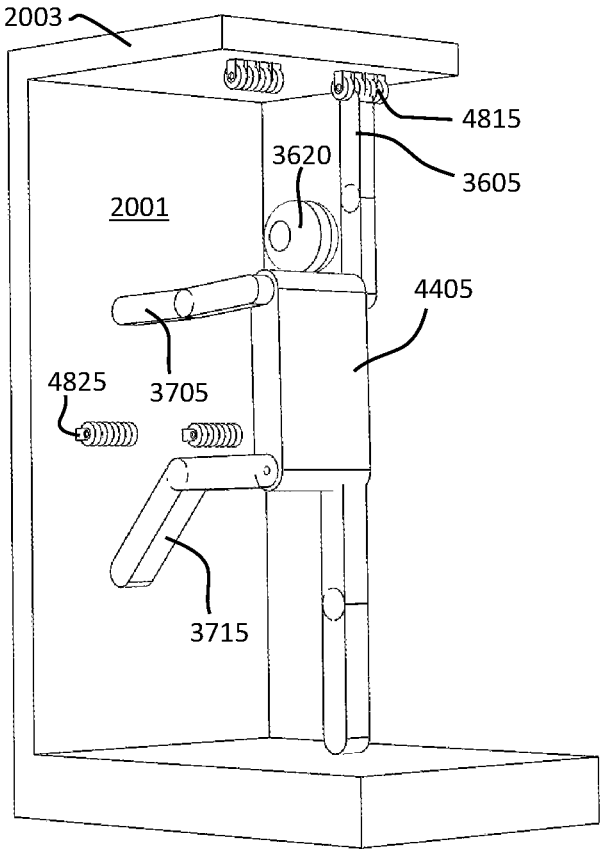
FIG. 15 is an isometric view of an embodiment of an exercise apparatus shown without cords or handles to better show pulley locations in relation to a user of the device.

Shown in FIG. 15 is a non-limiting example of a fixed overhead pulley 4815 location relative to a user 4405 and forward-mounted pulley 4825 location relative to said user in accordance of the working principles of embodiments of the device. The size of the user may vary from a $5^{th}$ percentile female up to a $95^{th}$ percentile male. The requirements of the device, relative to each size of person, will be similar, relative to the user, and as follows. Note that it is understood that this description is not intended to provide a single exact position for the overhead and forward sets of pulleys for all sizes of users. Rather, a set of practical limitations are disclosed relative to a person of any size from a $5^{th}$ percentile female up to a $95^{th}$ percentile male to provide a device which enables the range of methods of performing the various exercises shown here.

Figure 34:
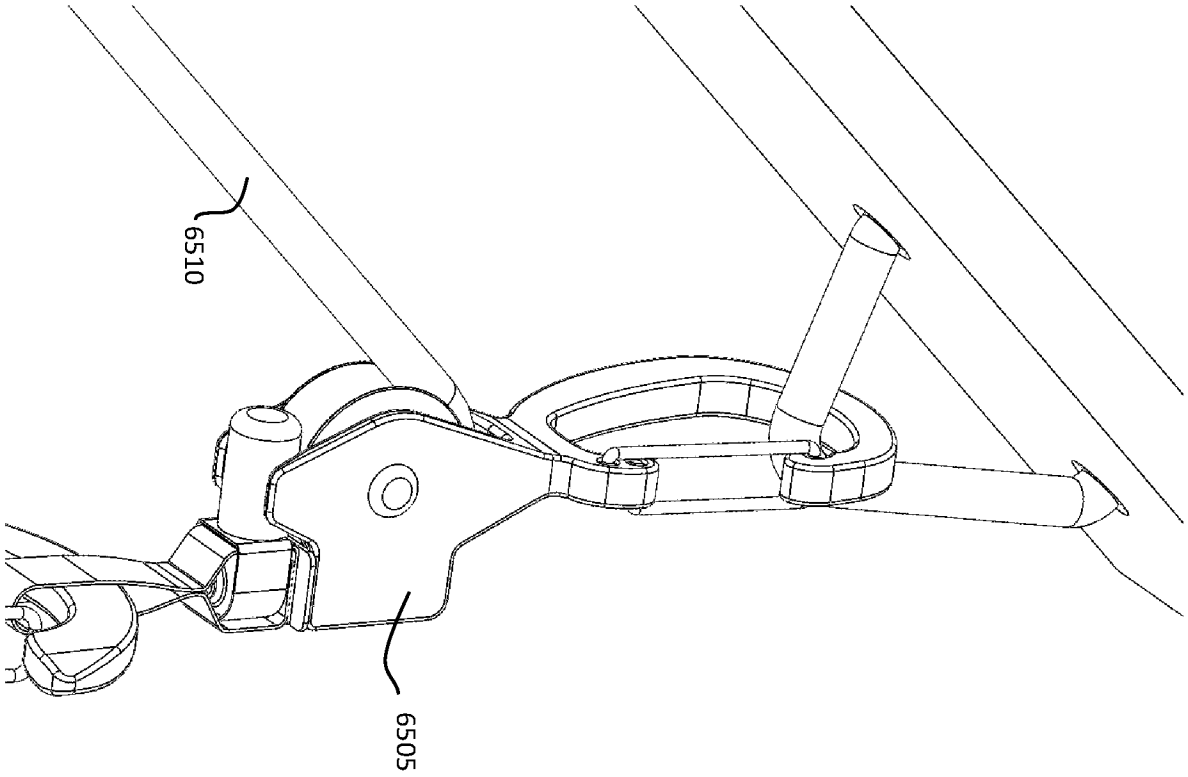
FIG. 34 is a closeup isometric view of a pulley of FIG. 33.

In FIG. 15, the user is shown standing and facing a wall structure which comprises a forward-mounted set of fixed pulleys. For clarity, "fixed pulleys" in this description refers to a pulley or pulleys that are flexibly secured to a fixed member such that they are able to self-align with the direction of tension of the elastic cords. A non-limiting exemplary means of allowing this pulley self-alignment is shown in FIG. 34. The "fixed pulley" is, therefore, able to articulate through a wide range of angles but a limited range of positions relative to the structure as constrained by the flexible or articulated securing means.

As shown FIG. 15, a user of a given height stands directly below the overhead-mounted pulleys. With a vertically extended arm 3605, the user 4405 will preferably be able to at least reach and grasp the upper pulleys 4815 without standing on a platform. This is a desirable maximum height of the pulleys 4815 for a user. A minimum height for the pulleys is that the user should be able to stand directly under the pulleys 4815 with clearance above their head to the pulleys 4815. This will give the user enough range of motion to perform the exercises disclosed here. It is understood that it is possible for a shorter person to perform many of the exercise methods disclosed here with a device that is optimized for a taller person, and visa versa. In an embodiment shown in FIG. 18 and FIG. 19, the overhead-mounted pulleys 4815 and forward-mounted pulleys 4825 are adjustable height and the overhead-mounted pulleys are an adjustable distance from the forward mounted pulleys to allow for optimal placement for a wide range of user heights. In the non-limiting embodiment shown in FIG. 18, the lower pulleys 4825 may be optionally mounted on alternative mounting points 7405. Other embodiments are less easily adjustable but can be permanently mounted during installation at a position that is suitable for one or more of the primary users.

Figure 16:
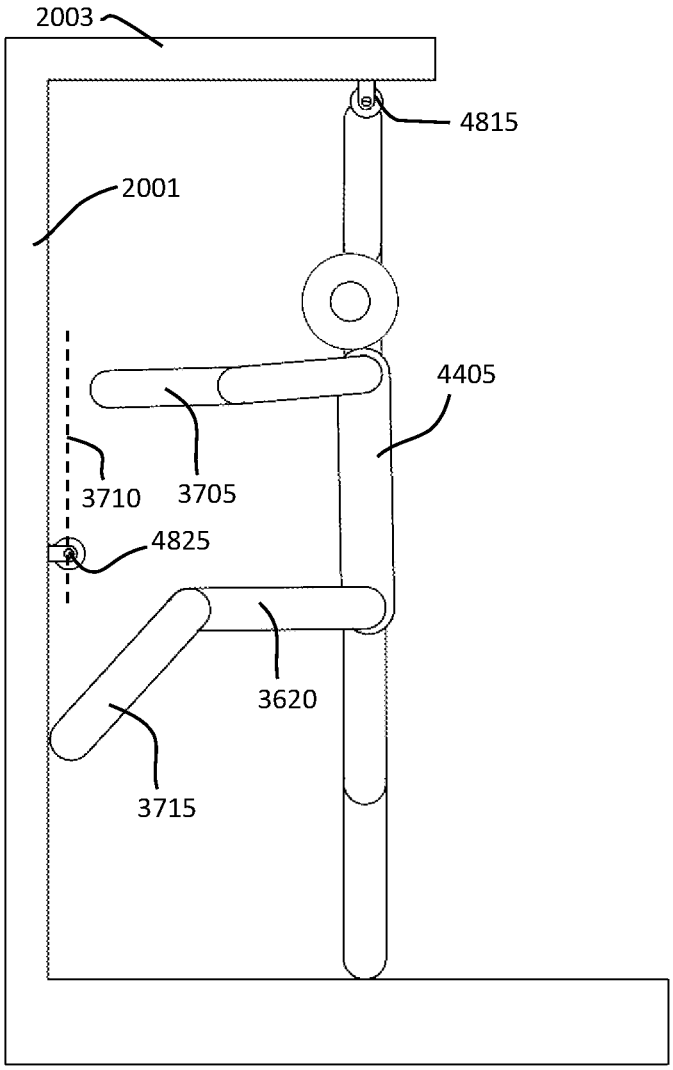
FIG. 16 is a side view of the embodiment of FIG. 15 shown without cords or handles.

FIG. 16 shows a side view of the same 3D representation as the previous FIG. 15, the user is also shown standing directly under the overhead-mounted pulleys 4815, and with a straight arm 3705 extended forward toward the fixed plane 3710 which intersects the rotation axis of the forward-mounted pulleys. It is preferable, as shown in this FIG. 16, that the user would be unable to touch the wall 2001 from this position with their outstretched arm 3705 and hand. This ensures that the user 4405 will be able to perform exercises like the dip lunges, shown in FIG. 20 to FIG. 23, without contacting the wall with their feet or knees.

Note that the user is shown with a horizontally extended upper leg 3620 and partially extended lower leg 3715. In an embodiment it is considered acceptable that the user 4405 would not be far enough from the wall to extend their leg completely horizontally without contacting the wall with their foot. However, the user may be restricted from performing certain exercises.

In an embodiment, the overhead-mounted pulleys 4815 to be further from the wall such that the user would not contact the wall with a completely horizontally extended leg. In this embodiment it is considered preferable that the overhead-mounted pulleys 4815 would be horizontally far enough from the forward-mounted pulleys 4825 to allow a straight and horizontal leg without contacting the wall 2001 or intersecting a vertical plane passing through the axis of the pulleys 3710. This would allow a user to perform the assisted pistol squat motion shown in FIG. 24 through FIG. 28 while facing the forward-mounted pulleys. Alternatively, if the overhead-mounted pulleys are located horizontally close enough to the forward-mounted pulleys that the user cannot horizontally straighten their leg when facing the horizontally-mounted pulleys, the user has the option to face away from the horizontally-mounted pulleys to do a pistol squat as shown in FIG. 24 through FIG. 28.

Figure 17:
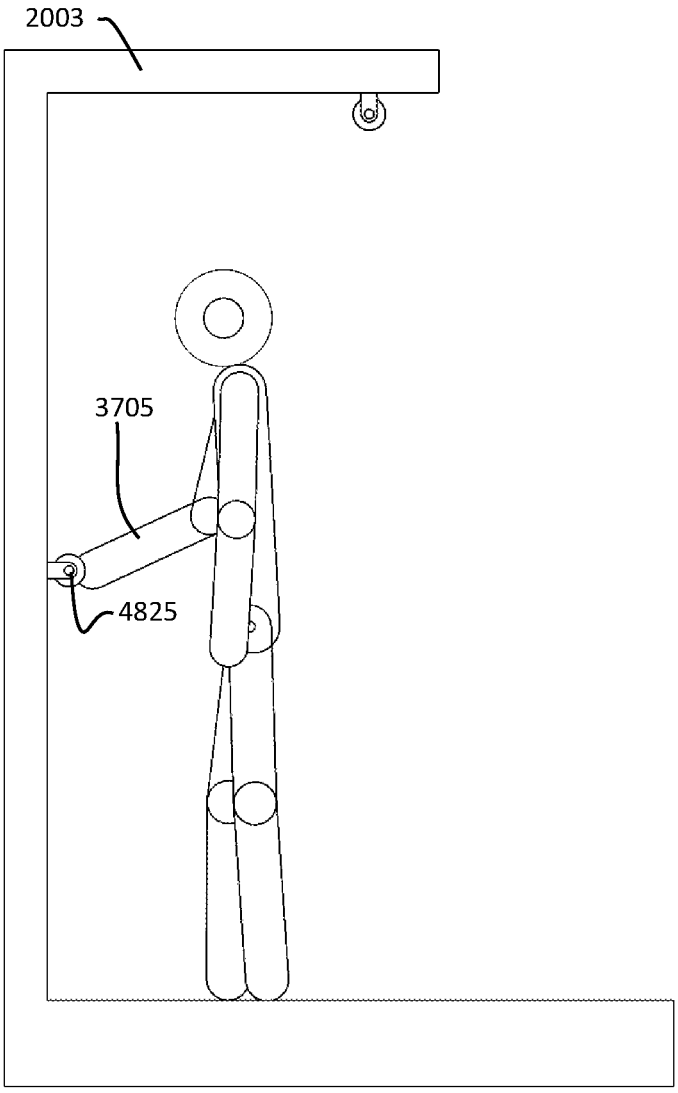
FIG. 17 another side view of the embodiment of FIG. 15 shown without cords or handles, with the user shown in a different posture to illustrate pulley locations in relation to the user.

In FIG. 17, a non-limiting example of a forward-mounted pulley height is shown for a given user. An objective of this exercise device is to reduce the unwanted stress and strain of setting up the device. By contrast, working out with barbells or dumbbells may often require a user to pick up heavy weights from a range of heights including low enough to require a user to bend considerably at the waist. With embodiments of the present device, the forward mounted pulleys are preferably fixed to the forward member at a height that is above the downward stretched arm of a given user, when the user is standing straight, so the user is not required to bend at the waist to attach or detach the pulleys and elastic cords from the forward mounted pulley location. A secondary and non-obvious benefit of this forward-mounted pulley height is that it ensures that the pulleys are vertically high enough above the floor to provide assistance against the downward force of gravity to the core muscles such as during an exercise like the bicep curl/sit-up shown in FIG. 1 and FIG. 2. If the forward mounted pulleys are fixed at too low of a height, the assistance will be too much in the horizontal direction and not enough in the vertical direction which will not effectively provide the upper body enabled user-variable assistance against the force of gravity during certain upper body/core combined methods of exercise as disclosed here.

Figure 33:
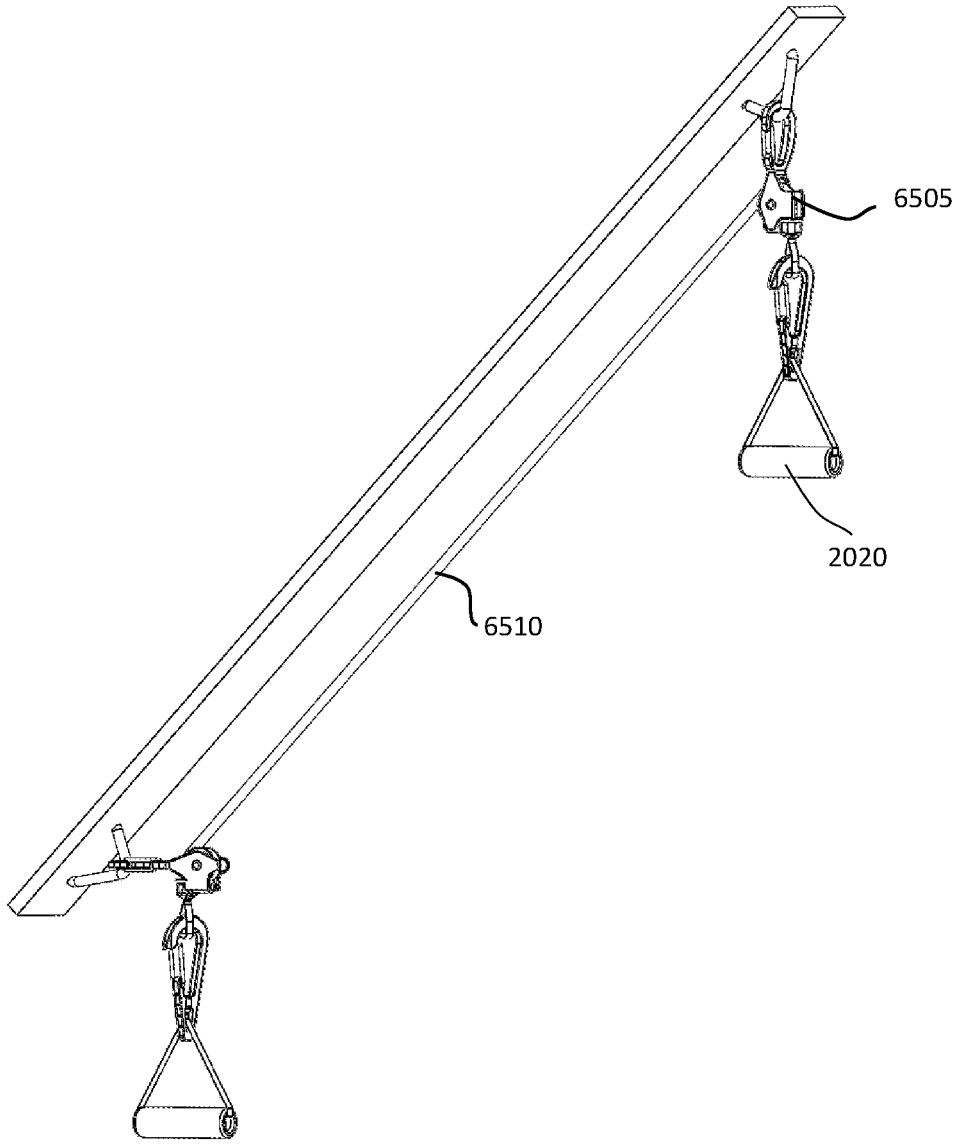
FIG. 33 is an isometric view of two pulleys suitable for use in embodiments of exercise apparatus, and a cord extending between the two pulleys with a handle at each end.

It is noted that in embodiments of the device, the pulleys are not permanently connected to the pulley attachment members. Rather, the pulleys are assembled to individual elastic cords (such as, but not limited to one pulley or two pulleys connected to a cord as a single assembly as shown in FIG. 33. Regardless of whether the pulleys are permanently or temporarily fixed to the wall or ceiling or other structure, the position of the pulleys when fixed, should be within the limits disclosed here.

Figure 29:
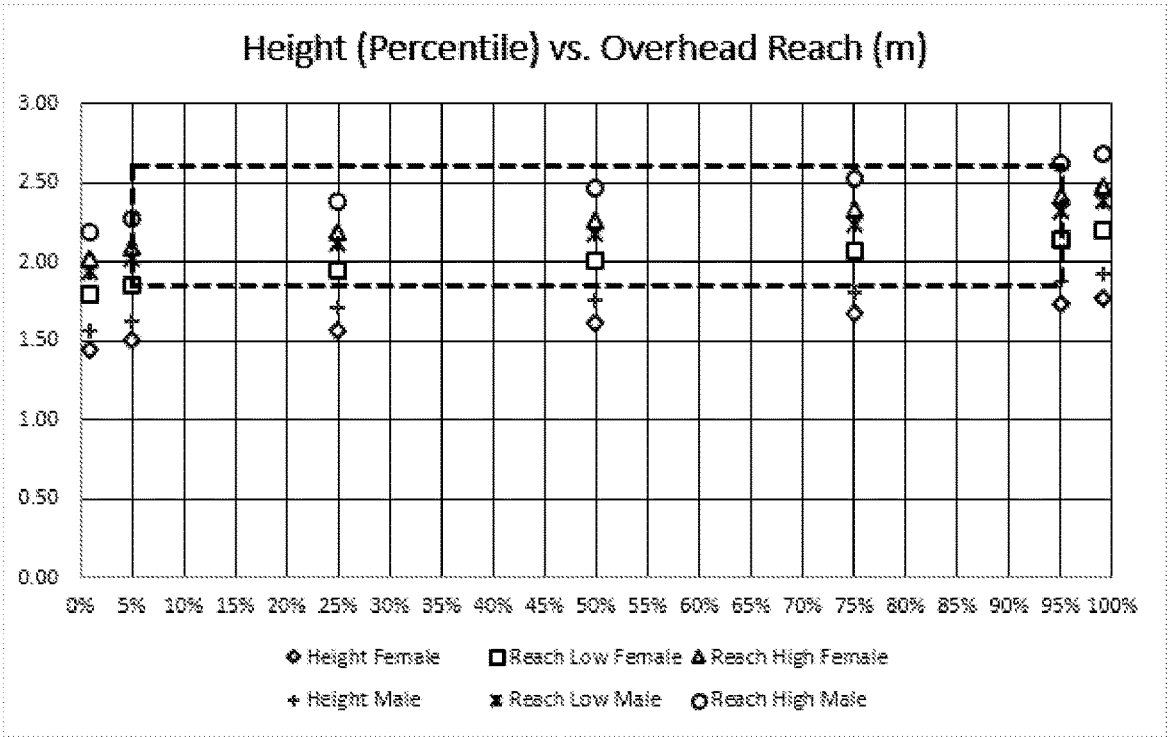
FIG. 29 is a chart showing relationships between height and reach.

In summary, the overhead-mounted pulleys are preferably within vertical reach of a given user and above the head height of said user. It is important that the overhead-mounted pulleys are low enough to allow convenient attaching or detaching various strengths of elastic cord to achieve a range of total cord strengths. If the overhead-mounted pulleys are too low, however, a full range of vertical motion of the user may not be possible. The chart shown in FIG. 29 shows the overhead grasping height for a range of user heights from a $5^{th}$ percentile female up to a $95^{th}$ percentile male. A person's height to a flatfooted overhead reach is generally within the extremes of a ratio of 1.24 to 1.4. Thus, a height between the upper and lower extremes is shown for men and women at each height percentile. The rectangle superimposed over the chart shows the range of grasping heights which would compatible with a device designed with a device with a lowest overhead handle height of ~1.8 m which would be suitable for a $5^{th}$ percentile height female and a maximum overhead handle height of ~2.6 m which would be suitable for a $95^{th}$ percentile height male, assuming that the user's hand would be at the height of the handle. The height of the overhead-mounted pulleys, is preferably within 300 mm-800 mm of the overhead grasping height of a given user depending on their height. The height of the pulleys, for the purpose of this document, will be from the floor to the center axis of the overhead pulleys. Variation above or below the vertical grasping height measurement is necessary for adjustable embodiments of the device that have discrete adjustment positions that may not be at the exact reach height for a given user. It has been shown by experimentation that this pulley height measurement is beneficial but that some variation can be tolerated and still allow for completion of methods of exercise disclosed here. For the purpose of this document, the height of a pulley is measured from the floor to the center axis of a pulley. If a handle is higher than ideal when at rest against an upper pulley, a user may attach a cord extension such as a non-elastic cord to the end of an elastic cord assembly to bring the handles to a suitable starting position without altering the k-value of the cords.

The overhead-mounted pulleys are also preferably at a horizontal distance from the forward-mounted pulleys that is equal to or greater than the outstretched arm and hand length of the user. This is important to ensure that a user can perform a number of the methods of exercise disclosed here without interference from the device structure or wall. The following chart shows the horizontal reach for a range of user heights from a 5th percentile female up to a $95^{th}$ percentile male. The horizontal distance from the forward-mounted pulleys to the overhead-mounted pulleys, is preferably within 100 mm, 200 mm, 300 mm, 400 mm, 500 mm of the forward reach of a given user. The variation above or below the horizontal reach measurement in the chart is necessary for adjustable embodiments of the device that have discrete adjustment positions that may not be at the exact height for a given user. It has been shown by experimentation that this pulley horizontal distance is beneficial but that some variation can be tolerated and still allow for completion of methods of exercise disclosed here. For the purpose of this disclosure, the horizontal distance of the overhead-mounted pulleys is measured from the center axis of a forward-mounted pulley to the center axis of an overhead-mounted pulley.

The forward-mounted pulleys are preferably at a distance above the floor which does not require a standing user to bend at the waist to reach them. This is especially important for elderly people or anyone who has lower back pain because it will often be necessary to switch out the forward-mounted pulleys of one or more cords early in a workout session before the user's lower back is fully warmed up and may be vulnerable to injury from this motion. The vertical distance from the floor to the forward-mounted pulleys, is preferably within 100 mm, 200 mm, 300 mm, 400 mm, 500 mm of the lower reach limit of a given standing user. Variation above or below the vertical reach measurement is necessary for adjustable embodiments of the device that have discrete adjustment positions that may result in the pulleys not being at the exact height for a given user. It has been shown by experimentation that this pulley vertical height is important but that some variation can be tolerated and still allow for completion of methods of exercise disclosed here. For the purpose of this document, the vertical height of the forward-mounted pulleys is measured from the center axis of a forward-mounted pulley to the floor.

Measurements and dimensions given herein are descriptive of general values that have been found by the inventors to be appropriate for embodiments of the disclosed invention, but are not strict limits or requirements for design of the disclosed device. Modifications can be made to the dimensions described herein without departing from what is covered by this document.

The inventors have determined that a preferred configuration of the overhead-mounted pulley attachment points is directly above the user's CG and above the height of the top of their head (to allow adequate downward range of motion for the exercise methods disclosed here) and at or below the top of the upward stretched straight arm and fingers of the user. For a $5^{th}$ percentile tall woman, the maximum overhead grasping height is generally accepted, at the time of this document, to be around 1890 mm, and for a $95^{th}$ percentile tall male, the overhead grasping height is generally accepted, at the time of this document, to be around 2310 mm. In the embodiment shown in FIG. 13, the user is holding the handles at about a 2100 mm height, and the maximum handle height of the device is around 2300 mm. In the same embodiment shown in FIG. 14, the minimum height is shown to be about 1744 mm, well within the reach of a $5^{th}$ percentile height woman. The head height of a $95^{th}$ percentile male is generally around 1860 mm, so a single non-adjustable overhead pulley mounting feature height of around 1890 mm (+−50 mm, +−100 mm, +−150 mm, +−200 mm) will allow a $5^{th}$ percentile tall woman to switch out elastic cords without standing on anything, while allowing a $95^{th}$ percentile tall male to use the device with the pulleys starting in the at-rest position above their head or at least above their shoulders.

In another embodiment of the device disclosed here, the overhead pulley attachment height is a single non-adjustable vertical position of around 2310 mm which is high enough that a $95^{th}$ percentile tall male can change pulleys without standing on anything and will also provide this person with a full range of vertical handle motion. A person if the height of a $5^{th}$ percentile female with less vertical reach, must only stand on a platform that is a maximum of 450 mm to change the cords. This is considered, by the inventors, to be a safe and convenient platform height which is understood by the inventors to be at or below the maximum step height of a $5^{th}$ percentile tall female with their upper leg at a maximum angle of horizontal.

Note that all male and female percentile heights shown here are for adults. Embodiments of the device are also envisioned and anticipated by the inventors for children by applying the same principles for and relative to a wide range of children's heights.

Many different structures to achieve pulley placements within these ranges are possible and conceived by the inventors. These include, but are not limited to, metal, plastic, or wooden structures which are fixed or articulated, movable, freestanding, or fixed to a wall and/or ceiling or other structure. Constructions disclosed here have certain features and benefits that are described here, but it is understood that other constructions are possible and conceived by the inventors which provide a user with the working principles of the invention.

For certain environments, such as a home gym with an approximately 88 ft ceiling, it may be beneficial for the apparatus to be capable of storing compactly when not in use. For such environments, the inventors disclose a method of constructing the apparatus described herein which allows for the device to be stored flatly against a vertical surface when not in use. In the non limiting embodiment shown in FIG. 9, the apparatus features a wall plate 2505 which may be rigidly affixed to a vertical surface by screws, clamps, or other conventional methods. The apparatus further features a pivoting upper plate 2510 to which a plurality of pulleys 2515 is affixed. The pivoting upper plate 2510 may rotate relative to the wall plate 2005 along an axis substantially parallel to the vertical surface such that the pivoting upper plate 2510 may have a vertically aligned stored position and an angled deployed position. In the stored position, the pivoting upper plate may rest along the vertical surface and be held there by means such as but not limited to magnets, to minimize the amount of space occupied by the apparatus. In the deployed position, the pivoting upper plate may lean away from the vertical surface, allowing the plurality of pulleys to hang over substantially empty space in order to allow for their use in the exercises described herein. The pivoting upper plate may be retained in the deployed position through methods including but not limited to a bar, rod, strap, hard stop, pin, or other conventional method or any combination of the same.

Figure 10:
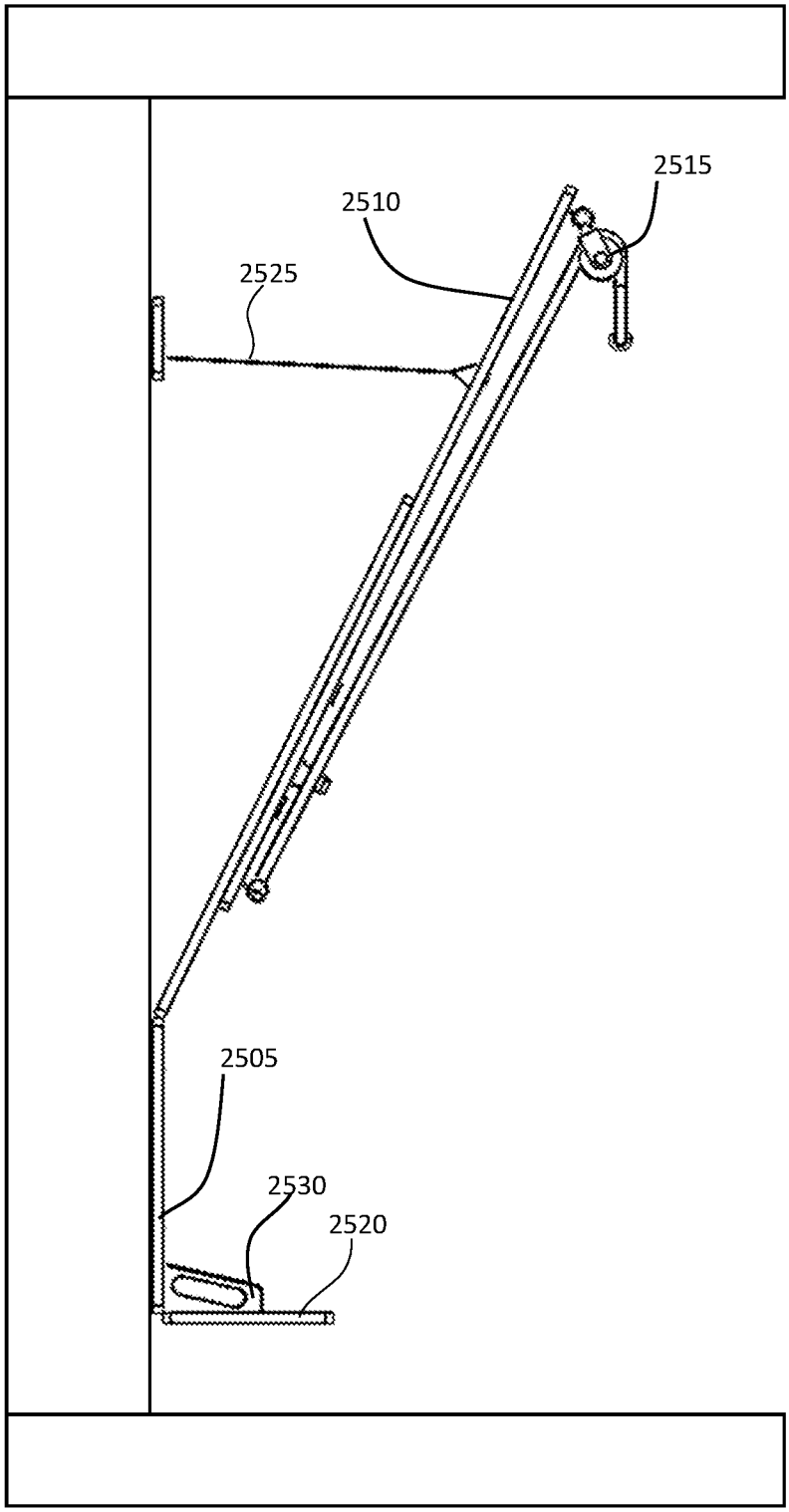
FIG. 10 is a side view of the embodiment of FIG. 9, in a deployed position.

Similarly, the apparatus shown in FIG. 10 may include a pivoting lower plate 2520 which may rotate relative to the wall plate about an axis substantially parallel to the vertical surface such that the pivoting lower plate 2520 may have a vertically aligned stored position and a horizontally aligned deployed position. As with the pivoting upper plate 2510, in the stored position, the pivoting lower plate 2520 may rest along the vertical surface to minimize the amount of useful space occupied by the apparatus. In the deployed position, the pivoting lower plate may lean away from vertical surface, allowing for its use in the exercises described herein. The pivoting upper plate 2520 may be retained in the deployed position through methods including but not limited to a strap 2525 shown attached to upper fixed plate 2810 in FIG. 11, hard stop, pin, or other conventional methods, or any combination of the same. The pivoting lower plate 2520 may be retained by bracket 2530 which may be fixed to either of wall plate 2505 or pivoting lower plate 2520 and magnetically or otherwise affix to the other of wall plate 2505 or pivoting lower plate 2520. In the non-limiting embodiment shown in FIG. 9 and FIG. 10, bracket 2530 is fixed to pivoting lower plate 2520 features a magnetic or ferrous element 2535 and corresponding magnetic or ferrous element 2540.

Figure 11:
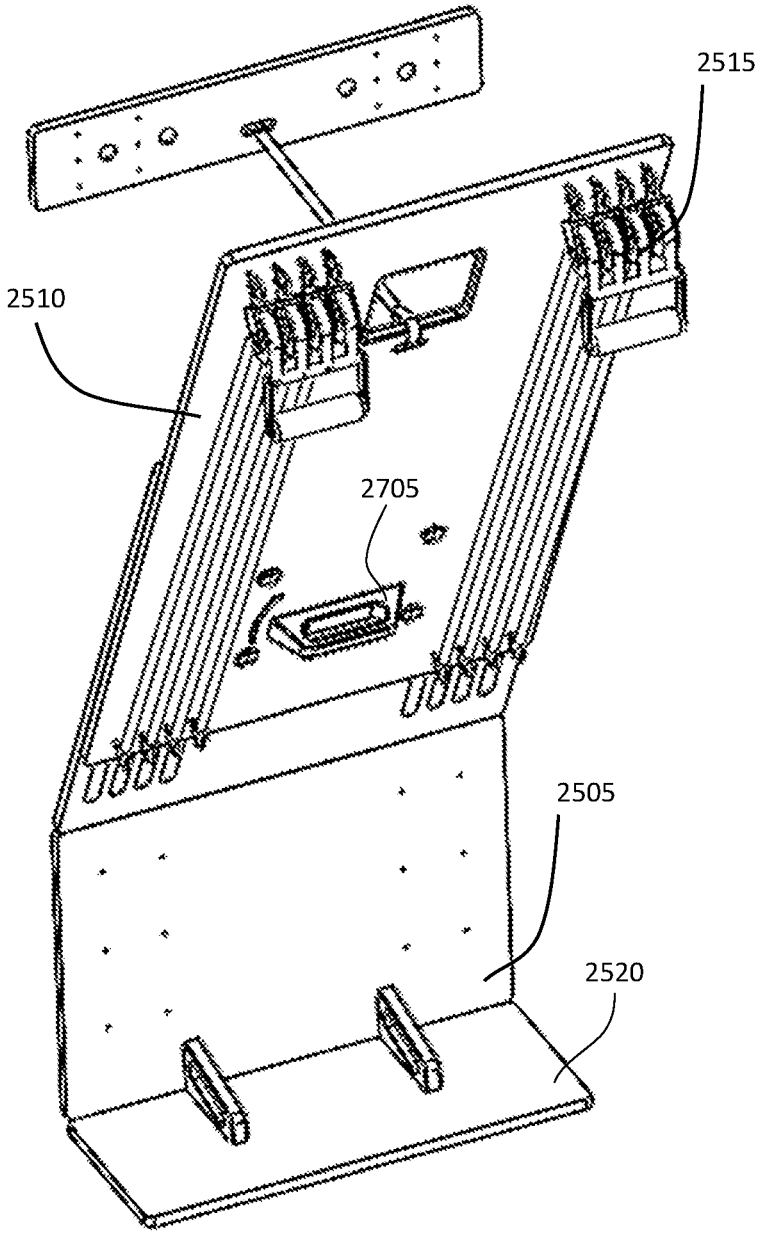
FIG. 11 is a close-up front isometric view of the embodiment of FIG. 10, with the wall not shown.
Figure 12:
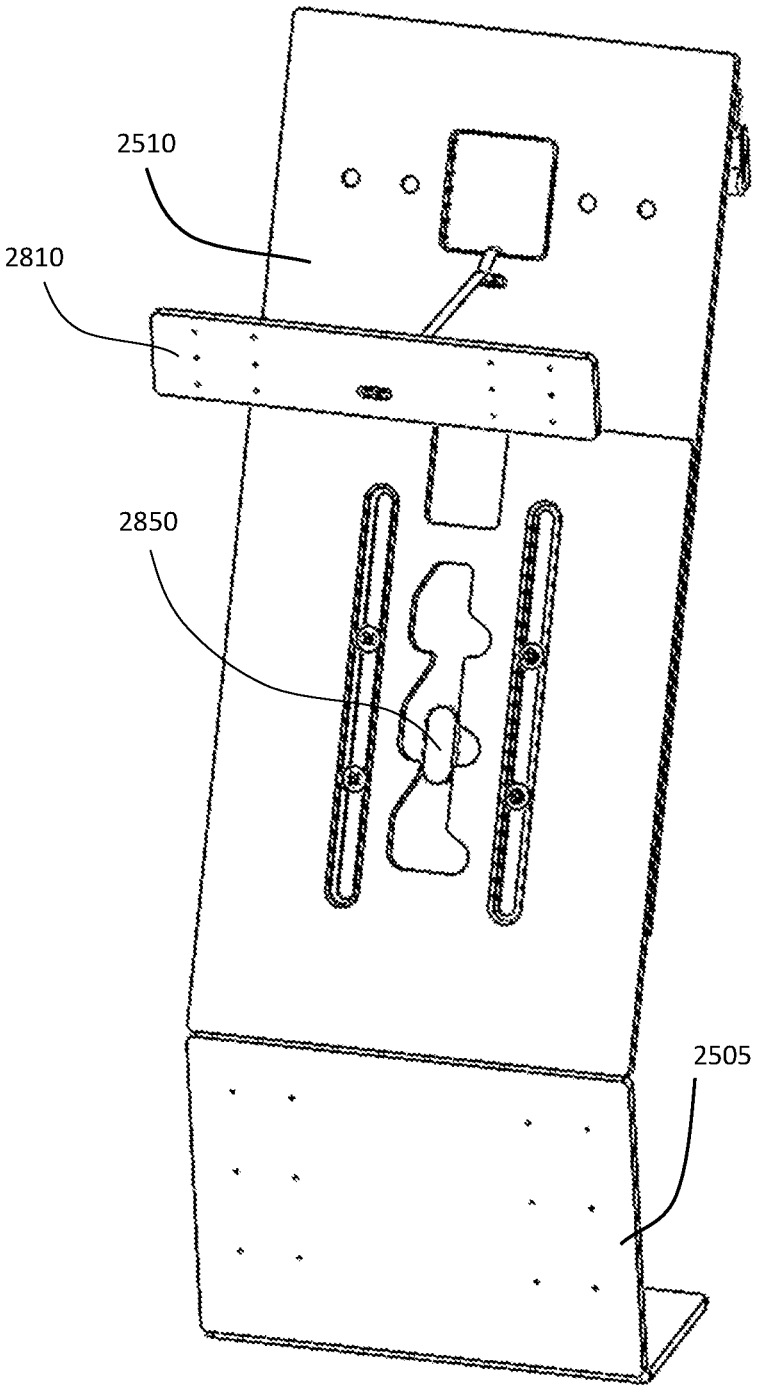
FIG. 12 is a close-up rear isometric view of the embodiment of FIG. 11, seen as if from behind the wall and with the wall not shown.

The apparatus may further feature a locking adjustment mechanism 2850, which rotates between a first position shown in FIG. 11 which allows for adjustment of the height of the pulleys 2515, and a second position which results in locking the position of the upper pivoting plate 2510 against movement in the downwards position, in order to accommodate use by users of different heights. As shown in FIG. 11 and FIG. 12, the locking mechanism 2850 may be accessed by the user from the front of the apparatus and may be controlled by a handle 2705. The inventors also contemplate other locking adjustment methods including, but not limited to use of pegs, latches, and fasteners.

Figure 13:
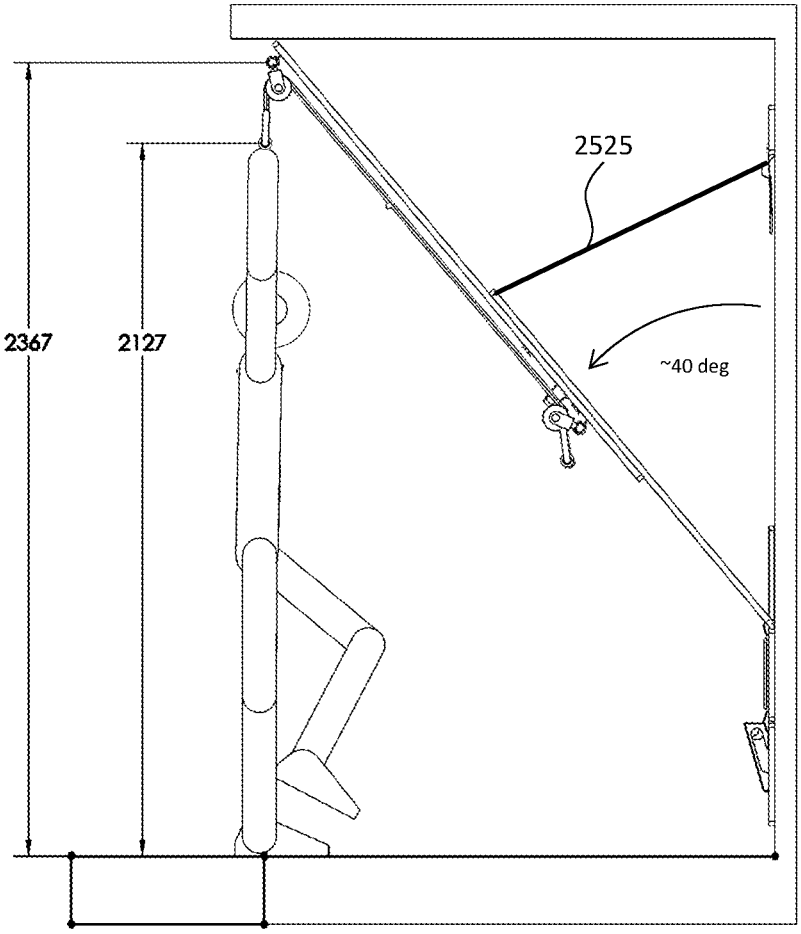
FIG. 13 is a side view of the embodiment of FIG. 9 in an extended deployed position.
Figure 30:
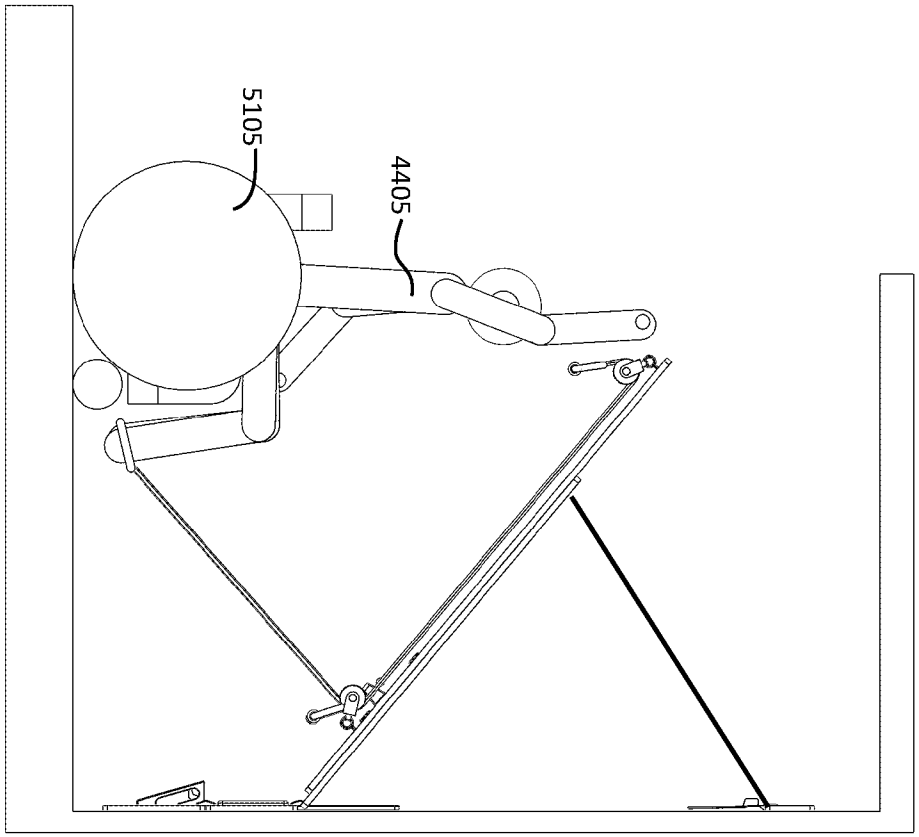
FIG. 30 is a side view of the embodiment of FIG. 13, with a lowered extended deployed position suitable for use by a person in a wheelchair.

Shown in FIG. 30 is the same device as in FIG. 13 with an angle from vertical that may be greater than the specified range for a standing person, so the upper pulleys can be accessed by a user 4405 in a chair or wheelchair 5105.

In an embodiment of the device shown in FIG. 9 through FIG. 14, a set of overhead-mounted pulleys is fixed to the upper end of the linear-sliding extendable member which is part of a pivoting/sliding subassembly 2510. The pivoting/sliding subassembly can be held at the desired angle by a rigid member or a flexible but non-elastic member such as a strap. It is preferable that this strap have a method of length adjustment such D-rings etc, so it may be raised or lowered within a range of adjustment angles for a wider range of users such as children or people who need or want to work out in a seated position. The strap is preferably fixed, at one end, to the pivoting member, and at the other end to a wall or other vertical structure such as via a plate or hook that is secured to the wall. A set of forward-mounted pulleys is fixed to the lower end of the extendable member. The forward-mounted pulleys may instead be mounted to a different structure. However, by mounting the forward-mounted pulleys to the same structural member as the overhead-mounted pulleys, the relative distance between the overhead and forward pulleys remains constant, and so the height and horizontal position of the overhead-mounted pulleys can be adjusted at the same time without increasing the at-rest length of the elastic cords. In this embodiment, the overhead cords can be lengthened by the user during exercise by pulling generally downward on one or more of the cord ends to stretch the cords through the overhead pulleys. The user can also pull on the lower ends of one or more of the cords with the lower handles, through the forward-mounted pulleys, in a more horizontal direction. These handle motions can be performed separately in a range of exercise methods, disclosed here, that achieve resistance training of major muscle groups including upper and lower body muscle groups at the same time with the benefits described earlier. Furthermore, methods of exercising are disclosed here whereby the user extends and/or retracts the elastic cords from the overhead-mounted pulleys and the forward-mounted pulleys at the same time. This enables a range of exercises that target unique and beneficial muscle group combinations. The positions of the overhead-mounted and forward-mounted pulleys, relative to the user, is critical to enabling these unique movements in a way that provides the opportunity for resistance training of combinations of muscle groups that are not enabled by more conventional workout equipment. The positions of the overhead-mounted and forward-mounted pulleys, relative to the user, is also critical to allow easy access to a wide range of heights of users to allow fast and convenient attachment or detachment of elastic cords of different strengths, and also to provide a convenient location of the ends of the cords when the associated cord-pulley assemblies are fixed to the structure, for the user to attached a handle to one or more of the cords. This convenient cord tension combination switching is critical to easily fine-tune the resistance felt by the user so the user can achieve a state of appropriate relative resistance and muscle recruitment from the upper body muscle groups as a result of pulling or pushing on the handles, relative to the core muscles and/or lower body muscle groups which are working against gravity.

As shown in the non-limiting exemplary embodiment in FIG. 13, if the pulley support member assembly is within the range for proper operation and at an exemplary angle of the pivoting/sliding subassembly of 40 degrees, and the linear-sliding extendable member (also referred to as the pulley support member) is at the uppermost linear adjustment position, the upper handle height is well suited for a taller person up to a $95^{th}$ percentile male, and the assembly provides adequate horizontal clearance to complete all of the methods of exercise without obstruction to the knees or feet of this user.

As shown here, at that same angle from vertical of approximately 40 deg, and with the same pulley support member, as in FIG. 13 above, and with the pulley support member in the lowest linear position, the overhead handles are within 5 mm, 10 mm, 15 mm, 20 mm of the ideal height for a $5^{th}$ percentile female, with adequate horizontal clearance to complete all of the methods of exercise without obstruction.

To summarize, the pivoting/sliding subassembly mechanism of the present device provides a compact form-factor when not in use and can be retracted and pivoted to stow against a wall in a building with a standard approximately 8 ft tall ceiling. When folded down it allows adjustability for convenient use and switching of the elastic cords for a standing human from the height of a $5^{th}$ percentile female adult up to someone of the height of a $95^{th}$ percentile male. It provides for all of this adjustability while at the same time providing that the cords are long enough, in their at-rest state, to provide a stretch ratio of approximately 2× to 3× for many exercises and a lower pulley attachment height that is within reach of the user without requiring them to bend at the waist. This is true for a person of the height of a $5^{th}$ percentile female, when the pivoting/sliding subassembly mechanism is deployed at approximately 40 degrees and the pulley support member is fully retracted along the liner slides, and all the way up to someone of the height of a $95^{th}$ percentile male when the pivoting/sliding subassembly mechanism is deployed at the same angle of approximately 40 degrees and the pulley support member is fully extended. This construction also allows for a plate below the pivoting member, to which the pivoting member is pivotally mounted, that is fixed to a wall or other structure. With this construction, the lower fixed plate is also high enough above the floor to allow a foot constraining member to be pivotally fixed to the bottom of the lower fixed member so it can accommodate a vertical foot of up to a $95^{th}$ percentile male when deployed horizontally, and to fold down to lay flat against the wall when stowed.

Furthermore, methods of using the present device, as disclosed here, can provide a high level of muscle recruitment and training while reducing the strain on joints to provide injury prevention and increased mobility training. Specifically, the downward tensioning of the cords from the overhead-mounted pulleys will reduce the effect of gravity on the lower body joints as compared to if the user was just doing that lower body exercise with no assistance. At the same time, the upper body joints are not experiencing the stress of lifting the entire lower body weight as they would be when doing exercises such as, but not limited to a conventional chin-up, for example, because the lower body is assisting the upper body muscles and joints against the effect of gravity.

As shown in FIG. 30, one or more methods of using this embodiment of the device allow a disabled person, such as someone with limited strength and mobility such as an injured person or a stroke patient or someone in a wheelchair, to exercise muscle groups in their upper body while seated and moving members of their paralyzed or movement-inhibited lower body, as a result of their upper body movement. This will promote blood flow in the lower body limbs and may also have the potential to increase the mind-muscle connection in a way that could aid in stroke recovery of disabled limbs, for example. With an angle from vertical that may be greater than the specified range disclosed here for a standing person, the upper pulleys can be accessed by a person in a chair or wheelchair.

Figure 14:
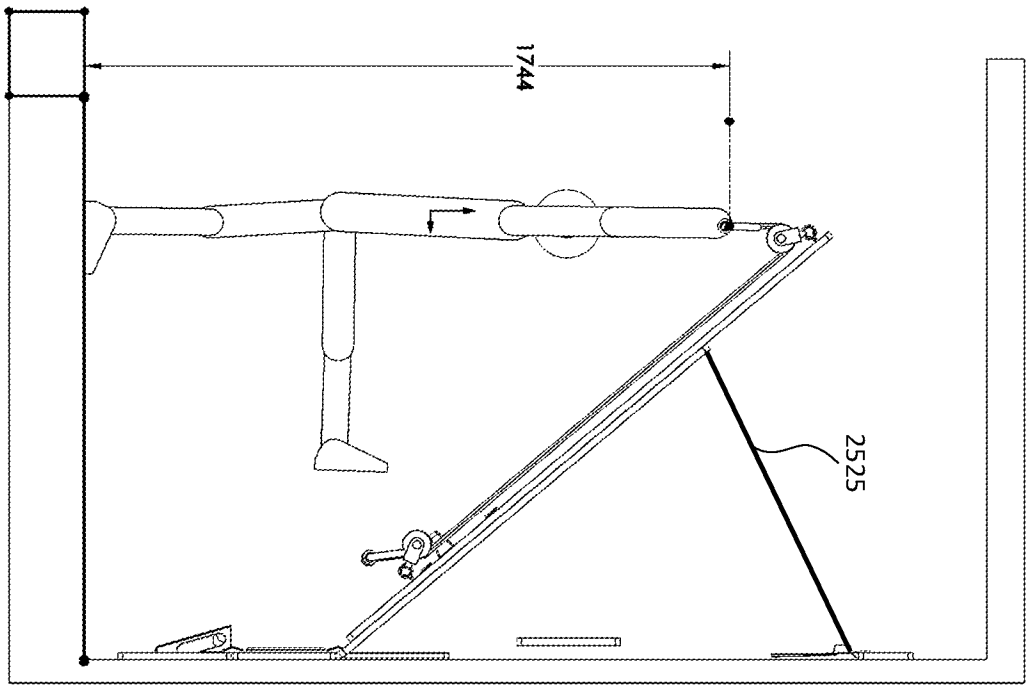
FIG. 14 is a side view of the embodiment of FIG. 13 in a less extended deployed position.

In summary this embodiment of the device provides the desired range of adjustability to achieve the requirements discussed in this disclosure for a range of human heights from a $5^{th}$ percentile female up to a $95^{th}$ percentile male is shown in FIG. 13 through FIG. 14. This device also allows convenient storage of the device against a wall, and a secondary adjustment via lengthening of the wall support strap to allow a vertical reach of down to 1100 mm above the floor for as small as a $5^{th}$ percentile female in a seated position such as from a chair or wheelchair. This configuration is shown in FIG. 30 and can be achieved with no other modifications to the able-bodied configuration described immediately above, other than a permanently longer, or adjustably longer, retaining strap 2525.

Figure 32:
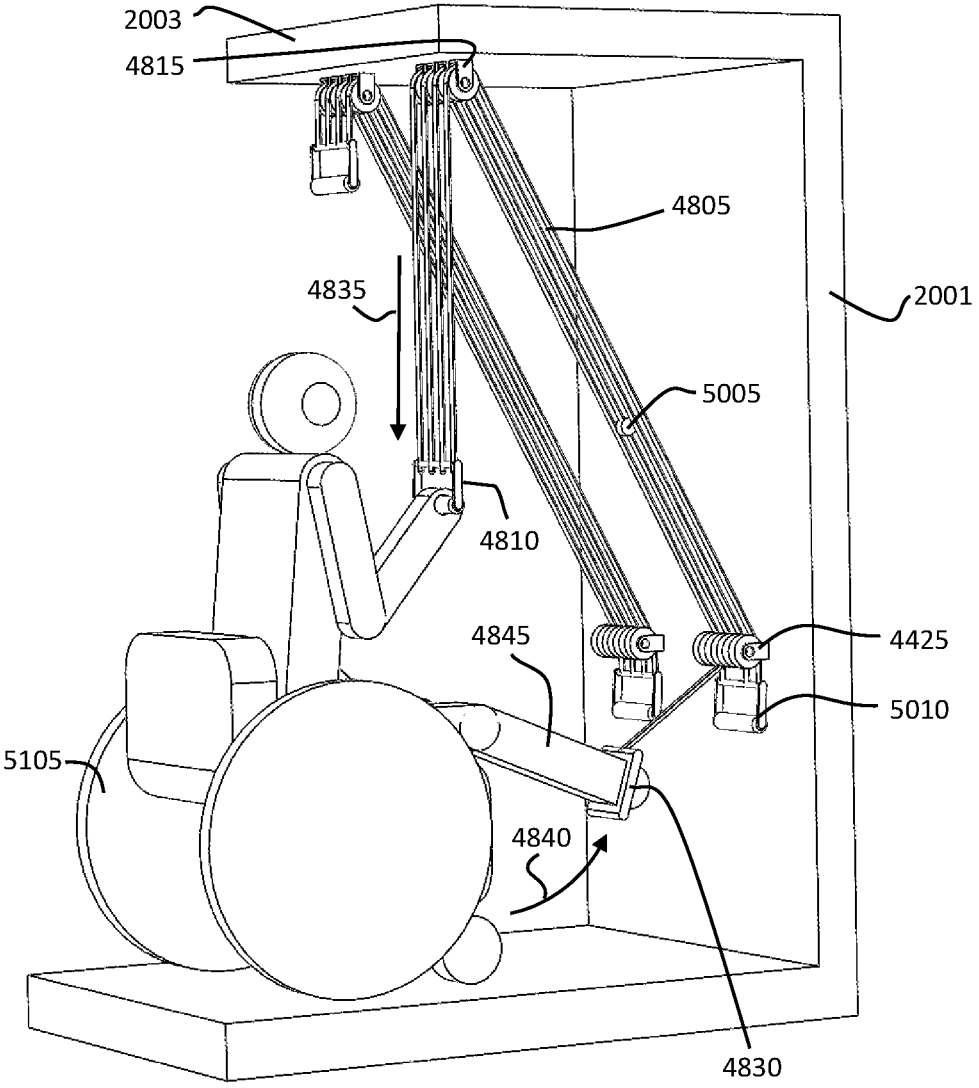
FIG. 32 is another isometric view of the embodiment of FIG. 31, showing the person in a second position of the chin-up leg extension exercise.

In an embodiment of the device, shown for example in FIG. 32, a first set of pulleys 4815 are pivotally-fixed to a ceiling or structure 2003 generally above the user's CG and a second set of pulleys 4425 are pivotally-fixed to a wall or structure 2001 and located in front of the user. The forward-mounted pulleys may be at any height but the investors have found that it works well for reasons described below, if they are near the height of the CG of a sitting or standing user. The second set of pulleys 4425 are rotationally connected to the lower end of the elastic cords 4805. The term "Pivotally-fixed" means that the pulleys are fixed to a structure, wall, or ceiling, but are free to pivot about their axis. Alternatively, as shown for example in FIG. 33 and FIG. 34, the housing of the pulleys 6505 may be non-rigidly attached to mounting point on a structure, ceiling, or wall, leaving them free to align themselves with the cords 6510. This non-rigid alignment arrangement allows for greater flexibility. Rigidly mounted pulleys have less tolerance for exercise movements which bring the user-interfacing elements out of alignment of the axis of the plane which circumferentially bisects the pulley. For example, rigidly fixed pulley housings may be more susceptible to cords derailing as they unseat from the pulley's groove due to high misalignment or rubbing against the housing of the pulley, causing friction. It is understood that cord refers to any of an elastic or non-elastic and twisted or non-twisted cord, such as but not limited to an elastic band, a non-elastic cable, or latex cord such as a tubular cord.

The second set of forward-mounted pulleys 4425 and lower user-interfacing elements 4830 enable a range of exercises that recruit upper and lower body muscle groups and/or upper body and core muscle groups simultaneously. In this embodiment, the elastic cords 4805 can be lengthened by the user pulling generally downward on a first end of the said cord via the upper user-interfacing element 4810. As shown in FIG. 32, the user 4405 is pulling downward on one of the upper handles 4810 and is thereby lengthening the corresponding cords which pass through the first set of pulley 4815. In this embodiment, the user can also pull on the lower ends of the cords via lower user-interfacing elements such as lower handles 5010 or leg attachment 4830, which are attached to cords 4805 which pass through the forward-mounted pulleys 4425. These forward-mounted user-interfacing elements are well-suited to a variety of movements in a more horizontal or even upwards diagonal direction. These handle motions can be performed separately or in series in a range of exercises, disclosed here, that allow resistance training of a high percentage of major muscle groups. Furthermore, methods of exercising are disclosed here whereby the user extends and/or retracts the cords from the overhead and forward-mounted pulleys at the same time. This enables a range of exercises that target unique and beneficial muscle group combinations. The positions of the overhead-mounted and forward-mounted pulleys, relative to the user, is critical to enabling these unique movements in a way that provides resistance training to combinations of muscle groups that are not enabled by more conventional workout equipment. The positions of the overhead-mounted and forward-mounted pulleys, relative to the user, is critical to allow easy access to the elastic cord ends to allow use by a wide range of heights of user to allow fast and convenient attachment or detachment of elastic cords of different strengths to the structure, and also to provide a convenient location of the ends of the cords to attached one or more of the cords to a handle by the user. This convenient cord tension combination switching is critical to fine-tune the resistance felt by the user so the user can achieve a state of appropriate relative resistance and muscle recruitment from the upper body muscle groups relative to the core muscles and/or lower body muscle groups. Furthermore, these methods of using the present device can provide a high level of muscle recruitment and training while reducing the strain on joints for injury prevention and increased mobility training. Furthermore, one or more methods of using embodiments of the present device with overhead and forward-mounted pulleys allow a disabled person, such as someone in a wheelchair, to exercise muscle groups in their upper body while simultaneously moving members of their paralyzed or movement-inhibited lower body, as a result of their upper body movement. This will promote blood flow in the lower body limbs and is also believed to have the potential to increase the mind-muscle connection in a way that could aid in stroke recovery of disabled limbs, for example.

The inventors have found that to enable a range of exercises, with the device, that provide muscle resistance training to a high percentage of major muscle groups, there is a clearly defined range of relative pulley positions which must be adhered to, for the convenient attachment and removal of the handles or other user interfacing elements from the ends of the elastic cords passing through the overhead and forward-mounted pulleys for each user.

One of the important requirements for embodiments of the device is the ability of the user to easily switch elastic cords so the cords of the desired tension can be conveniently combined to allow adjustability of the total cord tension for various exercises and to account for a user's weight and strength. This requirement necessitates that the overhead-mounted and the forward-mounted pulley attachment points are within easy reach of the user to allow them to add or remove and combine cords of different spring rates, without requiring the user to stand on a chair or other inconvenient raised platform above the ground. Or if a platform is required, that it is low enough to not require a step-up higher than would require lifting their upper leg past a horizontal position. Furthermore, because one of the intents of this exercise device is to make exercising as easy and convenient as possible, it is preferable to locate the forward-mounted pulleys far enough above the floor to allow the user to reach the forward-mounted pulley attachment members without bending over uncomfortably. This is important for elderly people or anyone who has experienced lower back pain because it will often be necessary to switch out the forward-mounted pulleys of one or more cords early in a workout session before the user's lower back is fully warmed up and may be vulnerable to injury from this motion.

Figure 4:
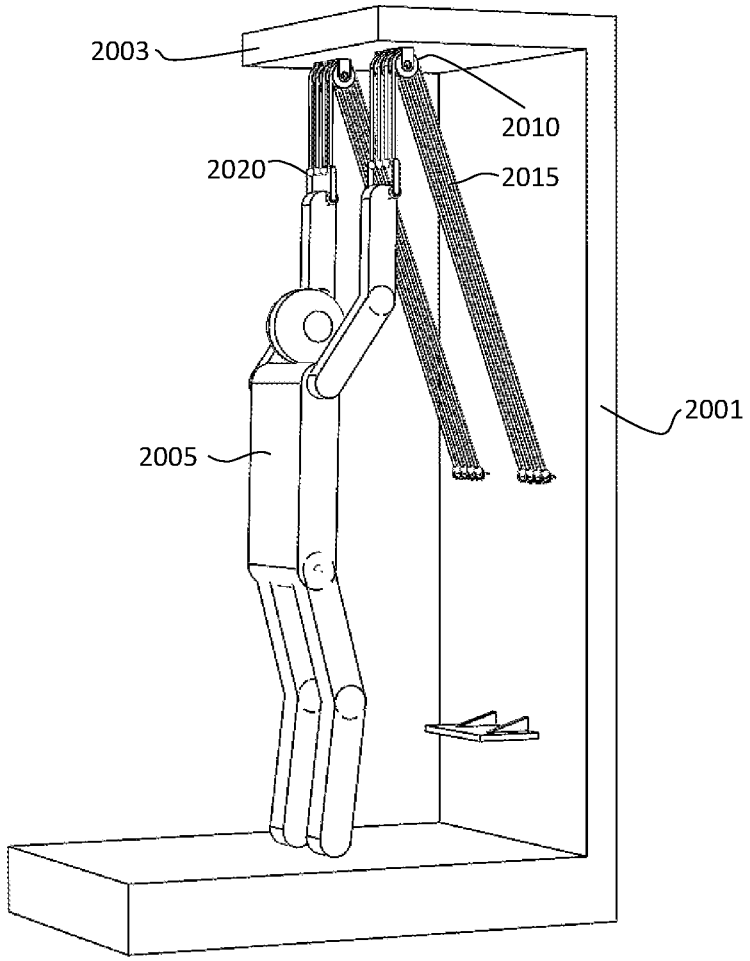
FIG. 4 is an isometric view of another exemplary embodiment of an exercise apparatus in use by a person to carry out an exercise.

In an example exercise (chin up/squat) as shown in FIG. 4, the user begins in a standing position and holds onto the user-interfacing handles 2020 preferably above the height of their head or at least above the height of their shoulders, and generally vertically aligned within approximately 12" (measured on a horizontal plane) of the position of their feet on the ground. Some users prefer to have the handles slightly forward of their feet, to put less stress on their shoulder joints.

Figure 5:
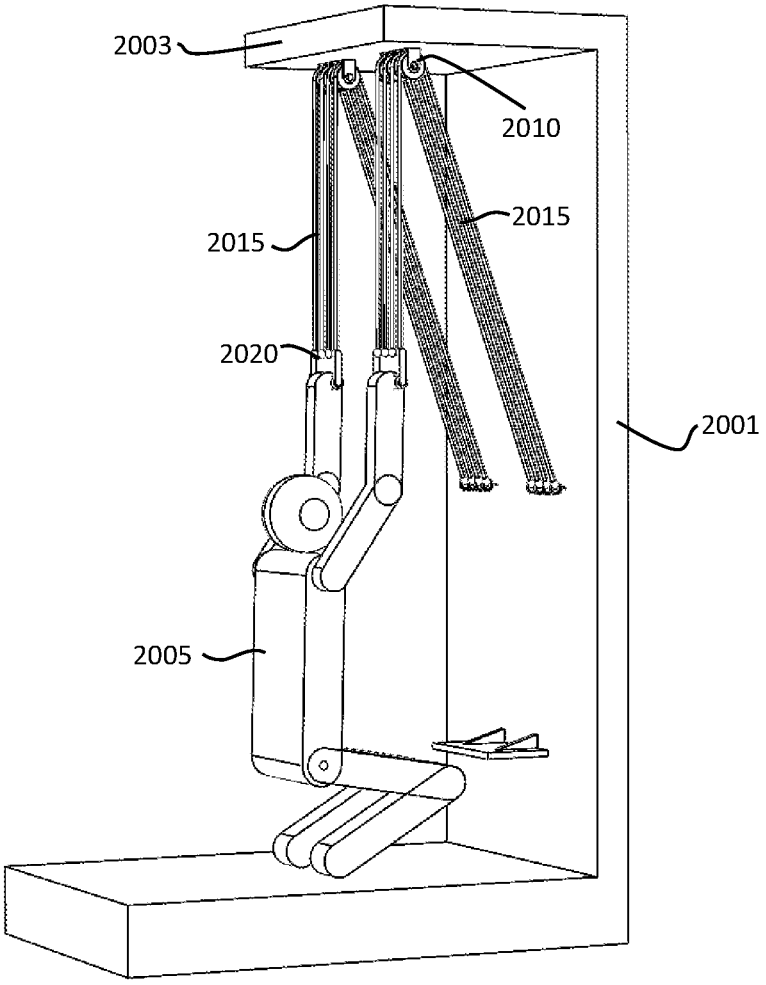
FIG. 5 is a further isometric view of the embodiment of FIG. 4 with the person shown in a different position of the exercise shown in FIG. 4.

As shown in FIG. 5, the user 2005 then does a squat with their arms extended upward, with their hands holding or attached to the user-interfacing handles 2020. The handles 2020 are attached at a first end of elastic cords 2015 which pass through pulleys 2010 and are attached a second end to the forward structure 2001. As shown in other embodiments, the other end of the elastic cords may also pass through pulleys that are rotationally fixed to the forward structure. The result of using straight arms is to minimize the load on the elastics so the user 2005 experiences a high percentage of the full weight of the user being supported by the leg muscles, creating maximum muscle tension during the eccentric contraction of the quads. The human mind and body will generally be able to exert higher forces during an eccentric contraction (IE: while joints are becoming more progressively bent, and while muscles are lengthening). So higher load during the concentric phase is achieved by using a minimum stretch on the elastic cords through the initial movement via straight/vertical arms.

Figure 6:
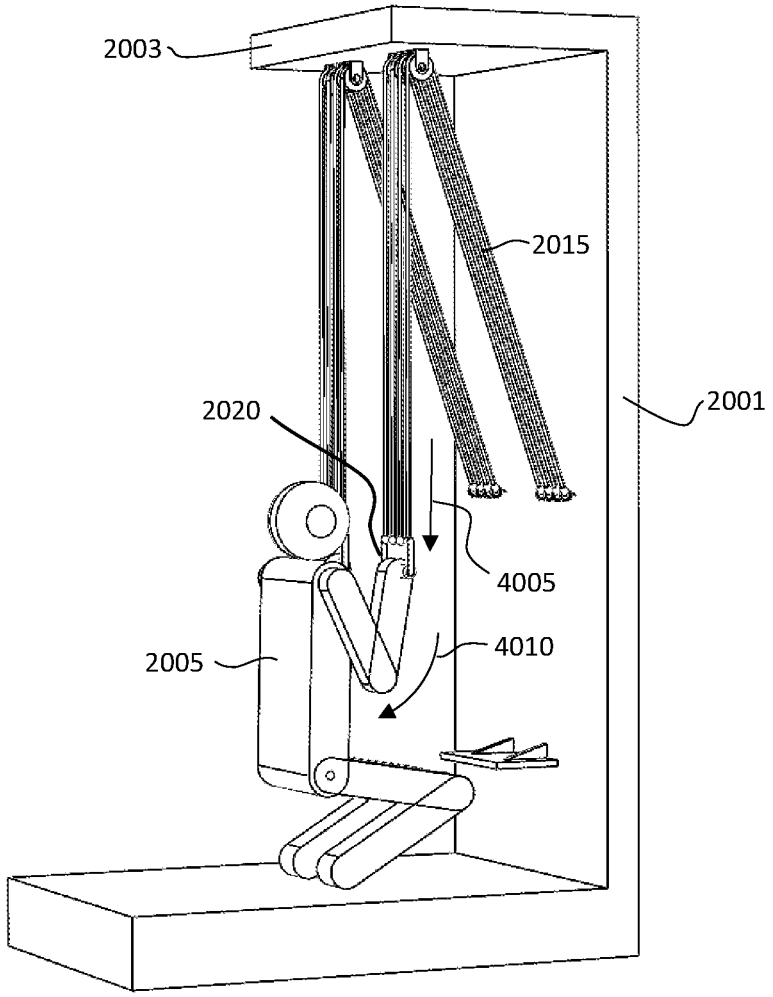
FIG. 6 is a further isometric view of the embodiment of FIG. 4 with the person shown in a different position of the exercise shown in FIG. 4 and FIG. 5.

As shown in FIG. 6, while remaining in the full squat position, the user 2005 pulls the handles 2020 downward as if they are doing a chin-up. This provides tension to the biceps and back muscles through lengthening and increasing tension on the elastic cords 2015. Arrow 4005 shows the direction of the motion of the handles as the user pulls down on the handles and arrow 4010 indicates the motion of the user's elbow as they complete the chin-up motion.

Figure 7:
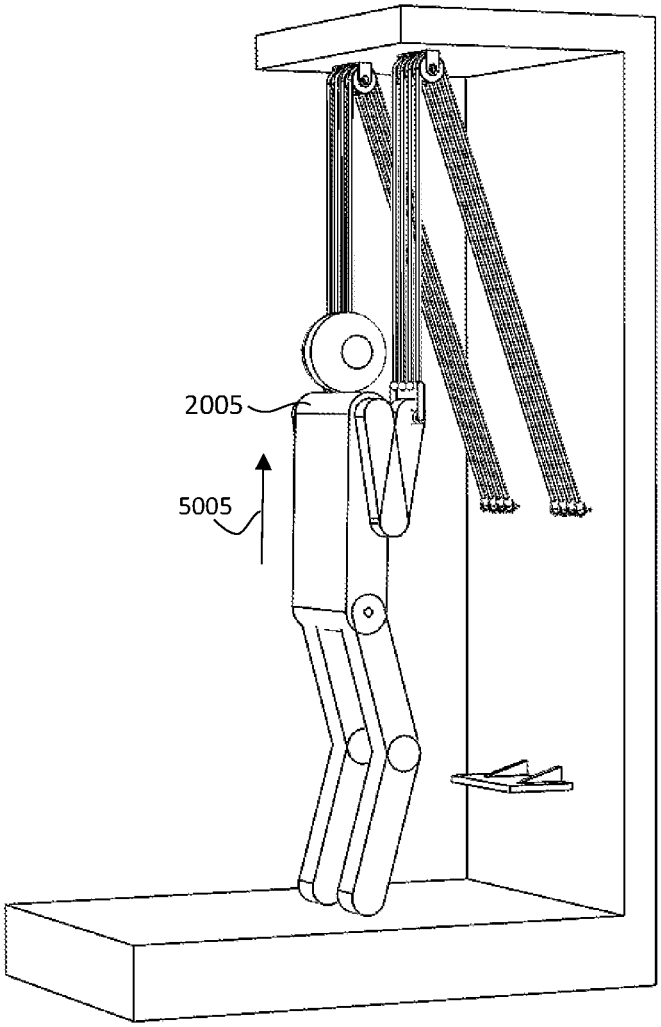
FIG. 7 is a further isometric view of the embodiment of FIG. 4 with the person shown in a different position of the exercise shown in FIGS. 4-6.

Next, as shown in FIG. 7, the user 2005 stands up contracting their quads, with their arms still in the full chin-up position relative to their torso. Arrow 5005 indicates the direction of the motion of the user's center of gravity. Keeping the user's arms in the chin-up position provides assistance to the quads through the increased tension in the elastic cord 2015, while simultaneously keeping the upper body chin-up muscles in tension, such that the upper and lower body muscle groups are both engaged and in tension simultaneously.

Figure 8:
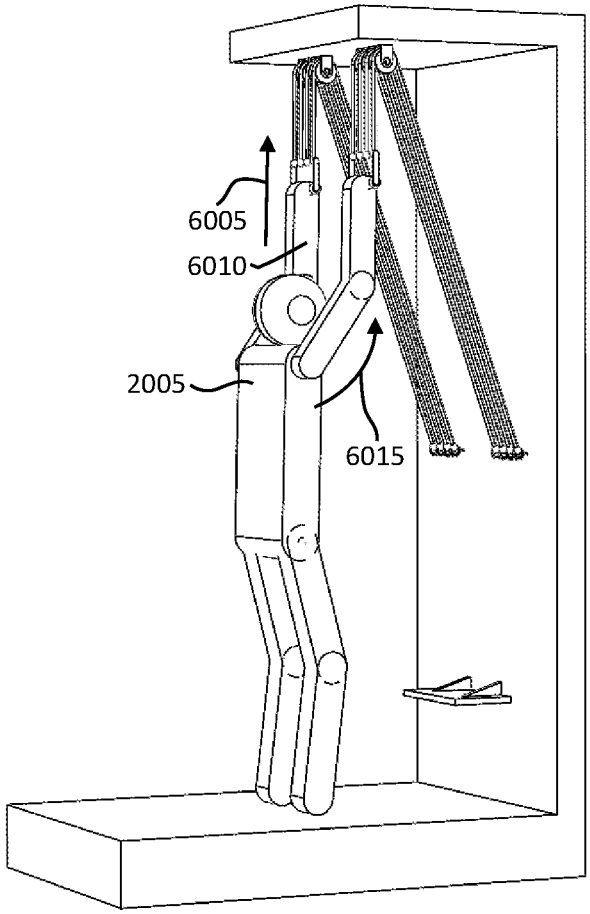
FIG. 8 is a further isometric view of the embodiment of FIG. 4 with the person shown returning to the position of FIG. 4.
Figure 9:
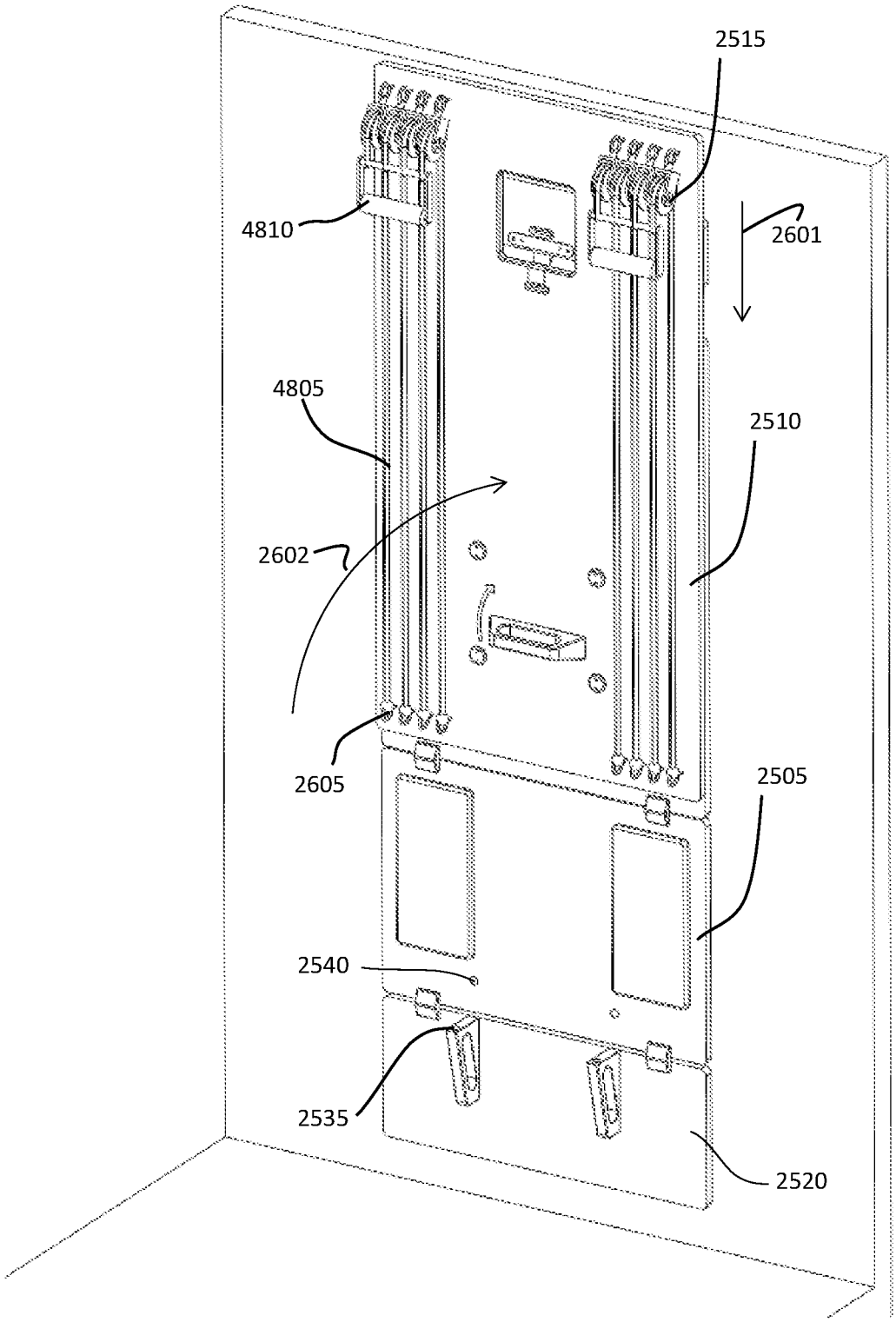
FIG. 9 is an isometric view of a stowable embodiment of an exercise apparatus, in a stowed position against a wall.

Next, as shown in FIG. 8, the user extends their arms 6010 upward in the direction shown by arrow 6005 as their elbows pivot in the direction shown by arrow 6015 and they begin the motion sequence again.

Variations to this exercise include, but are not limited to: 1) Doing the chin-up (or pull up or other pulling down motion) first, before doing the squat. This provides more assistance for the eccentric contraction phase of the squat which is more suited for a user with lower leg strength, or with a lower body joint injury, or if their leg muscles are more fatigued than their upper body muscles part way through a set. 2) Doing the squat with arms extended upward, and then doing the chin up motion when in the full squat position, and then extending the arms straight up while in the full squat position, and then doing the upward motion of the squat with arms extended upward. This provides more load on the leg muscles on both the up and down motions of the squat while also providing maximum upper body muscle tension on the eccentric contraction of the chin up. 3) One or more of the above variations can be used throughout a set to make it more or less challenging for the upper or lower body at any point during the set.

Figure 24:
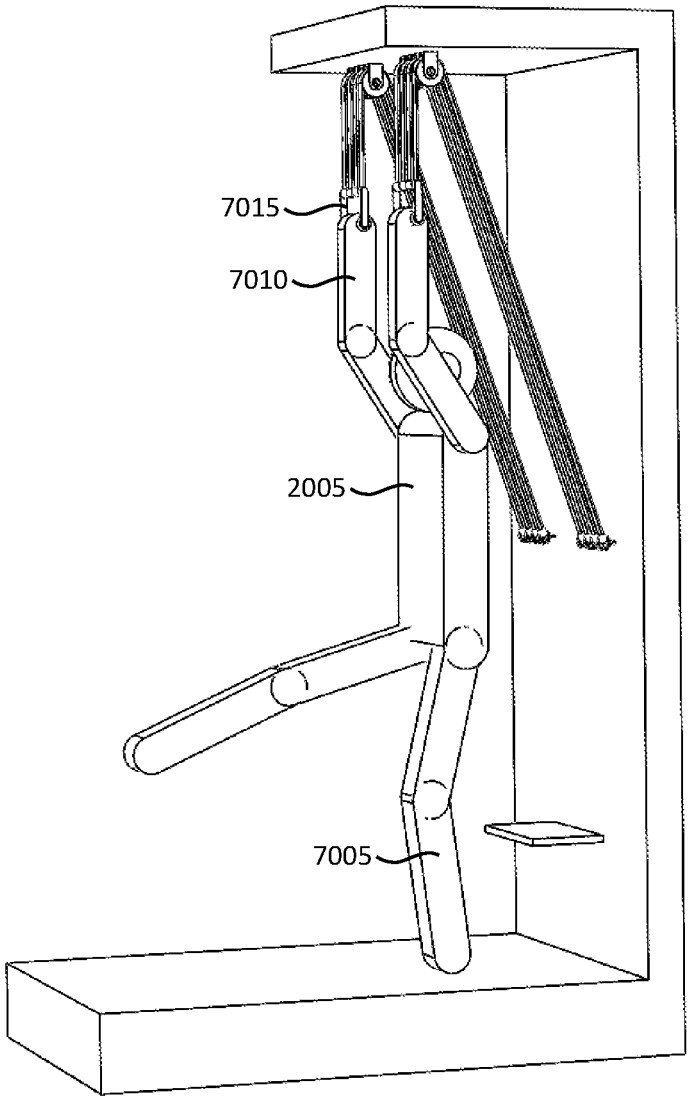
FIG. 24 is an isometric view of an embodiment of an exercise apparatus showing a user in a first position of a pull up pistol squat exercise.

In an exemplary exercise (pull-up pistol squat) as shown in FIG. 24, the user 2005 stands on one leg 7005 with their arms 7010 raised above their head while holding the handles 7015 preferable above their head and at least above the height of their shoulders, and generally vertically aligned within approximately 12" (measured on a horizontal plane) of the position of their feet on the ground. This exercise is similar to the chin-up squats but is performed with one leg at a time to increase the load on the quads. (Note that a pull-up is generally understood to use a hand position with the palms facing away from the user to recruit a different set of muscles than a chin up). It is understood that many of the upper body exercises disclose here can be combined with many of the lower body exercises disclosed here. The combinations of exercises described here are non-limiting exemplary combinations, the basic principles of which can be combined according to the preferences and requirements of the user.

Figure 25:
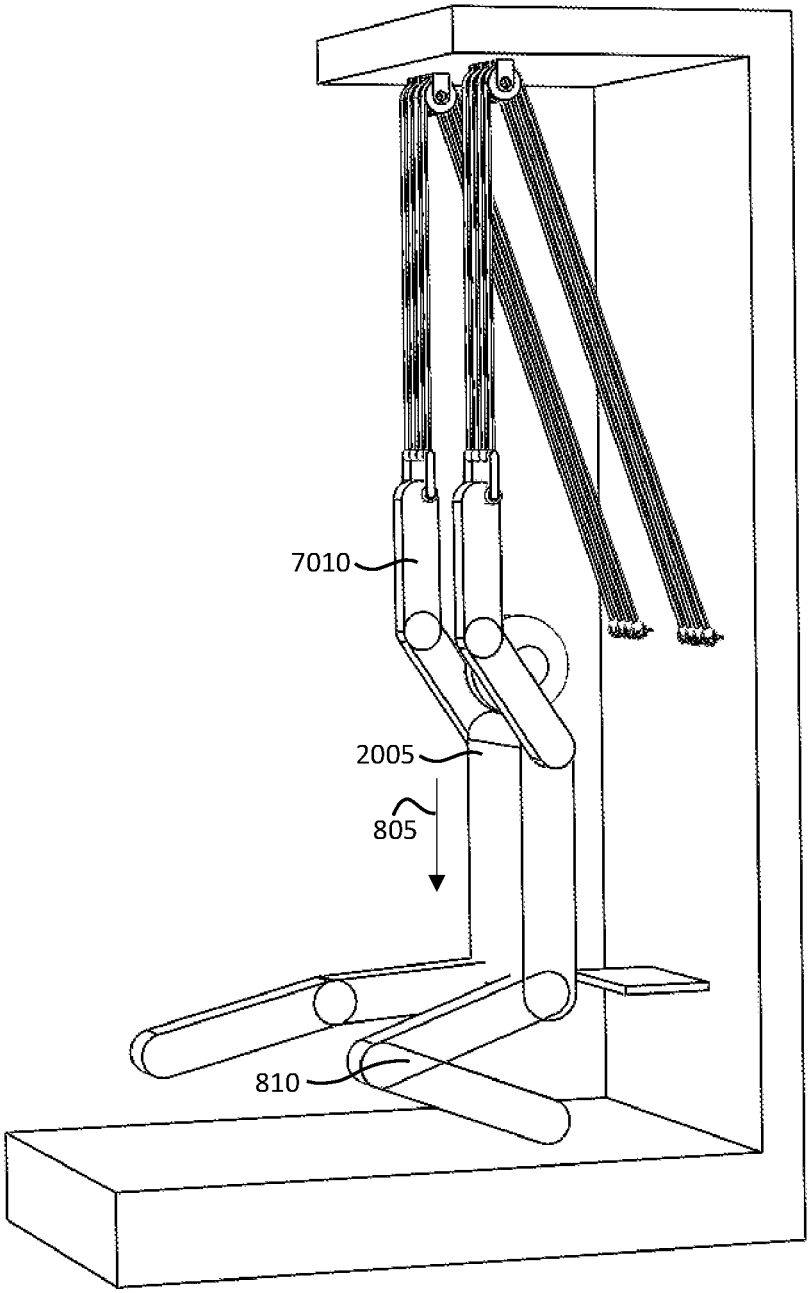
FIG. 25 is another isometric view of the embodiment of FIG. 24 showing the user in a second position of the pull up pistol squat exercise.

Next, as shown in FIG. 25, the user 2005 does a squat with one leg, lowering their center of gravity in the direction shown by arrow 805 and with their arms 7010 generally straight and vertically above the user 2005 to maximize the load on the user's loaded leg 810 muscles during the eccentric contraction.

Figure 26:
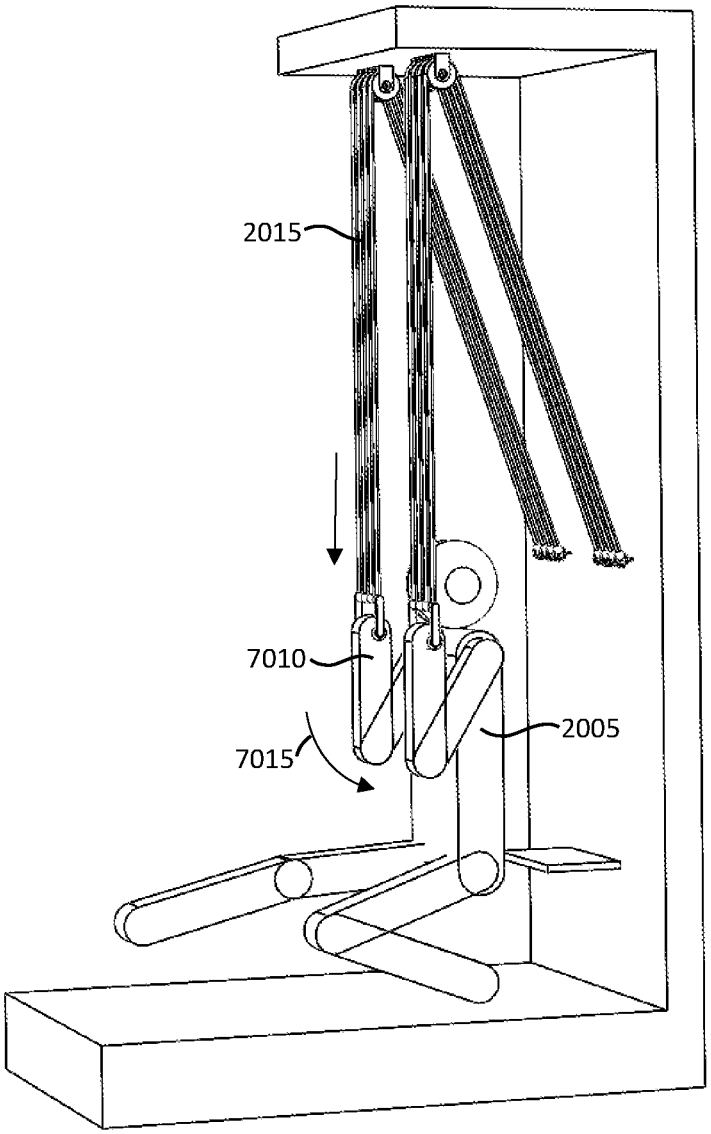
FIG. 26 is another isometric view of the embodiment of FIG. 24 showing the user in a third position of the pull up pistol squat exercise.

Next, as shown in FIG. 26, the user 2005 does a chin-up or pull-up, or other motion to lengthen the elastics 2015 with the upper body muscles. As they perform this chin-up motion, the motion of the user's elbows is shown by arrow 7015.

(It is also noted that "next" as it is used in these descriptions, indicates a sequence of upper or lower body movements, but that the timing of these movements can be overlapped to create concurrent upper and lower body movements.)

Figure 27:
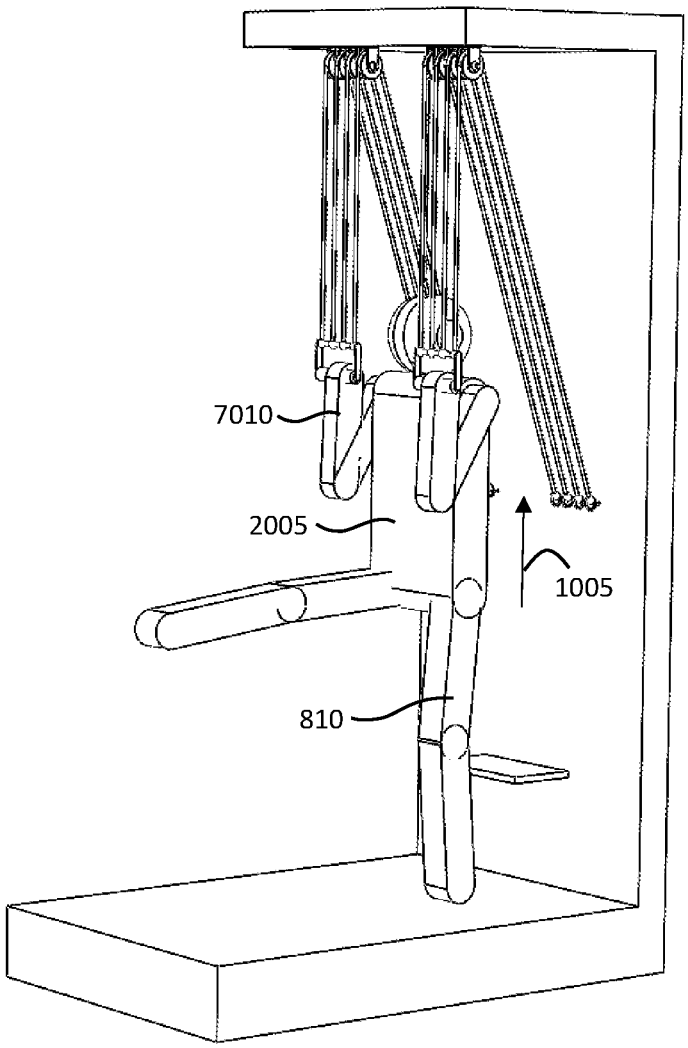
FIG. 27 is another isometric view of the embodiment of FIG. 24 showing the user in a fourth position of the pull up pistol squat exercise.

Next, as shown in FIG. 27, the user 2005 straightens their loaded leg 810 and stands up with their arms 7010 still in the full chin up position. This gives the user 2005 the maximum elastic tension assistance with their concentric squat motion. During this motion, the direction of motion of the center of gravity of user 2005 is shown by arrow 1005.

Figure 28:
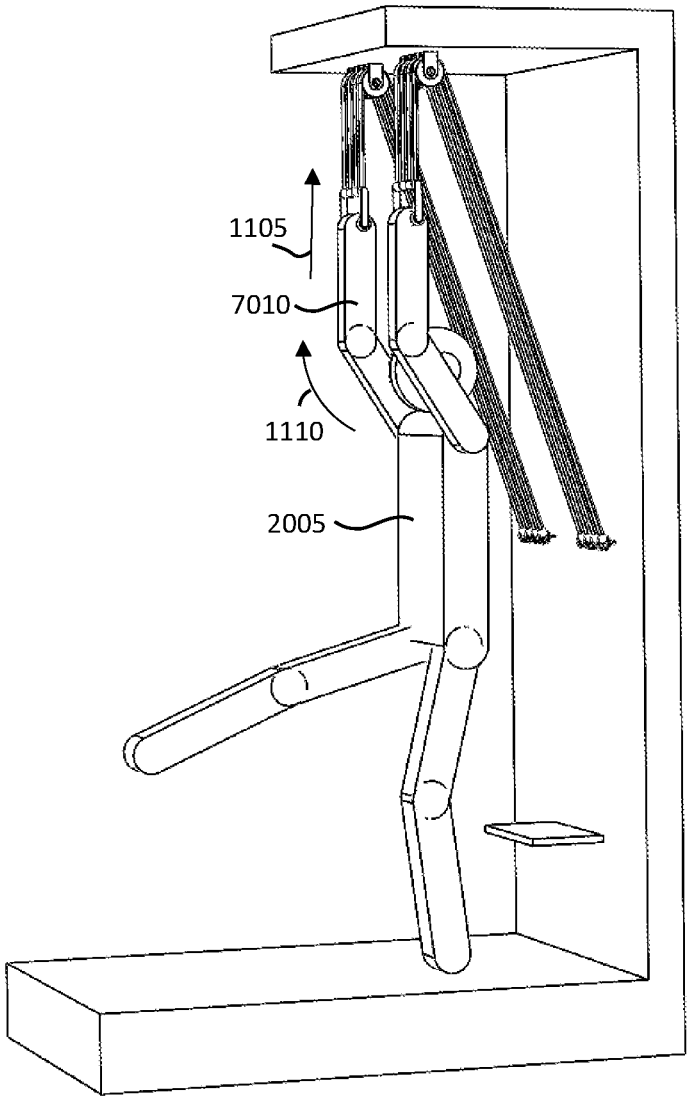
FIG. 28 is another isometric view of the embodiment of FIG. 24 showing the user returning to the first position of the pull up pistol squat exercise.

Next, as shown in FIG. 28, the user 2005 extends their arms 7010 above them in the direction shown by arrow 1105, with their elbows moving in the direction shown by arrow 1110 again and repeats the motion.

Depending on the user's fitness level and goals, the user can choose to continue doing any of these full body movements until the upper or lower body reaches a point of high exhaustion or complete exhaustion (AKA "failure") where they are no longer able to complete the motion. Research has shown that pushing a muscle to failure or near to failure is an effective method of promoting hypertrophy. With this device and with these or similar movements, if the lower body nears failure before the upper body, then the user can use their upper body to assist the lower body by pulling down on the handles for a greater percentage of the lower body movement. This is why having an adequate length of the elastic cords is important. If the initial, at-rest length of the cords is too short, then the spring rate, k, will be too high, and additional lengthening of the bands by concentrically contracting the upper body muscles will increase the force of the cords too much for the user to achieve a full range of motion of the upper body muscles at the same time as a full range of motion of the lower body muscles.

In another scenario, if the user's upper body muscles reach failure before the lower body, the user has the option to exert the lower body muscle group to a higher level to provide assistance to the upper body muscle group. It has been found by experimentation, that the user's brain, with minimal training with this system, will naturally exert the upper or lower body muscle groups to the degree necessary to assist the other. In this way, it is possible for the upper and lower body muscles to both reach failure (or a high level of exhaustion, if preferred by the user) at a similar time during the same set. This provides a high level of fitness training to two muscle groups at the same time to reduce the time needed for a full body workout.

This device and workout method also results in the surprising effect of reducing the perceived effort of the full body workout. To illustrate this effect, consider a conventional full body exercise with a perceived effort, as follows. If the user were to combine a squat and a curl into one exercise, using an elastic cord system that is attached to the ground instead of an overhead fixed member, then the squat motion and the curl motion are both working the lower and upper body in the upward direction against gravity and against the elastic cord tension. The effect of this motion is similar to the device and exercises described here in that the leg and arm muscles are both being exercised at the same time, but the effort perceived by the user is higher because they feel like they are in a higher gravity scenario. The pressure on their feet is increased. The pressure on their spine is increased. The pressure on their hip and knee and ankle joints is increased. All of these proprioceptive inputs to the brain are believed, by the inventors, to signal that the body is operating in an increased gravitational force in the downward direction.

By contrast, with the device and methods described herein, the lower body is pushing up against gravity, while the upper body muscles are pulling down against the tension of the elastic cords. The result is a reduction of the force on the feet, ankles, knees hips and back. It is believed by the inventor that these proprioceptive inputs signal the user's brain that they are in a reduced gravitational force. In this scenario, the perceived effort is noticeably lower than the previous contrasting example, even though it is possible, through techniques described here, and through adjustment of the elastic band tension force, to bring upper and lower body muscles both to a high level of exhaustion or failure at the same time. It is also believed by the inventors that the upper and lower body strength of an average person is better suited to gain fitness training benefit from the present device, as compared to the squat/upward bicep curl example, above, because the squat/upward bicep curl example puts too much load on the lower body, relative to its load capacity, compared to the upper body load capacity. In other words, if both the upper and lower body are pulling upward at the same time, the legs of an average person will generally fatigue before their upper body.

By contrast, again, the device and exemplary exercises described here, provide the opportunity for the lower body to move in the upward direction, while the upper body applies a downward force on the handles. With methods of using the present device, the lower body acts to push the feet in the direction away from the person's center of gravity, the upper body acts to pull the hands in the direction towards the person's center of gravity. It has been found by the inventors that this combination of muscle tension directions has the surprising effect of allowing the upper and lower body to see similar loads relative to their load capacities. The load on the lower body is a function of body weight minus the tension provided by the force of the elastics acting on the upper body.

Lunges are a challenging method of exercising the leg muscles. At the same time, traditional dips are difficult for a person of average fitness and strength to perform. The surprising result of the combined exercise described here as well as other exercises in this document, is that the combination of these two method of exercises, performed with the device described here, allows a person of average strength and fitness to perform both exercises simultaneously, much more easily than if they were to perform these exercises individually. In addition to this benefit, performing these exercises at the same time, allows a person to compete a workout session more quickly than performing these exercises individually.

Figure 20:
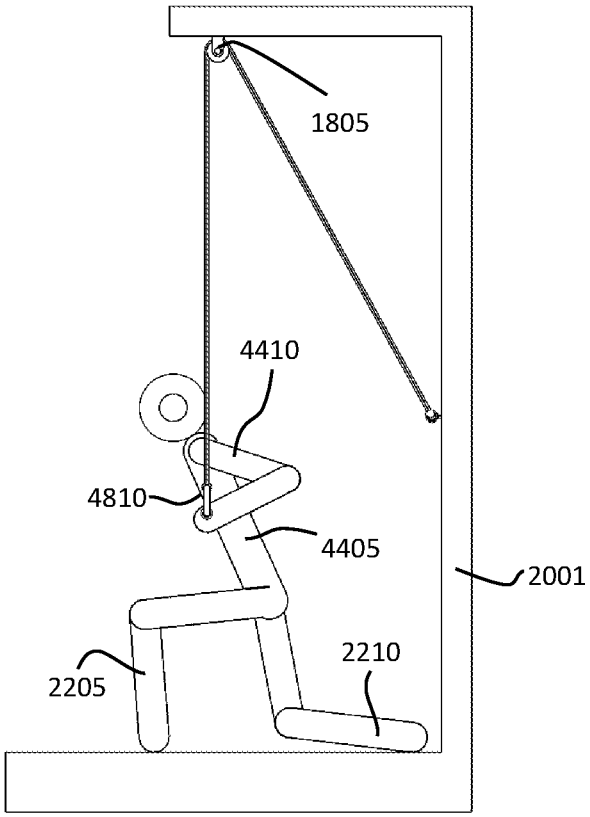
FIG. 20 is a side view of an embodiment of an exercise apparatus showing a user carrying out an exercise and in a first position of the exercise.

As shown in FIG. 20, to begin this exercise the user 4405 brings the overhead-pulley 1805 mounted handles 4810 to their sides with bent arms 4410 as if they are going to perform a dip. They then lower their body into a lunge position with a first foot 2205 in front of them and a second foot 2210 behind them. This exercise is an example of why it is important for the pulleys to be far enough from the wall or structure 2001 so the user 4405 can extend their legs toward the wall without obstruction.

Figure 21:
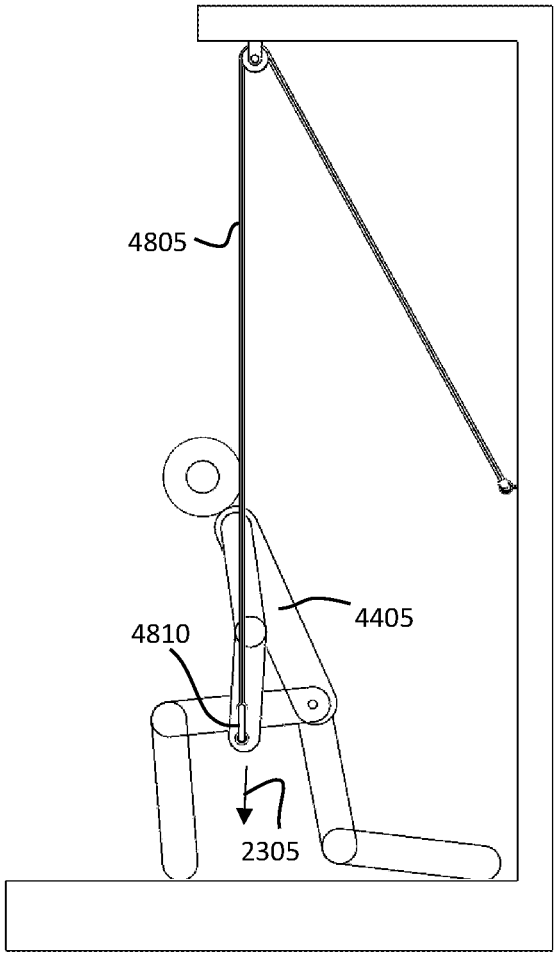
FIG. 21 is another side view of the embodiment of FIG. 20 showing the user in a second position of the exercise.

Next, as shown in FIG. 21, the user pushes the handles 4810 downward as if doing a dip. The motion of the handles is shown by arrow 2305. This increases the tension and vertical force of the elastic cords 4805 and provides vertical assistance to the lower body for the lunge motion. This is an example of why it is important for the elastic cords to pass through the overhead pulleys and to be anchored at a distance from those pulleys, because this allows the elastics to stretch far enough to perform this exercise, even if the device is located in an in-home gym with a ceiling height of approximately 8 ft.

Figure 22:
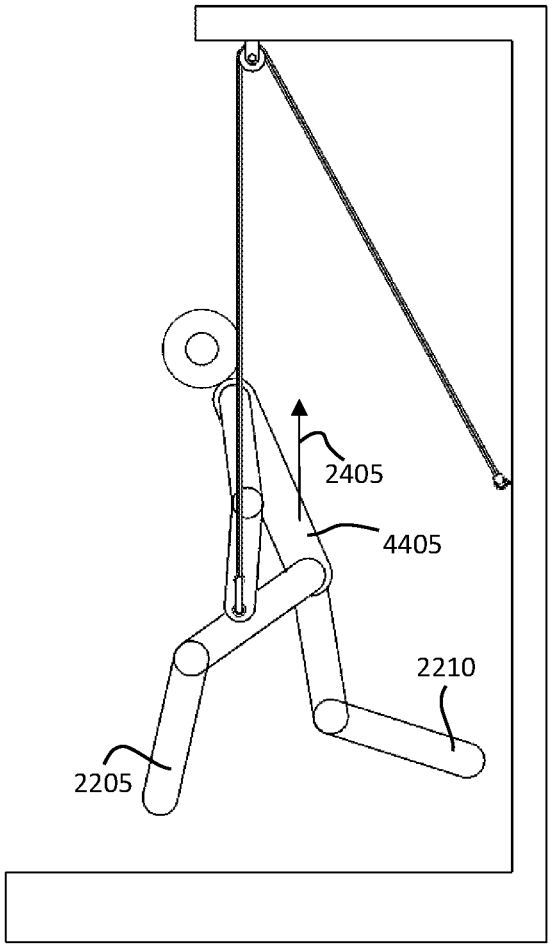
FIG. 22 is side view of the embodiment of FIG. 20 showing the user in a third position of the exercise.

Next, as shown in FIG. 22, the user 4405 pushes down with their legs, which moves their body and center of gravity up in the direction shown by arrow 2405. With a fast enough motion with sufficient force from the leg muscles, the user will be suspended above the floor momentarily, because the upward force of the elastic cords is supporting the body weight of the user enough to give them the sensation of doing lunges in a lower gravity environment.

Figure 23:
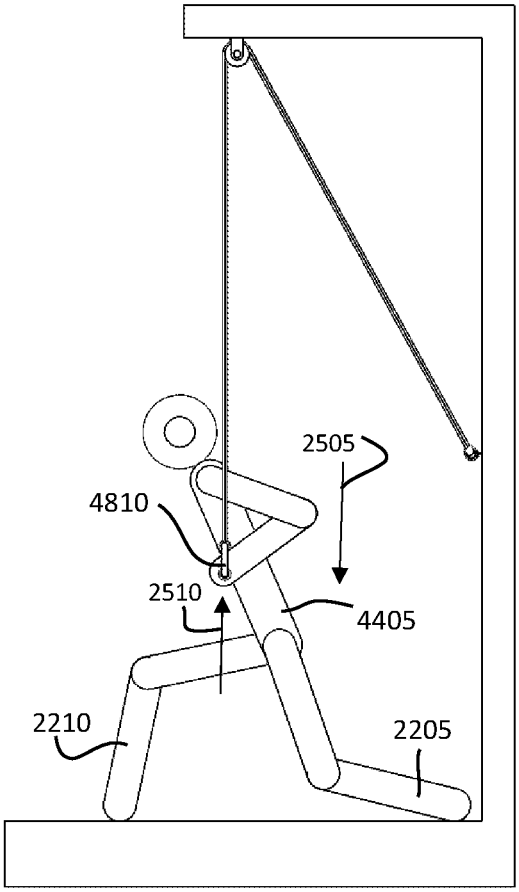
FIG. 23 is a side view of the embodiment of FIG. 20 showing the user in a fourth position of the exercise corresponding to the first position with legs reversed.

As shown in FIG. 23, while suspended above the floor, the user 4405 may move the back foot 2210 forward and the forward foot 2205 backward so when they return to the floor contact, the opposite foot is forward and the user repeats this motion until the upper and lower body are both fatigued. The motion of the user's center of gravity is show by arrow 2505 and the motion of the handles 4810 is shown by arrow 2510.

The surprising effect of this exercise when performed with the device disclosed here, is that the upper body muscles, which are weaker than the lower body muscles, are able to provide the desired level of assistance to the lower body to make the lunge part of the exercise challenging for the user, while at the same time, the upper body must work hard enough to sufficiently fatigue the upper body muscles that are recruited for the dip portion of the exercise.

It is well known in the fitness industry that triceps exercises, with conventional cable or elastic machines, tend to stress the triceps during one phase of the motion more than others because the resistance force is coming from a similar direction through the whole motion. When the user pulls down on the handle of a conventional cable or elastic band workout device, they will have greater mechanical advantage over the mass being lifted at the top and bottom of the motion as a result of their forearm being less perpendicular to the elastic at the top and bottom, as compared to halfway through the motion. This results in a less effective stressing of the muscles through the full range of motion.

The present device and this method of using it, allows the user to keep the triceps loaded to a more consistent torque at the elbow through the full range of motion. This happens as a result of attaching to a handle, one or more elastics passing through the overhead-mounted pulleys as well as one or more elastics passing through the forward mounted pulleys. As a result, the lower elastic becomes more perpendicular to the user's forearm toward the bottom of the motion (when the upper elastic is becoming less perpendicular to the user's forearm). This results in a more consistent resistance at an angle that requires a more consistent torque at the user's elbow through the full range of motion. This is believed, by the inventor, to result in more significant muscle training stimulus than a single cable or elastic.

Note that the effect of this exercise method with the present device can be adjusted to achieve an effect similar to the effect to that which was achieved by the Nautilus machines invent4ed in the 1960's. With the present device, a similar effect can be achieved with a low cost and compact elastic workout system.

Figure 40:
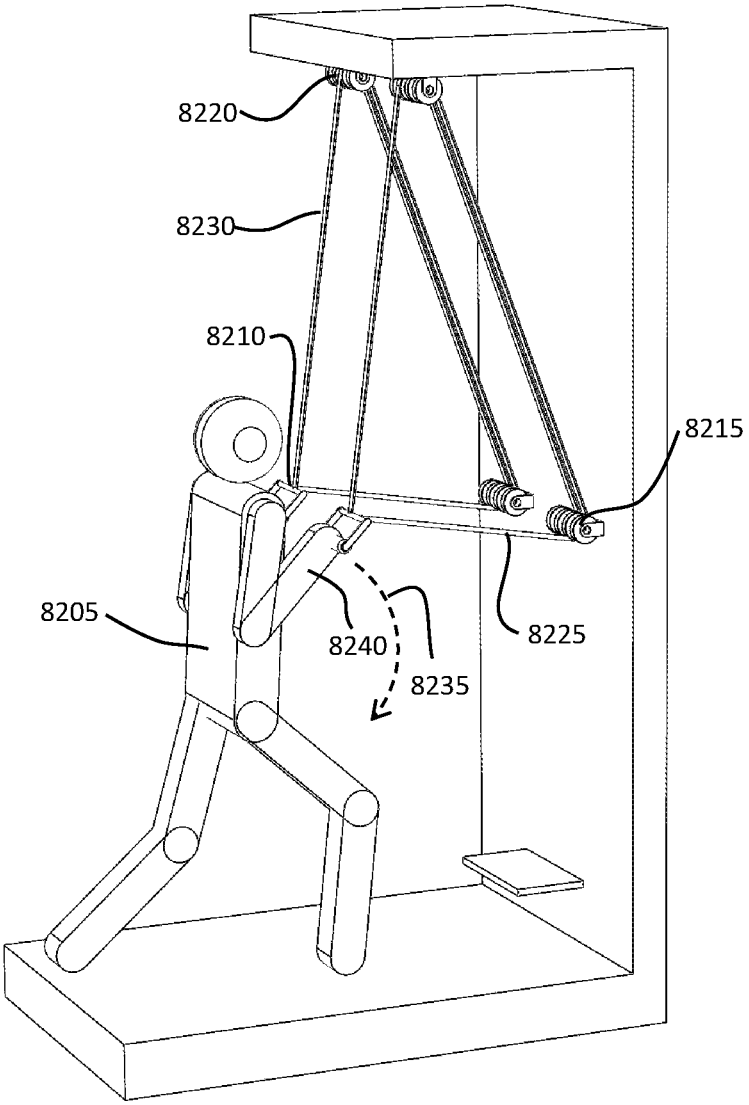
FIG. 40 is an isometric view of an embodiment of an exercise apparatus showing cords from different pulleys connected to a common handle, and showing the user in a first position of a consistent torque triceps exercise.

The embodiment shown in FIG. 40, comprises two sets of pulleys, a first upper set 8220 located above the head of the user 8205 and a second forward-mounted set of pulleys 8215 located in front of the user 8205, two sets of elastic cords, with a first set of cords 8230 attached at one end to the handles 8210 with the first set of cords 8230 passing through the upper pulleys 8220 and the opposing ends of the first set of elastic cords fixed at a location near or at the forward mounted pulleys. The second set of elastic cords 8225 is also attached at one end to the handles 8210, with the second set of elastic cords 8225 passing through the forward-mounted pulleys and the opposing end of the elastic cords fixed near or at the upper mounted pulleys 8220.

Shown in FIG. 40 is the starting position for the consistent elbow torque triceps exercise. The user 8205 may choose to use a stronger elastic cord from the vertical pulleys and a less strong cord from the forward-mounted pulleys 8210. For the first half of the motion, the upper elastic 8230 is more perpendicular to the user's forearms 8240, when viewed from the side, than the forward elastic 8225.

Figure 41:
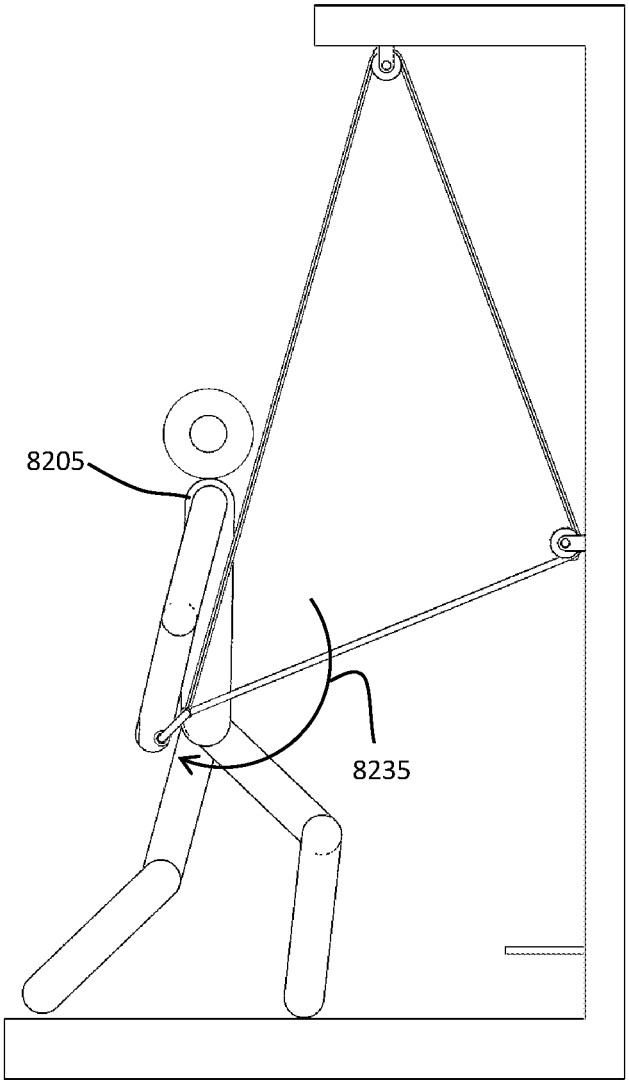
FIG. 41 is a side view of the embodiment of FIG. 40 with the user in a second position of the consistent torque triceps exercise.

As the user straightens their arms through the second half of the motion, by contracting their triceps, in the motion of the handle shown by arrow 8235 in FIG. 40 and FIG. 41, the angle of the upper elastic 8230 becomes more aligned with the forearms giving the forearms 8240 much more mechanical advantage over the upper elastic 8230. As a result, if only the upper elastic was used, the triceps would not be at maximum capacity in this position which is typically considered to be detrimental to muscle hypertrophy and fitness training. To solve this problem, the second set of elastic cords 8225 passing through the forward-mounted pulleys 8215 started less perpendicular to the forearms and is now more perpendicular to the forearms. By choosing an appropriate forward elastic strength, the user can optimize this exercise to achieve a more consistent loading of the triceps through the full range of motion.

Figure 42:
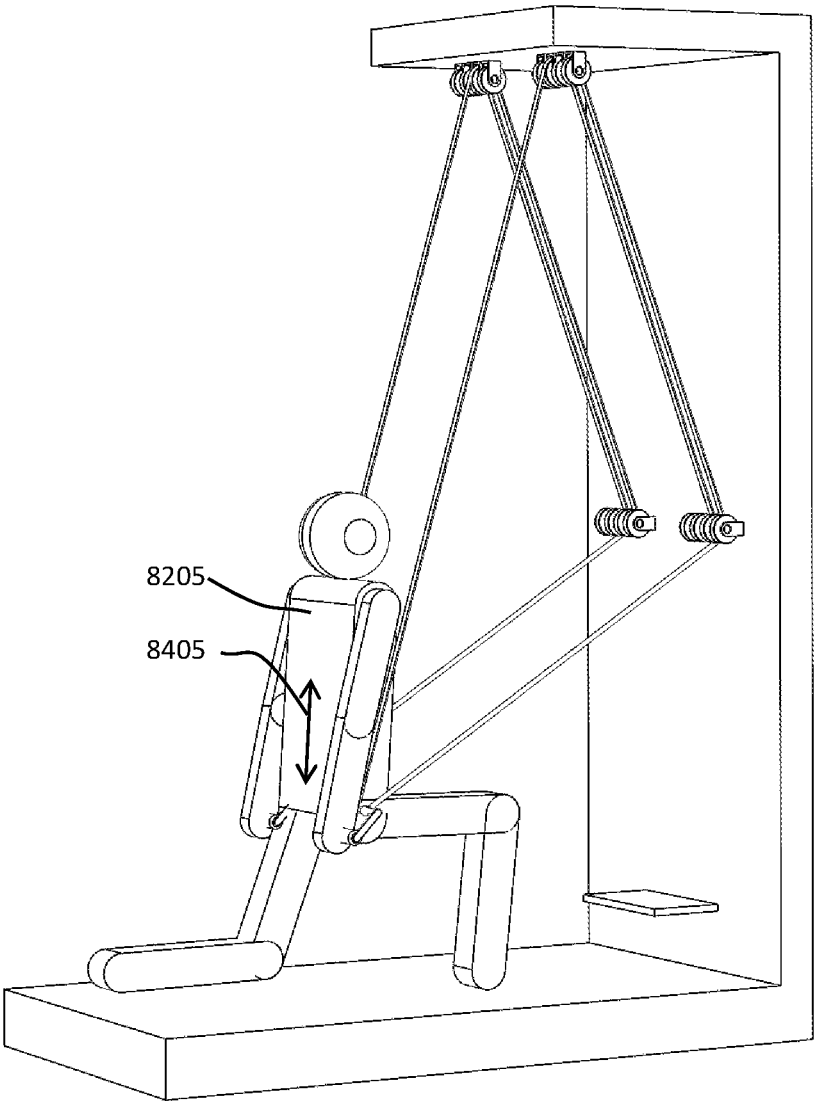
FIG. 42 is an isometric view of the embodiment of FIG. 40 with the user shown doing a different variant of the consistent torque triceps exercise.

In a variation of this exercise shown in FIG. 42, the user may raise and lower their center of gravity, the direction of movement of the user's center of gravity shown by arrows 8405, with a squat or lunge motion, for example, to increase or decrease the load on the triceps. In this way it is possible for the user to add additional load to their triceps muscles by lowering their center of gravity, or to assist their triceps by raising their center of gravity while at the same time providing exercise stimulus to their lower body muscles.

In a variation of this exercise, the user may also raise or lower their center of gravity, and/or move their center of gravity toward or away from the forward-mounted pulleys to achieve greater or lesser triceps resistance (as a result of the increased elastic resistance force with increased lengthening of the elastics) while simultaneously exercising the leg muscles during the lunge or squat or other motion to raise and lower their center of gravity.

Exercising the upper pectorals is difficult with a conventional pushup and is typically done on an incline bench press with dumbbells or a barbell.

Figure 43:
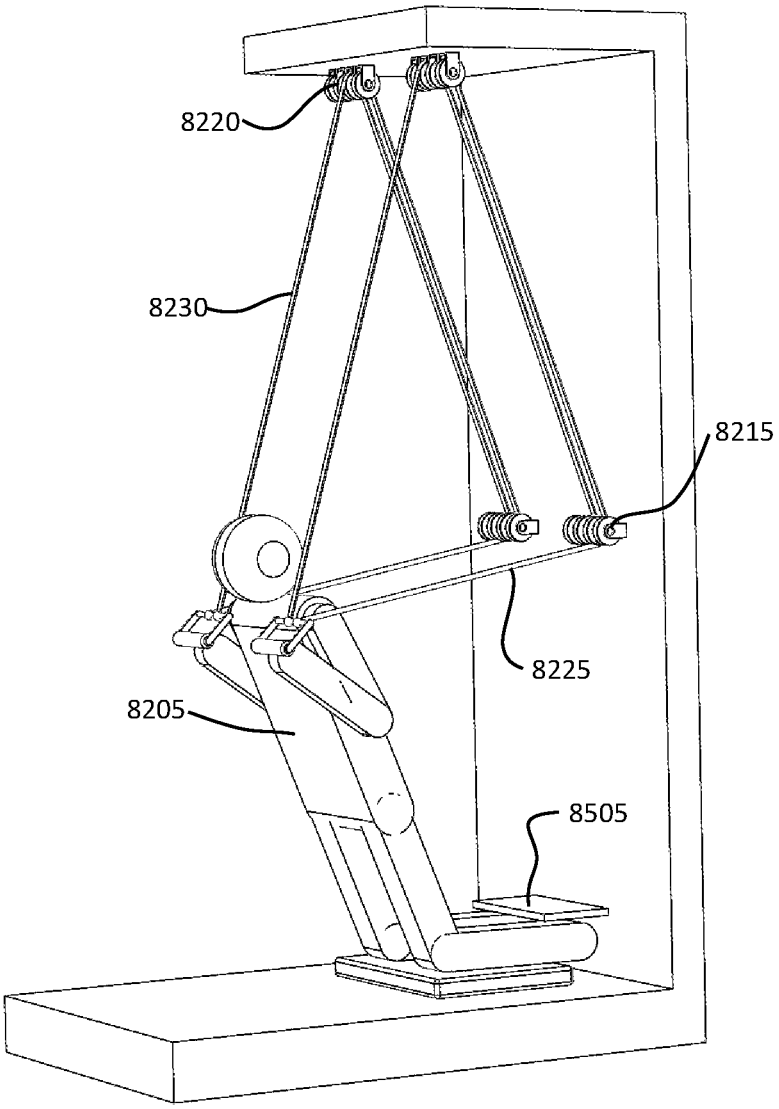
FIG. 43 is an isometric view of an embodiment of an exercise apparatus with a user in a first position of a upper pectoral/hamstring exercise.
Figures 44, 45:
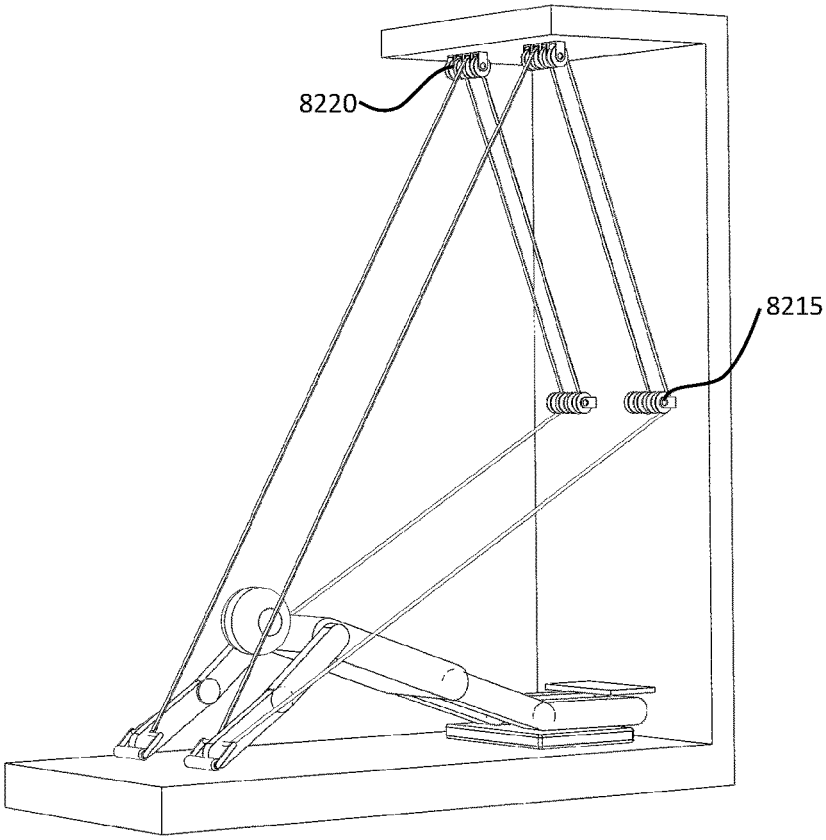
FIG. 44 is another isometric view of the embodiment of FIG. 43, showing the user in a second position of the upper pectoral/hamstring exercise.
FIG. 45 is a chart showing a table of values for displacement and tension for multiple cords of different spring rate attached together.

Shown in FIG. 43 and FIG. 44 is a combined upper chest and hamstring exercises that allows exercising of the upper pectorals and the hamstrings simultaneously by using both sets of pulleys simultaneously. Exercising the upper chest muscles is difficult with only an overhead elastic attachment. The present device and method of using it, allows the user to provide a resultant resistance load angle that is part way between the upper and forward-mounted pulleys to exercise the upper pectorals at an ideal angle while simultaneously exercising the hamstrings.

The user 8205 starts in the kneeling position holding both handles near their chest in a similar position, relative to their torso, to the lowest position of a pushup. A foot constraining platform 8505 is shown in FIG. 43 which constrains the feet of the user 8205. The user may choose to use a stronger first set of elastic cords 8230 passing through the upper pulleys 8220 and a weaker elastic from the second set of elastic cords 8225 passing through the forward-mounted pulleys 8215.

To perform the method of exercising, the user 8205 lowers themselves to a more horizontal position by extending their hamstrings and straightening their knees, this motion is referred to a Nordic curl and is a very difficult exercise for most people. The assistance from the upper body mass being partially supported by the elastics will allow many people to perform the full range of Nordic curl motion part of the exercise.

The user lowers themselves to a near-horizontal position, shown in FIG. 44, while, at some point in the motion, or throughout the motion, extending their arms against the combined resistance of the elastics. This combined angle can be adjusted (by use of different elastic strengths for the upper or forward elastics) to be upward and backward at an angle that is appropriate for exercising the upper pectorals.

As the user returns to the initial position In figure FIG. 43, they can choose to keep their arms more extended to provide more assistance to the hamstrings. Alternatively, they can choose to retract their arms to the original position earlier in the return motion to provide less assistance to the hamstrings.

The inventors have found that this method of using the present device is an effective way to allow the user to simultaneously load and exercise the upper pectorals and hamstrings in such a way as to simultaneously bring them both to failure or near failure or whatever level of exhaustion desired by the user.

An objective of the device is to provide a convenient and effective method of muscle training for a disabled user, such as someone in a wheelchair. This can be accomplished with a simple chin-up motion or a range of other motions for upper body training as described here for able bodied users. In addition, it is possible, with the present device, to move lower limbs, that may be paralyzed or injured as a result of the upper body motion. This can be used to strengthen the lower body muscles, or to promote blood flow and mobility of these limbs and joints.

Figure 31:
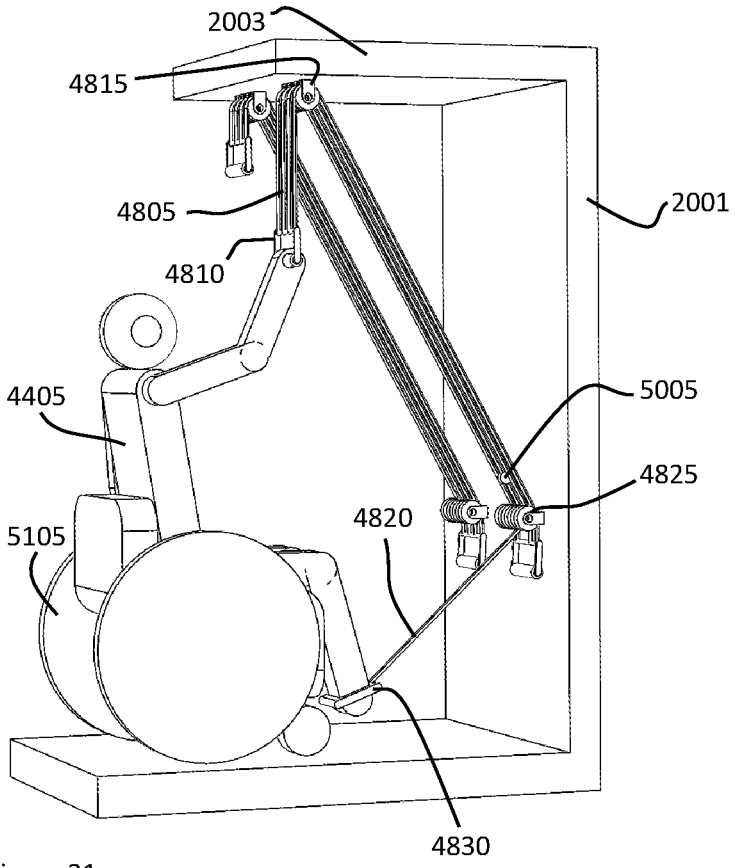
FIG. 31 is an isometric view of another embodiment of an exercise apparatus, showing a person in a wheelchair in a first position of a chin-up leg extension exercise.

In a non-limiting example of a method of using the present device shown in FIG. 31, a person in a wheelchair performs a chin-up motion with one arm (the inventor contemplates that two arms could be used as well). There are many ways to move a lower body limb as result of the chin up motion. One non-limiting example is shown here.

In the embodiment shown in FIG. 31, one or more primary elastic cords 4805 are attached to the handle 4810 extending through the overhead pulleys 4815. One or more of the elastic cords 4805 that are attached to the handle passes though the upper pulley 4815 but does not pass through a lower pulley. Instead, the non-handle end of this cord connects to a secondary cord 4820. The secondary cord is preferably a stronger elastic cord (higher k-value than the primary cord), or a non-elastic rope. The interface between the primary cord and the secondary cord is shown by element 5005 and could comprise any well-known method of connecting two cords, ideally in a manner that is simple and quick to change for example a mechanical clasp, locking carabiner on one cord that connects to a ring on the other cord, etc. The non-elastic rope or stronger elastic 4820 passes through a lower pulley 4825 and terminates at a user-interfacing harness 4830 attached to a foot or leg of the user. Note that the non-elastic cord or stronger elastic secondary cord may also be attached to an upper handle 4810 with the secondary cord passing through an upper pulley 4815, and with a lower strength elastic passing through the lower pulley 4425 and terminating at the foot or leg harness 4830. Attaching a secondary cord to the primary cord allows the user to adjust the tension vs. displacement profile of the user-interfacing elements. This configuration may make it easier for a person in a wheelchair to reduce the elastic strength by starting the motion under less tension and or at a lower position to tailor the resistance to their training needs. Various combinations of elastics and/or non-elastic cords are envisioned by the inventors.

As shown in FIG. 31 and FIG. 32, by pulling down on the user-interfacing upper handle 4810, the user 4405 will train muscles in their upper body while at the same time increasing the tension on the primary cord and secondary rope or cord 4820 attached to the foot or leg harness 4830, because the leg harness 4830 is attached to one end of the cord 4805 via secondary cord 4820, and the other end of the cord 4805 is attached to the user-interfacing handle 4810. Arrow 4835 in FIG. 32 shows the direction of motion of the user-interfacing handle 4810 when it is pulled down by the user 4405. As shown in FIG. 31 and FIG. 32, the apparatus is set up to cause the user's leg 4845 to lift in the direction shown by arrow 4840, when the user 4405 pulls down on the handle 4810. In doing so, this motion will promote blood flow in the user's leg and lower body. It is also believed, by the inventors, that this type of combined upper and lower body motion may promote the mind-muscle connection to assist in recovery from injuries including paralysis from a stroke. In cases where the user's leg is not paralyzed and has limited strength, the strength of the elastic band 4805 connected to the leg 4845 may be selected such that when the user pulls down on the handle 4810, the cable or elastic band 4805 connected at one end to the handle and at the other end ultimately to the leg harness 4830 provides assistance to the leg muscles allowing the user to lift the leg for exercise.

Non-limiting embodiments of the device disclosed in this document use one or both of upper handles which are pulled down from above the shoulder or head height of the user, and forward-mounted user-interfacing handles. The upper user-interfacing handles, for example handles 2020 shown in FIG. 4 can be pulled vertically downward, or somewhat horizontally by the user 2005, but instead of providing a constant force that simulates gravity, the device disclosed in this application provides a force which increases significantly through the range of motion of the handle. This increase of force is critical to the function of the device because it allows the user to assist the muscles of the lower body by increasing the tension on the handle by pulling it further downward than the original position above the user. The inventors contemplate a system whereby the elastic cords are attached at one end to handles, which serve as the attachment point of the user to the elastic cords. The cords are fixed at the opposite end at a pre-determined location such as a vertical wall or structure. The fixing of the opposite end may be accomplished by a pully with a stop too prevent the cord end from passing back through the pulley. The other end of the cord may also have an attachment for a handle. The placement of this fixed attachment point achieves the preferred amount of tension in the cords when at rest, such as slightly preloaded, but more or less than slightly preloaded can be used as well. The length of the cords is predetermined in order to tune the amount of tension increase (and thereby assistance) provided by the cords to the user as the cords are lengthened by the user. A longer or shorter at-rest length of the cord affects its stiffness, or k value. For example, two identical springs placed in series would have a k value that is one half (k/2) of the k value of any one of the two springs. Elastic cords made from materials such as latex or silicon tend to follow a similar trend. It is understood that whereas silicon and latex cords do not exactly follow Hooke's law, the general principles hold true for the purposes of explanation in this application. The user-interfacing portions of the device, such as handles, may be designed to accommodate varying elastic cord strengths. For example, each handle may have a plurality of mounting points for two or more elastic cords of the same or different spring rates. Thus, elastic cords may be attached from the user-interfacing portions of the device when greater resistance is desired and, conversely, elastic cords may be detached from the user-interfacing portions of the device when lower resistance is desired.

The inventors have found through experimentation that a force progression of the upper user-interfacing handles, such as handle 2020, as the handle is pulled from an initial starting location above the head of the user 2005 to a final position with the handle near the floor is effective for the exercises shown in this document if the upwards tension experienced by the handle which it is pulled all the way down to the floor is about double the tension experienced by the handle when it is located halfway to the floor when the handle is pulled vertically downwards from the initial position of the handle.

Higher and lower spring rates may also be used and are accomplished for example by using shorter or longer elastics, using different elastic materials, or simply by programming an electric motor to provide a pre-determined spring rate as the handle is pulled away from the pulley.

A force percentage increase from halfway to the floor to all the way to the floor by an amount as little as 20% is believed by the inventors to be adequate for the exercises in this document, although lower spring rates may be adequate for some exercises.

Spring rates of up to 3× the force at the floor as compared to halfway to the floor are considered by the inventors to be adequate by the exercises disclosed here, although even higher spring rates may be used in some applications.

Each handle may be attached simultaneously to multiple cords having differing lengths, k-constant/spring-rates, damping rates, and or preload tensions to tune the assistance provided by each handle. For example, a handle attached to two cords of two different lengths but the shorter cord having k-constant k1 and the longer cord having k-constant k2 would, when stretched, result in a tension profile which initially increases by k1 times displacement of the cord, but then changes to (k1+k2) times displacement once the shorter cord is stretched to the maximum un-stretched length of the longer cord.

For some exercises, it may be beneficial to create a more progressive spring rate. An example would be an exercise disclosed later in this document and shown in FIG. 24 through FIG. 28 where the user performs pistol squats. Due the high amount of leg strength required for this motion, a person at earlier stages of training would likely need a bit more upwards tension assistance from the chin-up motion powered by their arms at the very bottom of the squat range of motion. For reference, this position is shown in FIG. 26. This higher amount of tension assistance to the leg muscles from the flexing of the user's upper body which ramps up towards the bottom of the squat position can be accomplished by using a second elastic that does not begin to stretch until part way through the elongation of the first elastic.

Figure 46:
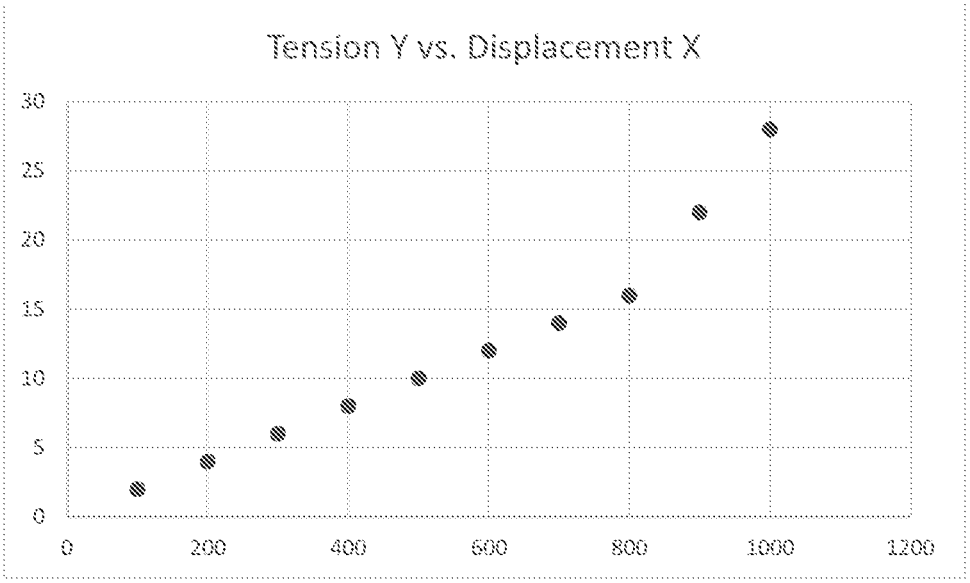
FIG. 46 is a chart showing a graph of the data shown in FIG. 45.

In a non-limiting example, a handle is attached to 2 Cords, with Cord 1 having k value k1 and Cord 2 having k value k2. Both cords are attached to a fixed structure at a position largely the same distance to the handle. Cord 2 is length 800 mm longer than Cord 1 and thus begins to stretch during the last 200 mm of travel, k2 is 2×k1, so the resulting k value ramps up by 3× for the last 200 mm. The corresponding displacement and tension of Cords 1 and 2 are shown by the table in FIG. 45 and the corresponding graph of the aforementioned table's data shown in FIG. 46.

Figure 49:
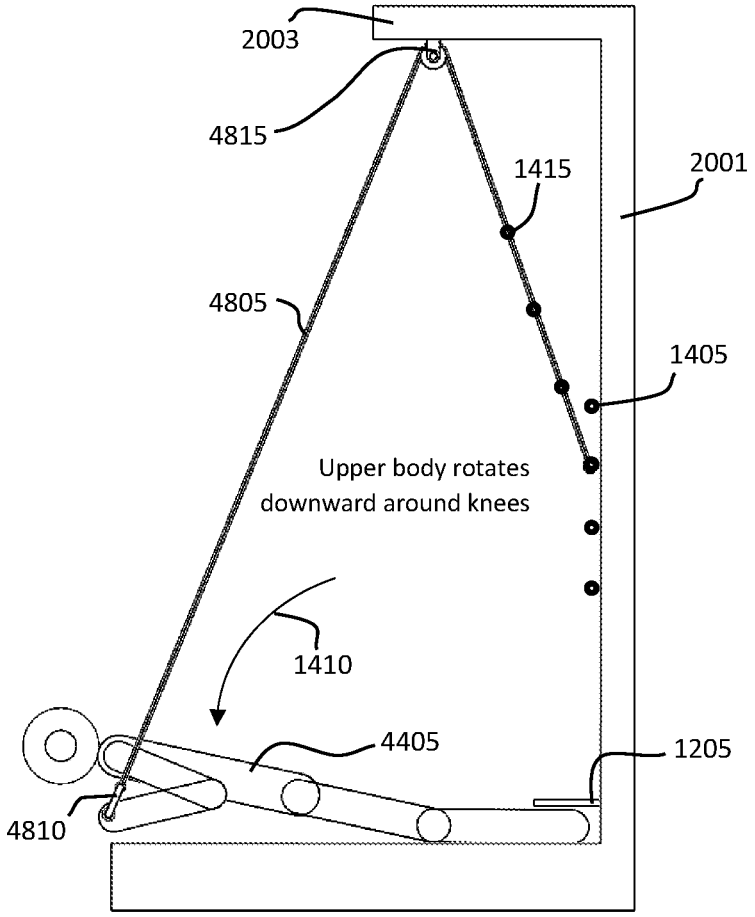
FIG. 49 is a side view of the embodiment of FIG. 47 with the user in a second position of the hamstring/pectoral exercise.

In an embodiment shown in FIG. 49, each cord 4805 has a plurality of attachment points 1415 along said cord 4805 and there are a plurality of attachment points 1405 along the fixed wall or structure 2001 so that the user can select one of many potential cord lengths between a user-interfacing handle and a fixed point in the case of a device with one set of handles, or between two user-interfacing elements at opposing ends of a cord in the case of a device with upper pulleys and forward-mounted pulleys, by choosing which attachment point along the forward structure to attach the forward-mounted pulleys.

Figure 53:
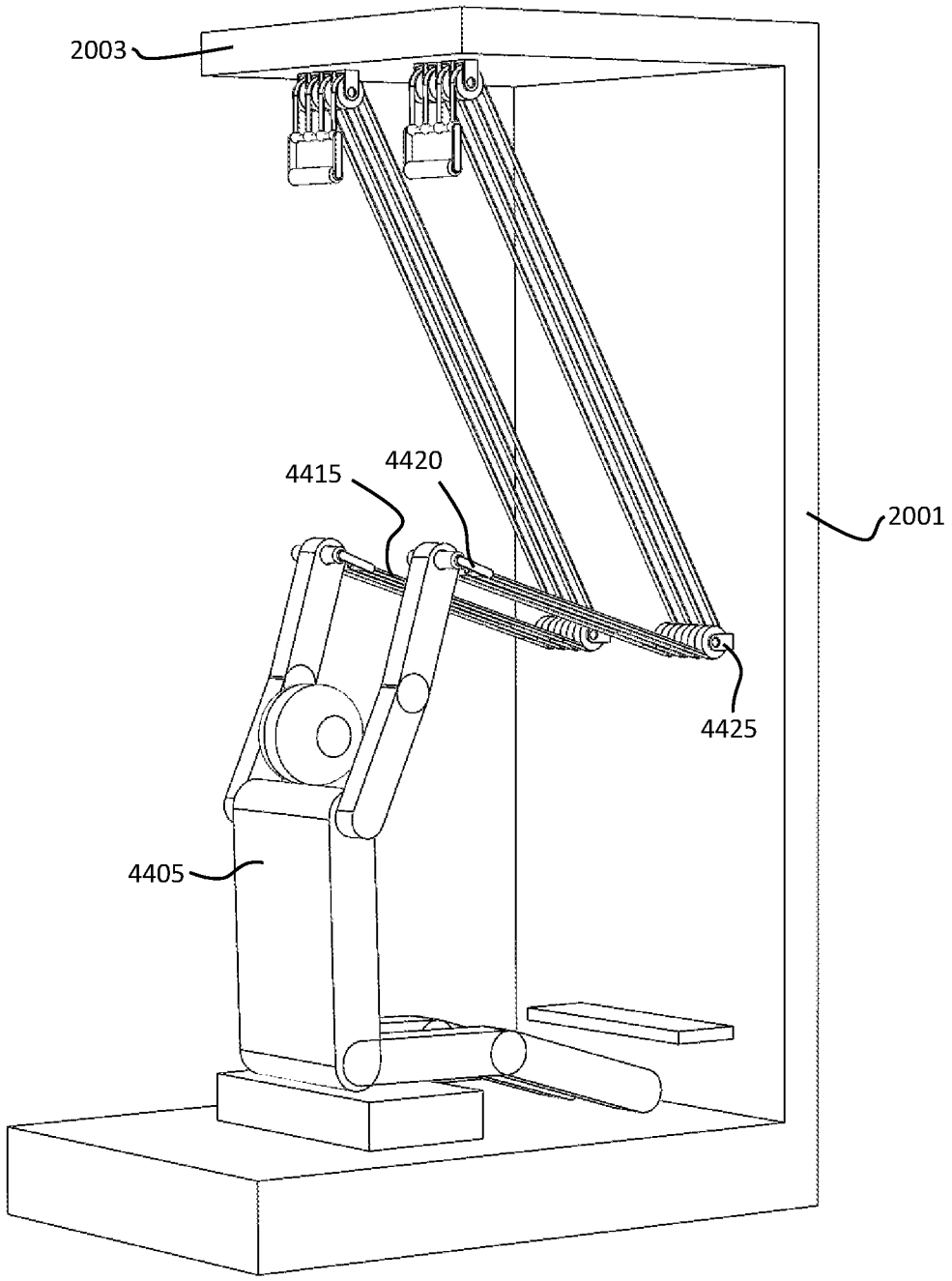
FIG. 53 is an isometric view of an embodiment of an exercise apparatus with a user in a first position of a front fly/sit ups exercise.

With the method of using the present exercise device shown in FIG. 53, the user starts in an upright sitting position and holding the handles extending from the lower pulleys, with their arms raised above their head.

Figure 54:
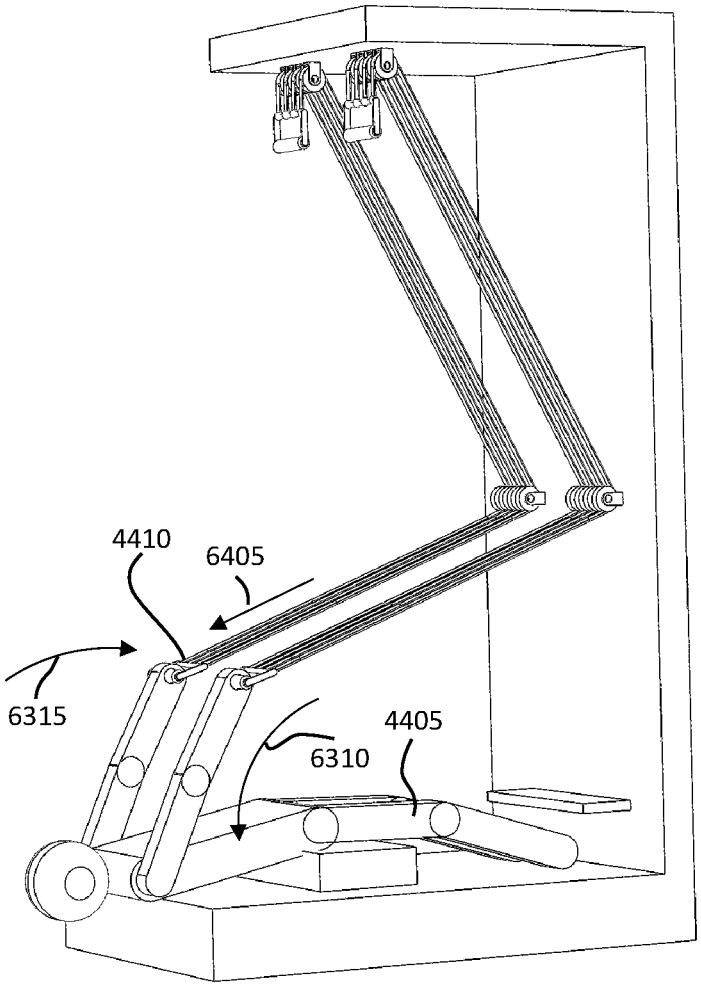
FIG. 54 is an isometric view of the embodiment of FIG. 53 with the user in a second position of the front fly/sit ups exercise.

As shown in FIG. 54, the user 4405 then sits back until they are in a more horizontal, or horizontal, or beyond horizontal attitude with their upper body. At the same time, the user lowers their straight arms relative to their torso. The motion of the handles 4410 is shown by arrow 6405, the motion of the user's arms is shown by arrow 6315 and the motion of the user's upper body is shown by arrow 6310. This motion has the unexpected benefit of keeping muscles in the shoulders in tension through the whole sit-up and at the same time, moving them through a large angular displacement (range of motion) while keeping them constantly under tension. And while the tension in the cables allows the user's shoulder muscles to assist the ab muscles, the abs are simultaneously recruited by the user to assist the shoulder muscles. This can allow the shoulder and ab muscles to both reach a high level of exertion, or fatigue, or failure at a similar number of reps.

Figure 55:
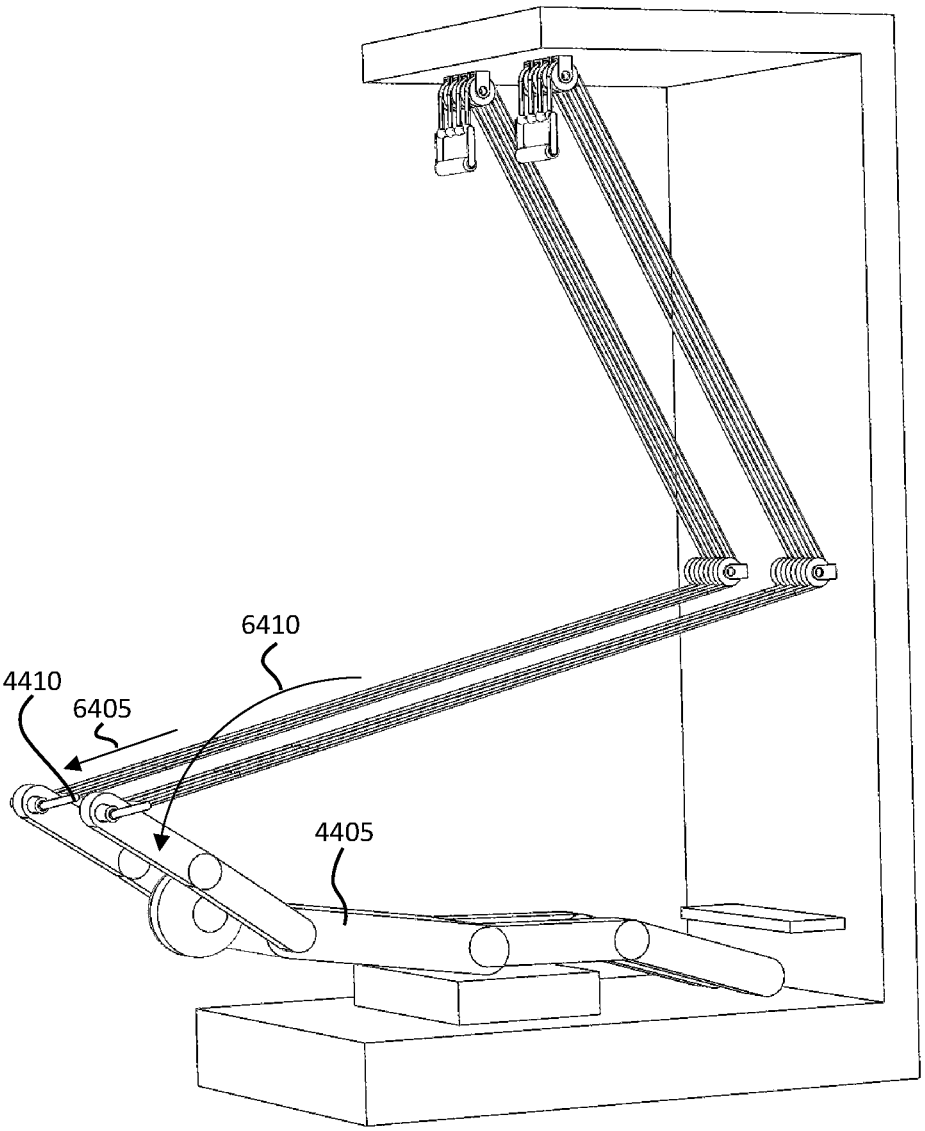
FIG. 55 is an isometric view of the embodiment of FIG. 53 with the user in a third position of the front fly/sit ups exercise.

A method of providing additional assist by the shoulder muscles, to reduce the load on the abdominal muscles is shown in FIG. 55. When the user 4405 is at the horizontal torso phase of the motion, the user angles their arms up, about their shoulders, to a more overhead position, relative to their torso. This creates higher tension in the elastic cords which results in the shoulder muscles taking on a greater ratio of the total force required to complete this combined exercise method as compared to the abdominal muscles. The motion of the handles 4410 is shown by arrow 6405 and the motion of the users arms is shown by arrow 6410.

Figure 60:
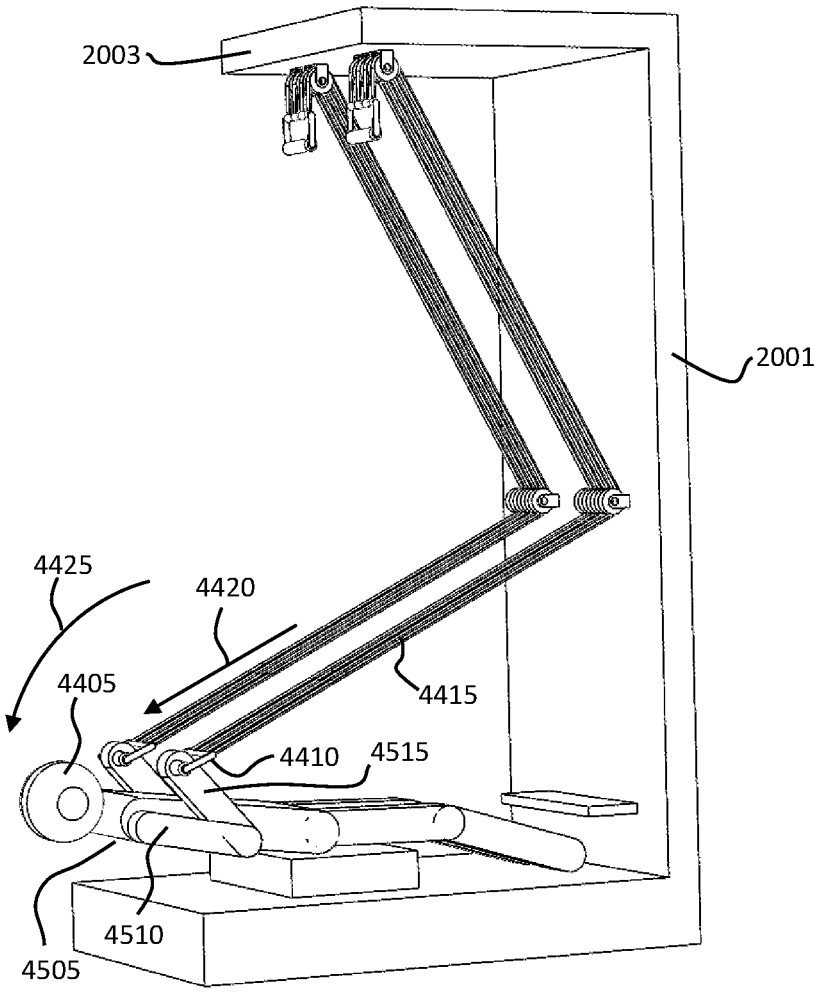
FIG. 60 is an isometric view of an embodiment of FIG. 59 with the user in a second position of the sit up/isometric curl exercise.

In an embodiment the user 4405 starts in a sitting position with their arms straight or nearly straight in front of their body, for example in the position shown in FIG. 2. The user 3905 starts in an upright seated position and pulls generally horizontally on the lower ends of the cords via user-interfacing handles 3910. The user's bicep muscles are under tension in this position due to the initial lengthening of the cords 3915. The user then leans back as shown in FIG. 2, which puts their core muscles under tension. Next, the user performs a row motion or bicep curl motion as shown in FIG. 60, pulling the handles towards their torso and stretching the elastic cords 4415 shown in FIG. 60, increasing the tension in said cords 4415, and thereby assisting their core muscles as they overcome the force of gravity on their upper body. This allows the user to self-assist their exercise motion, allowing even users with weak core muscles to train their abdominal muscles as well as other muscles recruited to perform the sit-up motion.

Figure 59:
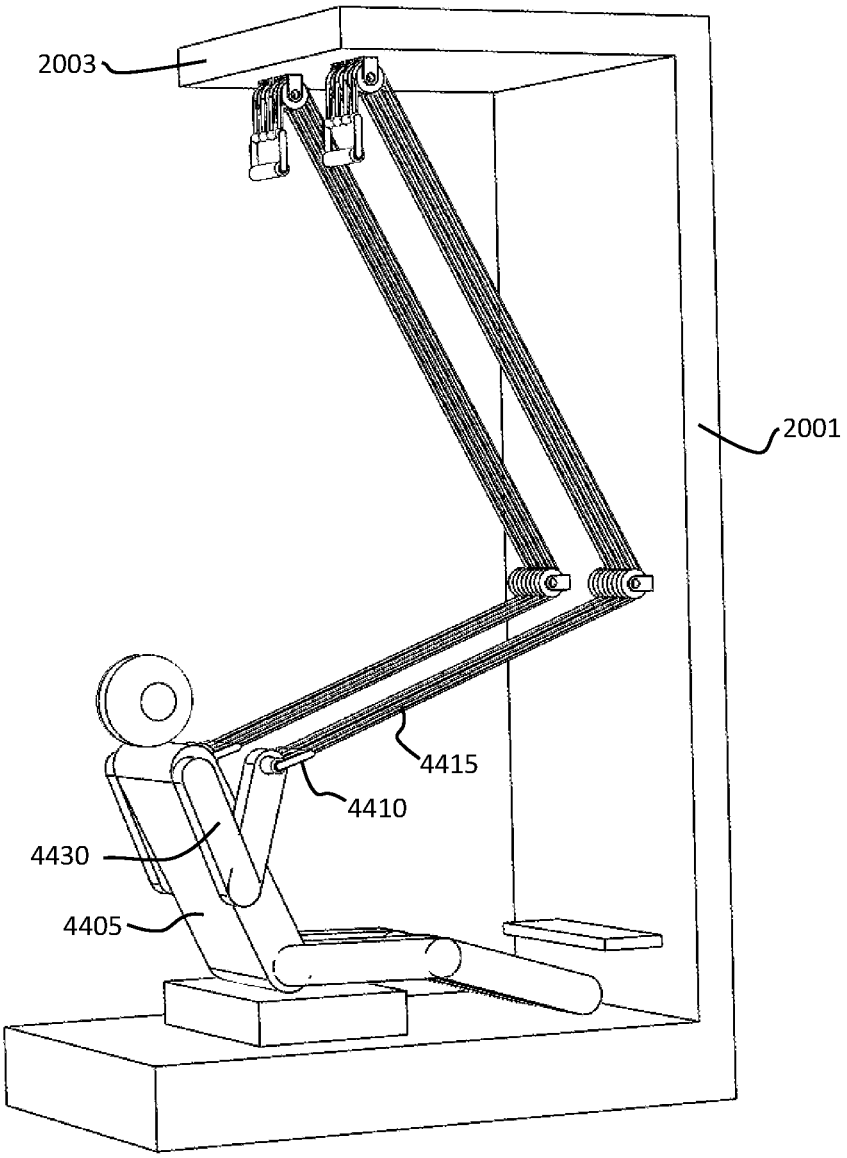
FIG. 59 is an isometric view of an embodiment of an exercise apparatus with a user in a first position of a sit up/isometric curl exercise.

A number of combined upper body and core or lower body muscle training methods are possible with the present device including some that do not require movement of one or more muscle groups due to the benefits of isometric resistance as the core or lower body travel through a range of motion that varies the tension on the cords and therefore, the tension on the muscles of the upper body. An example is the combined sit-up/isometric arm curl method of exercise disclosed here in FIG. 59, FIG. 60, and FIG. 61. As shown in FIG. 59, the user 4405 starts in an upright seated position and pulls generally horizontally on the lower ends of the cords via user-interfacing handles 4410. The user's bicep muscles are under tension in this position due to the initial lengthening of the cords 4415.

As shown in FIG. 60, the user then sits back toward a horizontal position with their upper body 4505 while maintaining the position of their upper arms 4510 and lower arms 4515 relative to their torso. The extra tension of the lengthened cords 4415 provides assistance to the abdominal muscles of the user while also increasing the isometric force on the user's bicep muscles and other upper body muscles.

Figure 61:
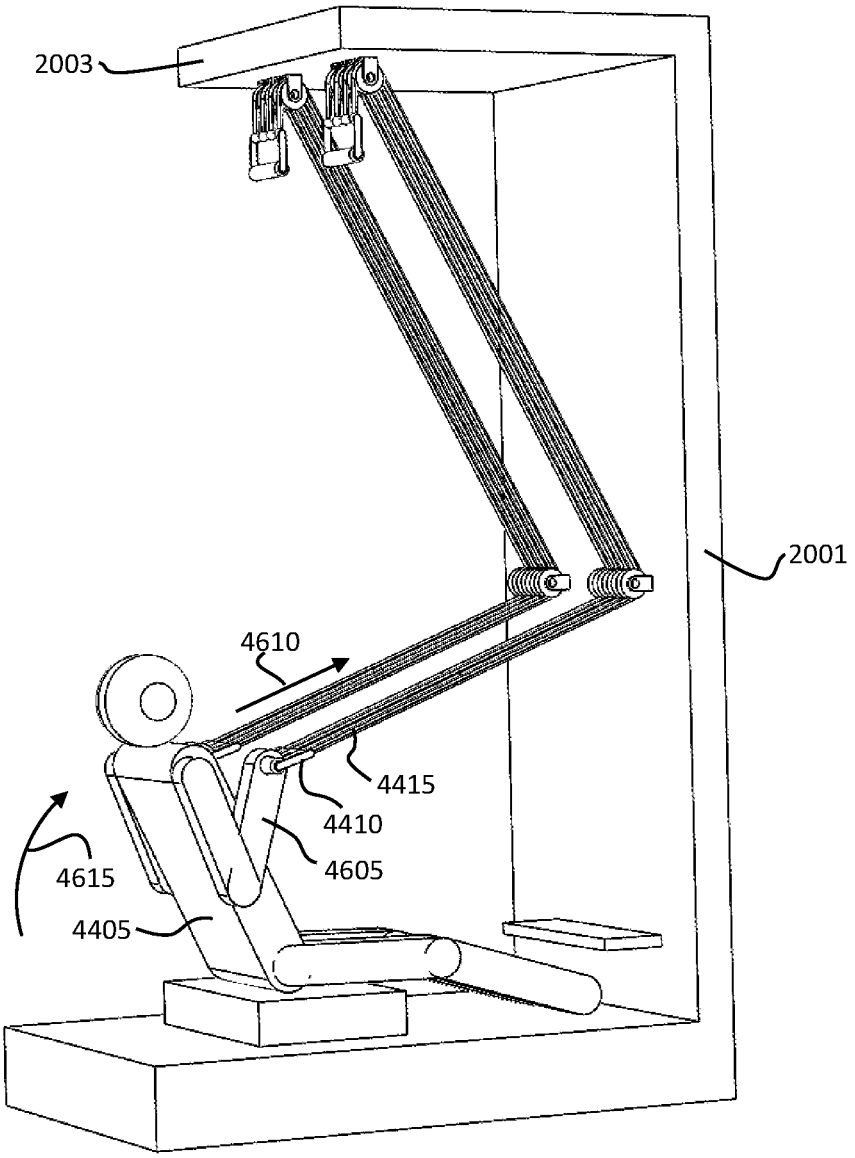
FIG. 61 is an isometric view of an embodiment of FIG. 59 with the user in a third position of the sit up/isometric curl exercise.

As shown in FIG. 61, the user 4405 then sits back up to the upright position without straightening their arms 4605, and then repeats the motion, preferably until failure or close to failure. The motion of the handles is shown by arrow 4610 and the motion of the user's upper body is shown by arrow 4615 as the user sits back up. It is preferable to choose a combination of elastic cord strengths that cause the core muscles and the arm muscles to fatigue to failure or near failure at the same number of reps. If the arms reach failure before the core on a set, the user can reduce the total strength of the cords for the next set so the core must do a higher % of the work to complete this method of motion.

Conventional shrugs with a barbell or dumbbell can be difficult and can cause injury for a couple of main reasons. One is that the mass of the bar and weights is the same in the fully stretched (lowest) position where the muscles are more vulnerable to injury. Furthermore, the use of a barbell may require a person to lean forward slightly when doing shrugs, which can put undue strain on the lower back.

Conventional sit-ups can be stressful on a person's lower back. One possible explanation for this is the tension of the ab muscles which are very close to the spine. The high compression of the lower spine that results from this, can be uncomfortable or even cause pain in some individuals. Furthermore, a person of poor or even average fitness may have difficulty performing a high number of sit-up reps. High reps have advantages for certain types of muscle training such as, but not limited to, optimizing hypertrophy.

The method of combining shrugs and sit-ups with the present device, as described here, reduces the risk of injury from the shrug aspect of the motion, by reducing the strain on the lower back, and reducing the force that must be exerted by the trap muscles when they are in the fully stretched position.

The assistance, to the abdominal muscles, resulting from the elastic cord tension, is believed, by the inventors, to create less compressive stress on the spine as compared to an unassisted sit-up. This is believed, by the inventors, to result from a greater distance of the elastic tension line, from the spine, as compared to relying on the tension of the abdominal muscles alone. In addition to this mechanical explanation theory, a number of users have experienced the ability to perform a higher number of sit-up reps with reduced lower back strain by using the present device with something similar to the following method.

To perform the exercise, the user 3905 starts in the upright seated position as shown in FIG. 2. With their arms extended somewhat toward the lower pulleys 3920 while grasping the handles 3910 which provide the initial cord tension due to the elongation of the cords which are preferably partly stretched in this initial user position.

As shown in FIG. 2, the user 3905 then lowers themselves in an eccentric contraction of the abdominal muscles with assistance from the tensioned cords through their stretched trap muscles.

Figure 56:
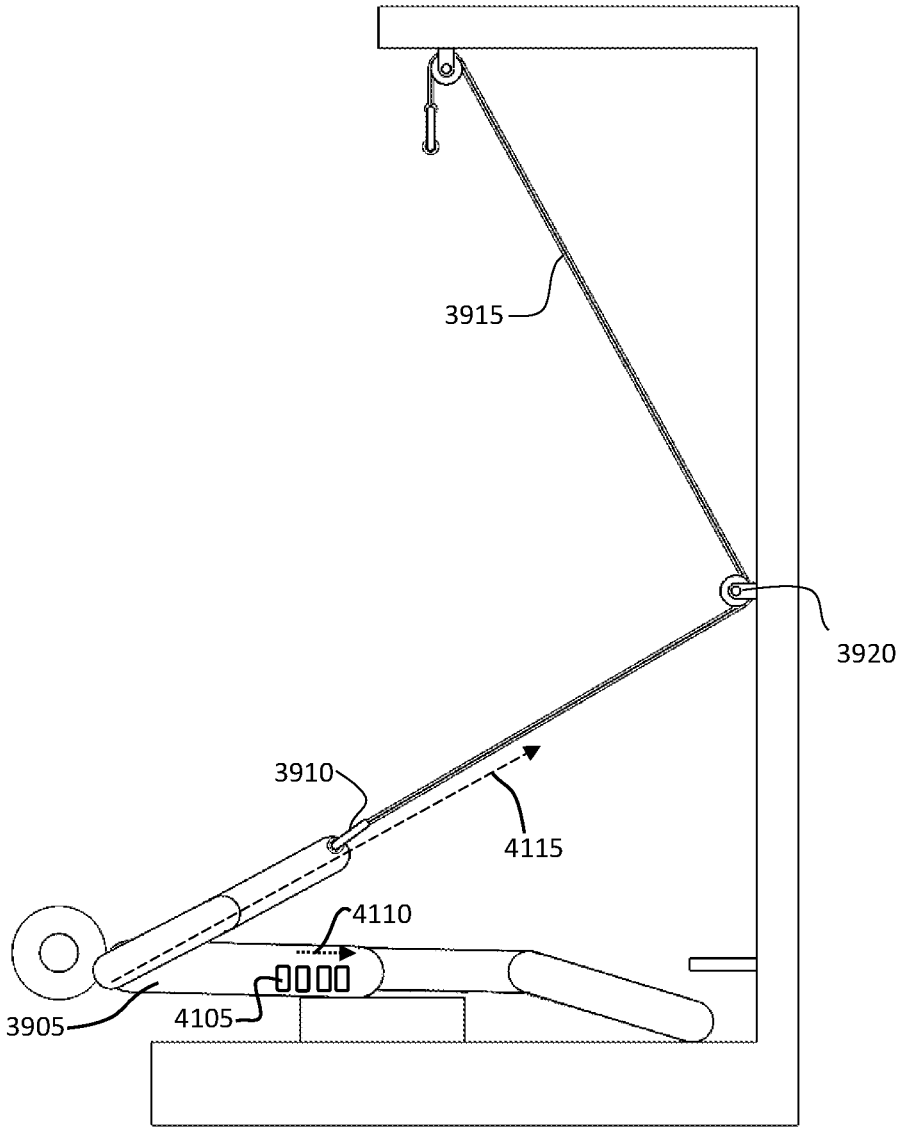
FIG. 56 is a side view of an embodiment of FIG. 2 with the user in a first position of a shrug/sit up exercise.

As shown in FIG. 56, the user then shrugs their shoulders by contracting their trapezius muscles. This increases the tension in the elastic cords 3915 and provides a muscle conditioning stimulus to the trapezius muscles.

With the present device, the lower pulleys 3920 are vertically high enough above the user's 3905 lower back, that the line of tension of the elastic cords 3915 is acting at a greater distance above the lower back vertebrate joints 4105 than the line of tension of the user's abs, the line of tension shown by arrow 4110. This results in lower leverage of the cords and abs acting on the compression of the lower back vertebrates and joints, as compared to an unassisted sit-up with only the tension of the abs acting on the lower back vertebrates and joints. The dashed arrow 4115 indicates the direction of tension acting on the handle 3910.

Figure 57:
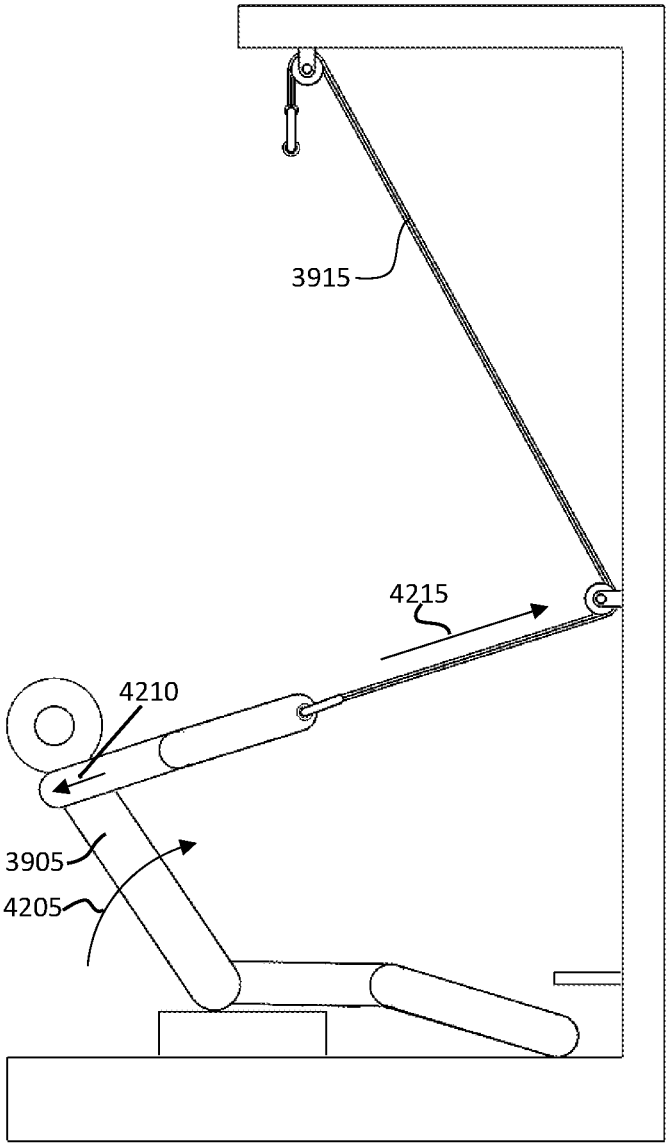
FIG. 57 is a side view of an embodiment of FIG. 56 with the user in a second position of the shrug/sit up exercise.

As shown in FIG. 57, the user then sits up, the motion of their torso indicated by arrow 4205, with assistance provided to the abdominal muscles from the tension in the elastic cords 3915 as shown in the previous figure, the direction of the tension shown in FIG. 57 by arrow 4215, and through the additional assistance to the abdominal muscles from the increased cord tension that results from contracted trap muscles (as compared to the downward phase, earlier, which had less tensioning of the cords, and therefore, less assistance from the cords), this motion caused by the trap muscles which increases tension in cable 3915 indicated by arrow 4210. This creates a motion that provides a greater tension on the abdominal muscles on the lowering phase and a reduced tension on the ab muscles on the sitting-up phase (this sitting-up phase is the phase of the motion where the compressive strain on the lower back is felt to be higher by many users in a conventional sit-up, and where the shrug, combined with the sit-up, as enabled by this method of using the present device, reduces this felt-strain on the lower back during the sitting-up phase of the sit-up).

Figure 58:
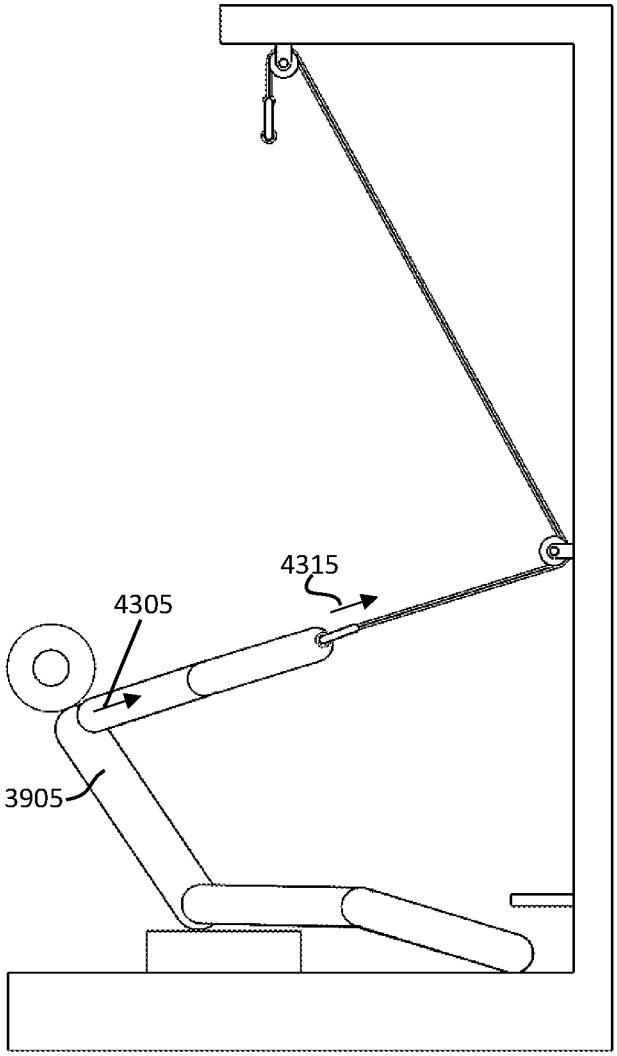
FIG. 58 is a side view of an embodiment of FIG. 56 with the user in a third position of the shrug/sit up exercise.

As shown in FIG. 58, at or near or approaching the top of the sit-up motion, the user then un-shrugs their shoulders, by extending their trap muscles, the motion shown conceptually via arrow 4305 and is ready to repeat the sequence. The direction of tension in the cables is shown by arrow 4315. Extending the traps toward the top of the sit-up, as compared to the bottom of the sit-up, results in lower tension on the traps when they are fully extended which is believed, by the inventors, to reduce the likelihood of injury to the traps as compared to a conventional gravity-based barbell or dumbbell shrug where the load and resulting trap tension is the same in all positions.

Variations to this exercise include but are not limited to a different than one to one ratio of the number of shrugs to sit-ups, a shrug or un-shrug at different sit-up positions to those described and illustrated here.

Figure 47:
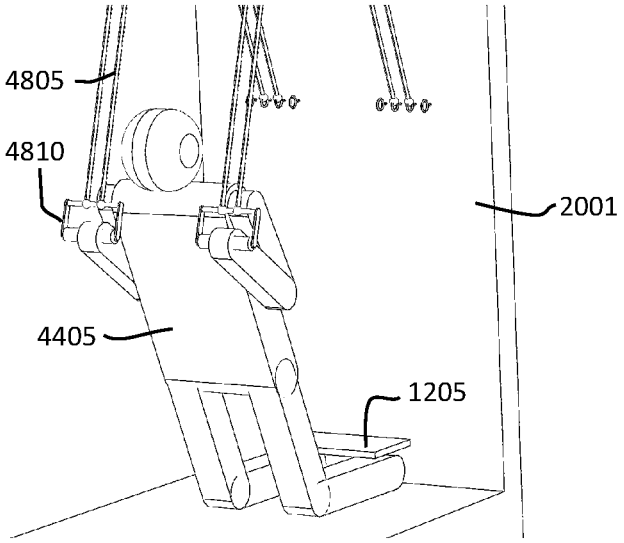
FIG. 47 is a partial isometric view of an embodiment of an exercise apparatus showing a user in a first position of a hamstring/pectoral exercise.
Figure 48:
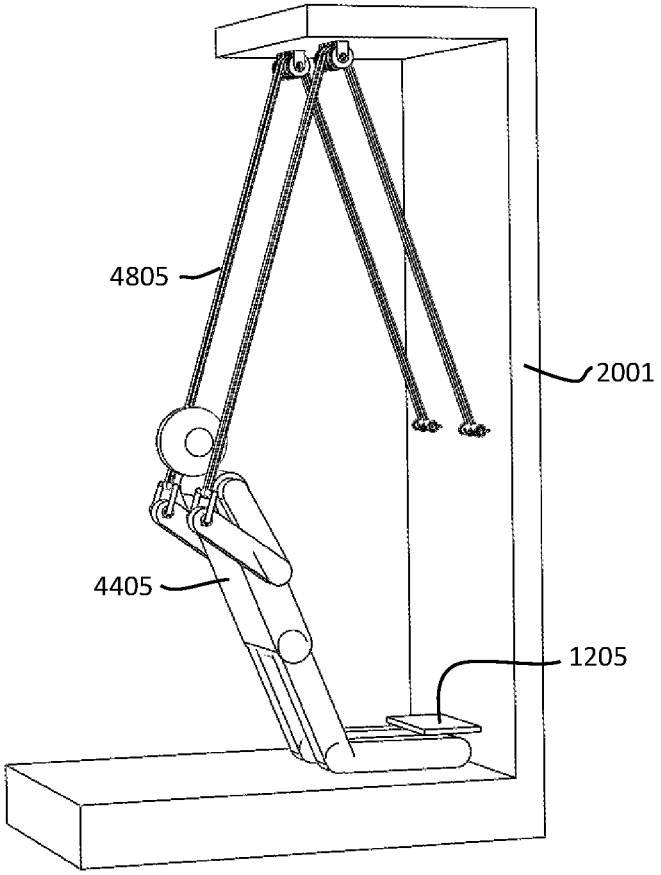
FIG. 48 is another isometric view of the embodiment of FIG. 47.

As shown in FIG. 47 and FIG. 48, the user starts by placing their feet under the foot constraining platform 1205. The handles 4810 are then held in front of and slightly outward from the shoulders.

In this non-limiting example shown in FIG. 47 through FIG. 51, two of the cords 4805 are unclipped from the handles 4810 because this exercise does not require as much assistance from the upper body of the user 4405 to the lower body of said user, and at the same time, the upper body muscle group used in this exercise are not as strong as the chin up or pull-up muscles, so a lower cord spring force is well suited to the upper body (in this case, pectoral muscles) strength.

Next, as shown in FIG. 49 the user leans forward while keeping their hips relatively straight, and pivoting at the knees. The ideal cord tension provides just enough assistance to the hamstrings so the user can control their decent with hamstring tension. This motion would be very difficult for a person of average strength, but the use of the elastic tension of the cords 4805 pulling upward has the effect of providing the ideal tension on the hamstrings so the user can do this motion and also perform multiple reps during a set, and also pull themselves back up with their hamstrings.

Figure 50:
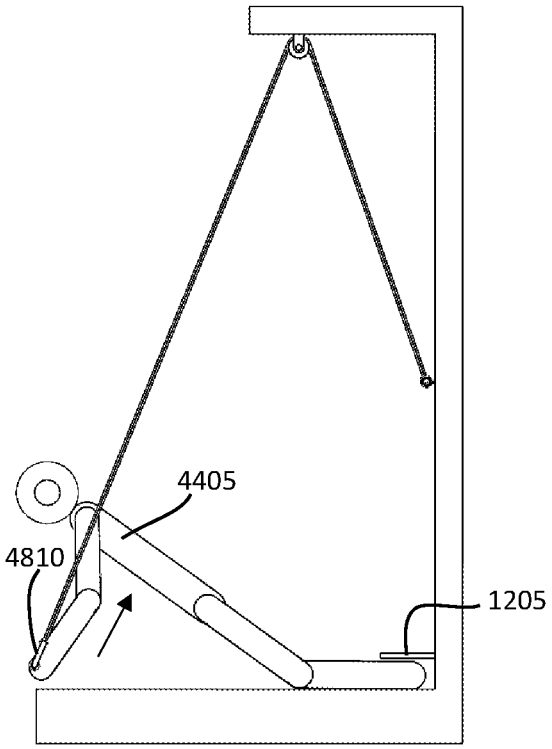
FIG. 50 is a side view of the embodiment of FIG. 47 with the user in a third position of the hamstring/pectoral exercise.

As shown in FIG. 50, when the user 4405 reaches a largely horizontal position, they will feel a high level of tension in their pectoral muscles. By contracting their hamstrings and pectoral muscles at the same time, the user can do a push-up motion, pushing against the handles 4810 to assist their hamstrings which are pressing against the foot constraining platform 1205, and simultaneously, a hamstring curl to assist their pectoral muscles. The surprising effect is that the strength of these upper and lower body muscle groups is well matched, so that both of them can reach a high level of fatigue at the same time. The other surprising effect is that this exercise can make the user feel like they are doing push-ups and hamstring curls in a reduced gravity environment. This is believed by the inventor to be because the pushing motion is made easier by the contraction of the hamstrings, and the hamstring contraction is made easier by the contraction of the pectoral muscles. At the same time, however, both of these muscles can be pushed to their limit at the same time. The result is that a high percentage of users experience a higher level of muscle exhaustion than they would expect for the reduced level of effort that they are perceiving. This effect is experienced by users who have tried this device under confidentiality during its development, for one or more of the exercises described here.

Figure 51:
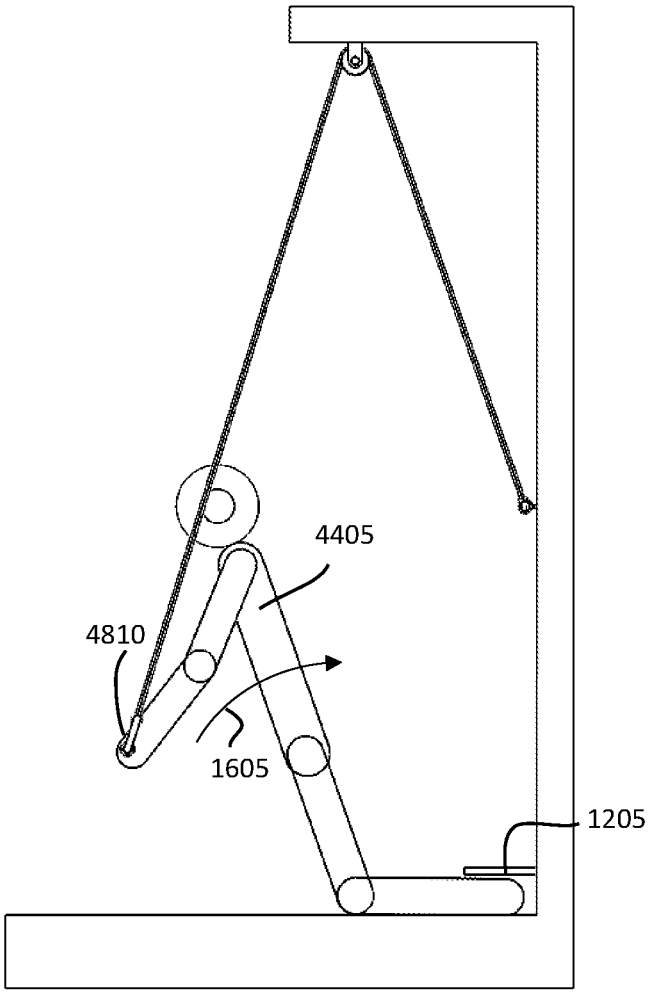
FIG. 51 is a side view of the embodiment of FIG. 47 with the user in a fourth position of the hamstring/pectoral exercise.

As shown in FIG. 51, with the increased elastic cord tension produced by the straightening of the arms in a push-up motion as the user 4405 presses against the handles 4810, the hamstrings receive enough assistance that they can contract and pull the user vertically upward. The Hamstrings of the user 4405 continue to contract and pull the user's upper body upward to a nearly vertical position. The motion of the user's upper body is shown by arrow 1605.

Figure 52:
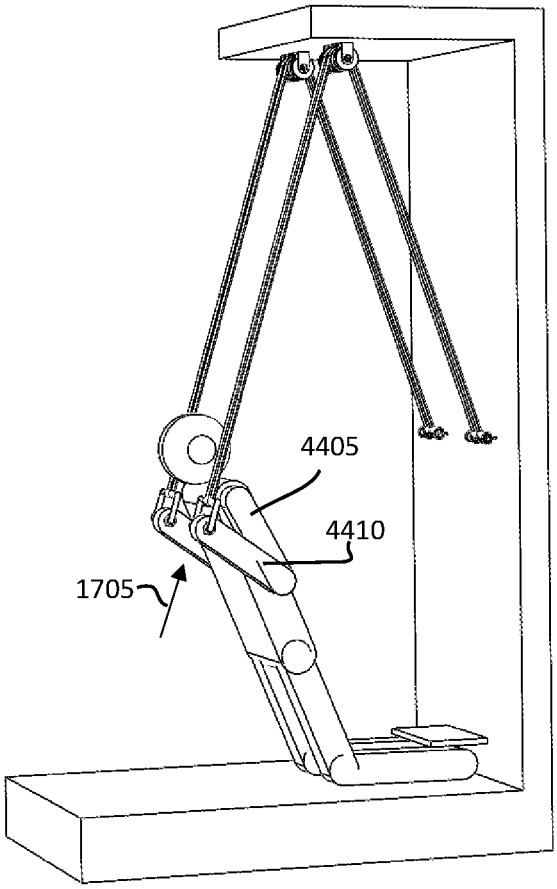
FIG. 52 is an isometric view of the embodiment of FIG. 47 with the user in a fifth position of the hamstring/pectoral exercise.

Next, as shown in FIG. 52 the user 4405 completes the motion with an eccentric contraction of the pectoral muscles and repeats the motion until they reach their desired level of exhaustion for the pectorals and/or hamstrings. As shown in this figure, the user's arms 4410 bend during the eccentric contraction and the handle moves in the direction shown by the arrow 1705.

Variations on this exercise include the exercise in which the arms are straightened before the lowering the upper body to the horizontal position. This will provide more assistance to the hamstrings during the hamstring eccentric contraction.

The lower position of the user, on their knees, results in a higher initial preload on the elastic cords than with exercises that start from a standing position. A surprising effect of this exercise is that this preload is ideal to keep the pectorals adequately loaded during the whole exercise so the pectorals can fatigue at a similar rate to the hamstrings.

Sissy squats are known to provide muscle tension and training to a different set of leg muscles than a conventional squat. Conventional sissy squats are difficult to perform because they are an unusual motion that requires good balance and it is difficult to adjust the amount of resistance. The lat row/sissy squat method of using embodiments of the device, allows a user to perform a sissy squat with much less of a balance challenge and also to vary the resistance force of gravity on their quad muscles while simultaneously exercising their back and arm muscles.

Figure 62:
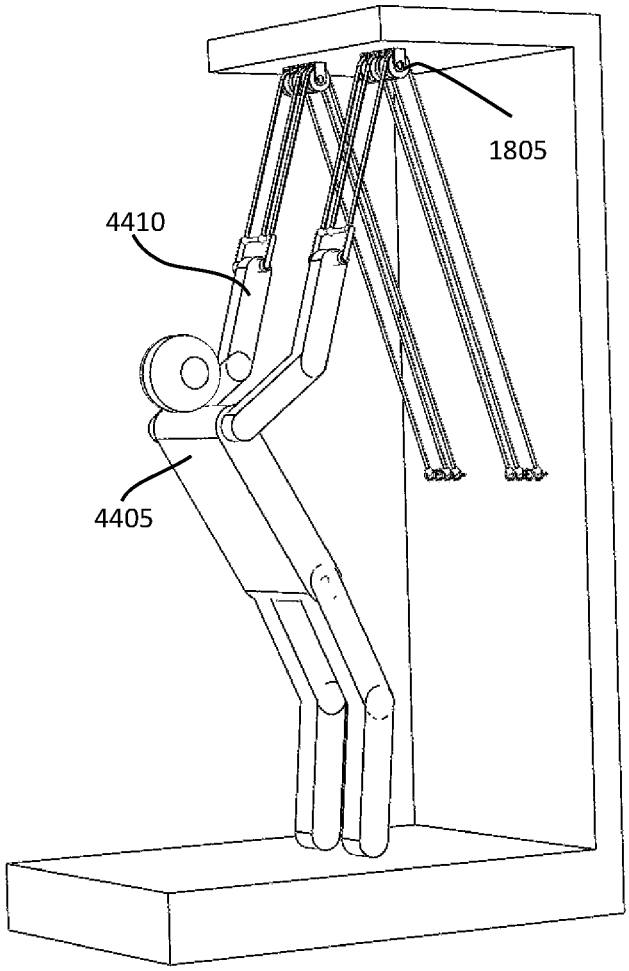
FIG. 62 is an isometric view of an embodiment of an exercise apparatus with a user in a first position of a lat row/sissy squat exercise.
Figure 63:
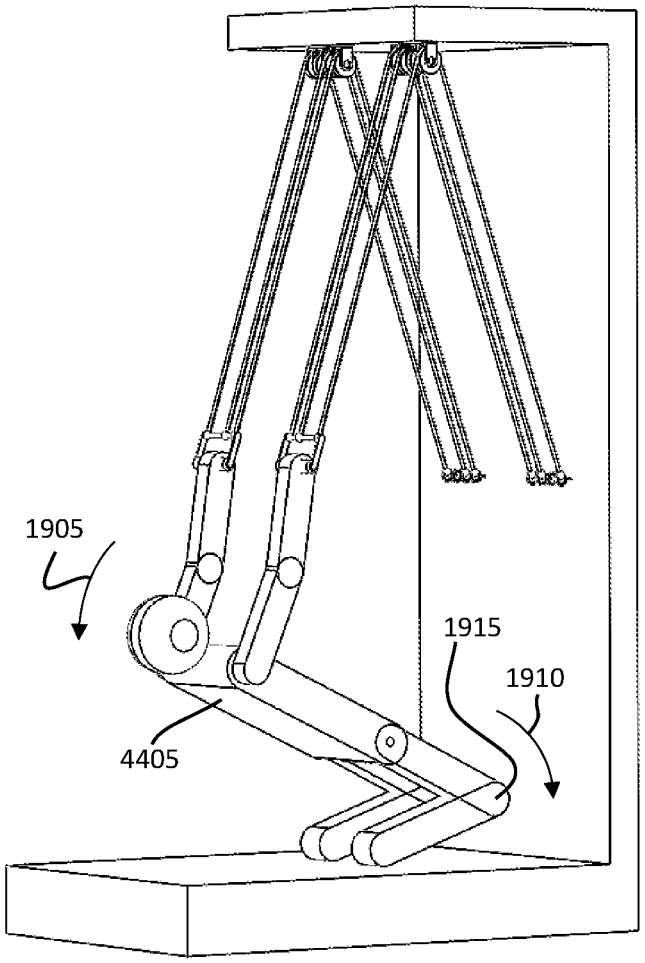
FIG. 63 is an isometric view of an embodiment of FIG. 62 with the user in a second position of the lat row/sissy squat exercise.

As shown in FIG. 62 the user starts by grasping handles attached to overhead-mounted pulleys 1805 while leaning back with their arms 4410 extended up and forward. Next, as shown in FIG. 63 the user 4405 leans back while bending their knees and lowering their hips straight down so their knees drive forward. The motion of the user's upper body as they lean back is shown back is shown by arrow 1905. The motion of the user's knees 1915 during this motion is shown by arrow 1910. This position puts a high level of tension on the quad muscles and especially the lateral quad muscles. From this position, a person of average fitness and training would have a very difficult time standing up again without assistance from the upper body.

Figure 64:
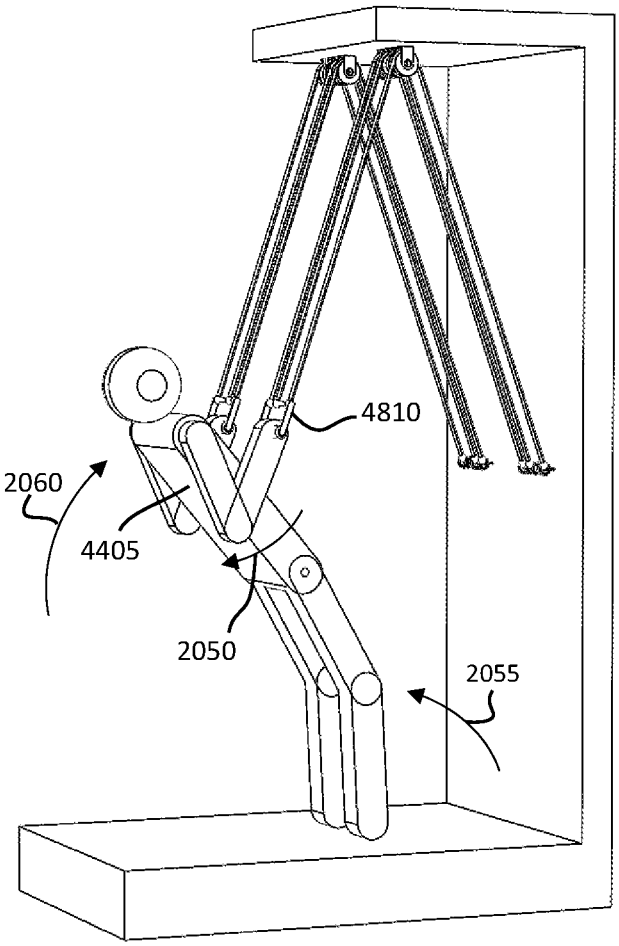
FIG. 64 is an isometric view of an embodiment of FIG. 62 with the user in a third position of the lat row/sissy squat exercise.

Next, as shown in FIG. 64 the user 4405 pulls the handles 4810 toward them in what is referred to as a "lat row". This puts tension on the user's lats and other back muscles. The motion of the user's elbows is shown by arrow 2050 and the motion of the user's knees is shown by arrow 2055. The motion of the user's upper body as it pivots up into a more vertical position is shown by arrow 2060. The surprising effect is that although the latissimus muscles are much weaker than the leg muscles, this exercise, done with this device, provides just enough assistance from the upper body to make the lower body concentric contraction possible from this position, while simultaneously providing enough assistance, from the lower body concentric contraction, to assist the upper body concentric contraction. The result is that the lower and upper body can be made to fatigue at a similar rate so they both reach a high level of fatigue at the same time.

Figure 65:
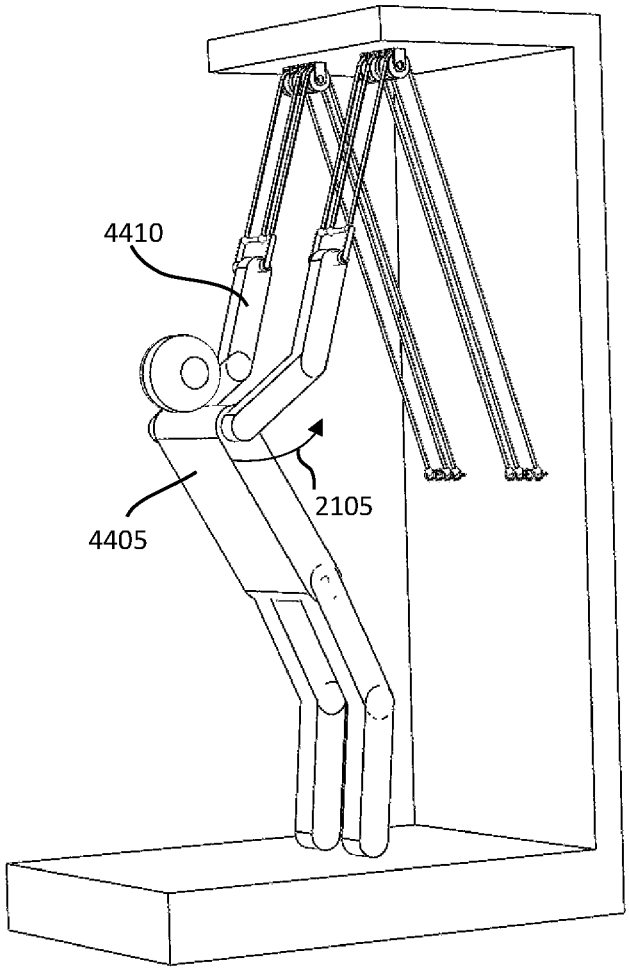
FIG. 65 is an isometric view of an embodiment of FIG. 62 with the user in a fourth position of the lat row/sissy squat exercise.

Next, as shown in FIG. 65 the user 4405 extends their arms 4410 again with the motion of their elbow shown by arrow 2105, and repeats the combined exercise.

Figure 66:
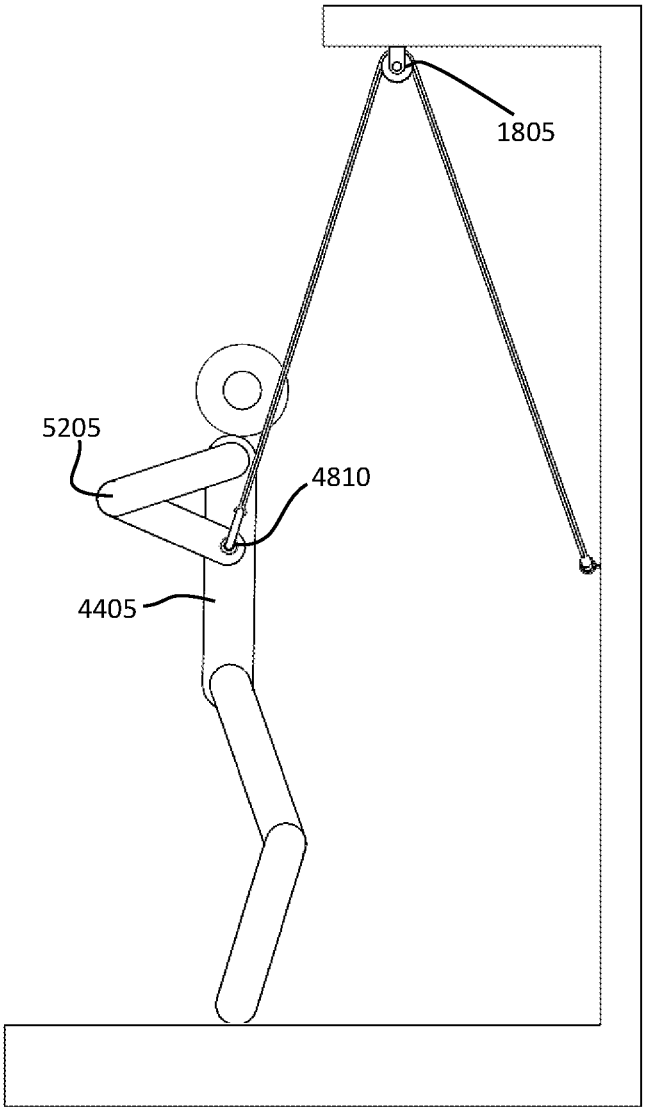
FIG. 66 is a side view of an embodiment of an exercise apparatus with a user in a first position of a constant tension triceps exercise.

Keeping a muscle group under constant tension is considered, by the inventors, to be an effective way of increasing muscle fitness, strength and/or size. This can be accomplished with the present device with the following method for triceps training. The inventors anticipate a number of other muscle groups that can be trained with the device in a way that keeps other muscle groups under constant tension. As shown in FIG. 66, to start the method of muscle training the user 4405 stands or sit in an upright position, and bends the elbows to the maximum bend position with their elbows 5205 behind them while grasping handles 4810 attached to overhead-mounted pulleys 1805. The palms of the hands may be up or down. The triceps will be in a stretched and tensioned in this position.

Figure 67:
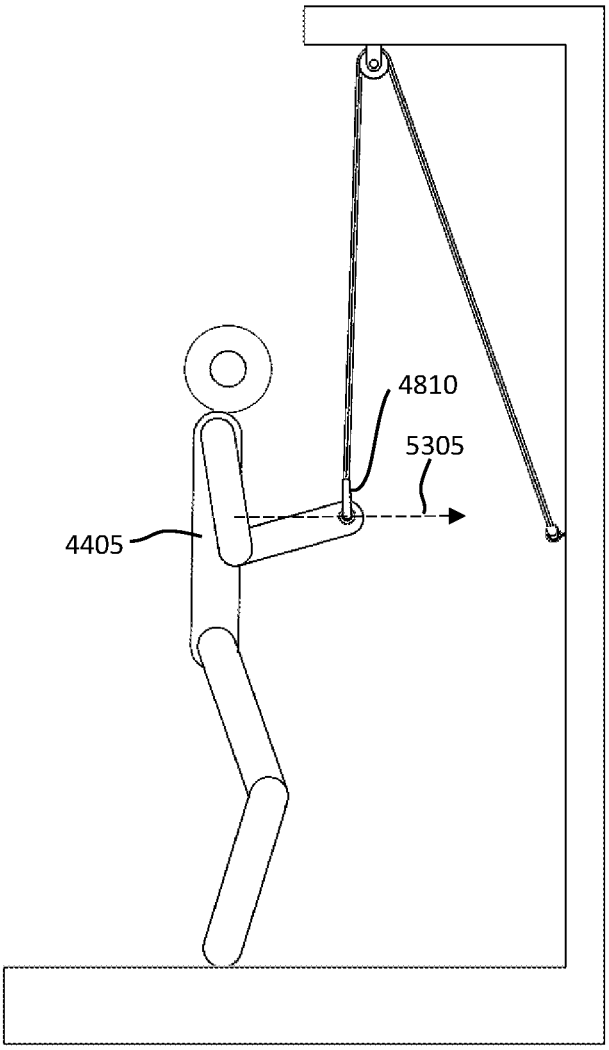
FIG. 67 is a side view of an embodiment of FIG. 66 with the user in a second position of the constant tension triceps exercise.

As shown in FIG. 67, the user 4405 then moves the handles forward in the direction shown by arrow 5305 while attempting to achieve a horizontal and straight motion of the handles 4810. This moves the triceps through a range of motion that would result in a change in tension with a typical dumbbell or barbell triceps exercise.

Figure 68:
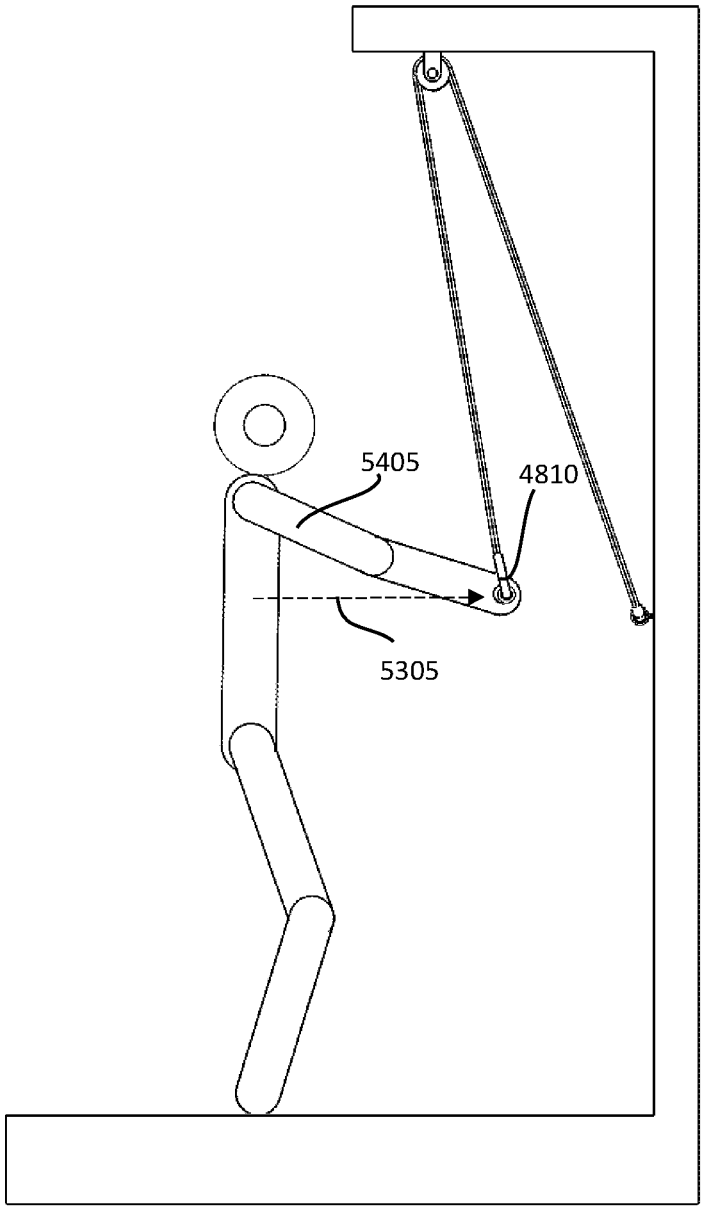
FIG. 68 is a side view of an embodiment of FIG. 66 with the user in a third position of the constant tension triceps exercise.

As shown in FIG. 68, the user continues to move the handles 4810 forward in a horizontal and straight line until the arms 5405 are completely straight. The triceps will remain at a relatively constant tension while the elbow has moved through a complete range of motion. This combination of effects is difficult to achieve with a typical free-weight or cable extension exercise on a conventional cable machine.

Variations of the exercise include moving the handles upward instead of horizontal as the handles are moved forward, this will reduce the tension in the cords if the user reaches a level of high exhaustion or failure and allow them to complete the movement.

Figure 69:
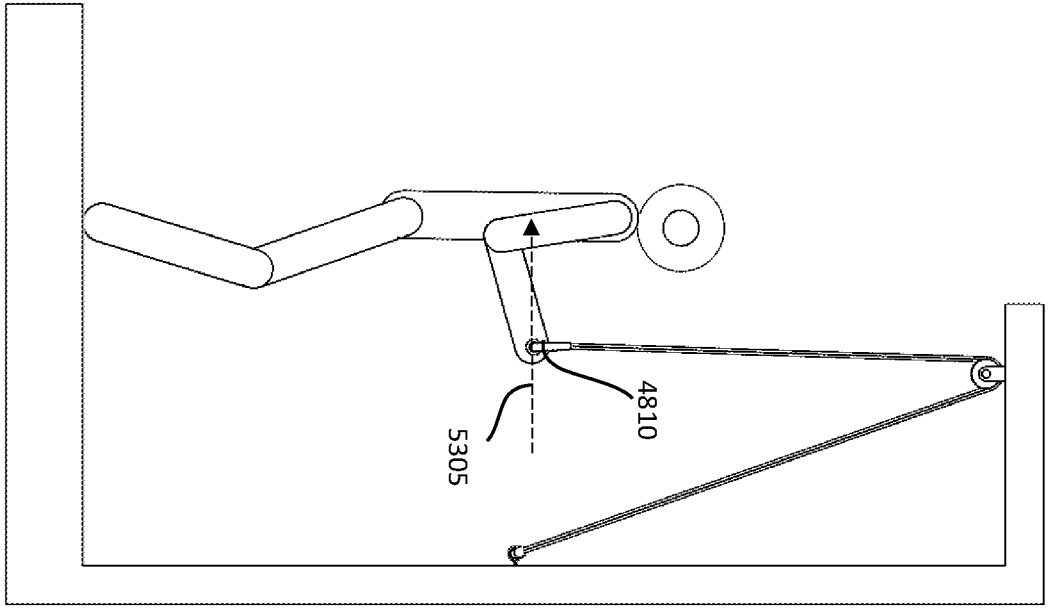
FIG. 69 is a side view of an embodiment of FIG. 66 with the user in a forth position of the constant tension triceps exercise.
Figure 70:
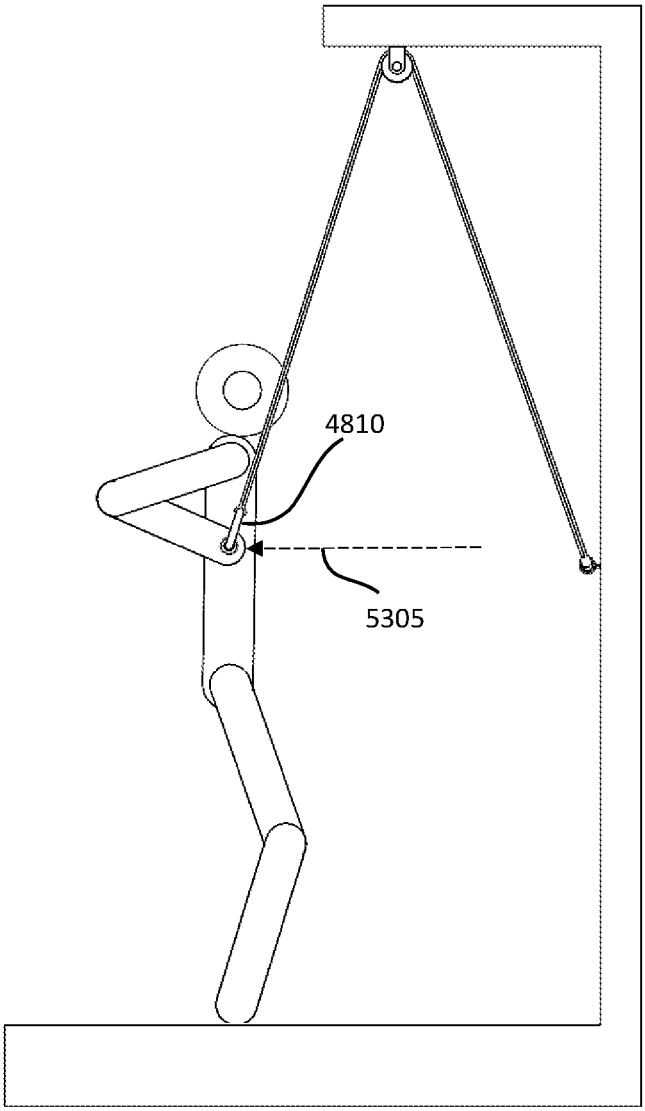
FIG. 70 is a side view of an embodiment of FIG. 66 with the user in a fifth position of the constant tension triceps exercise.

As shown in FIG. 69 to FIG. 70, the handle 4810 is then retracted to the original position and the cycle is repeated until the user's desired level of exhaustion or muscle failure.

In a combination exercise variation, the user may bend forward at the hips to engage the muscles of the lower back. In this case, the lower back and triceps can be exercised simultaneously. Furthermore, lowering the handles can provide additional assistance to the lower back against the effect of gravity, while raising the handles can reduce the assistance to the lower back. In this way the user can intuitively adjust the handle height toward the end of a set so the triceps and lower back can both reach a similar level of fatigue by the end of the set.

It is an objective of the present device to provide a simple and convenient way to attach and detach individual cord/pulley assemblies to and from the fixed pulley attachment members with a single-handed operation. Another objective of the present device is to allow simple and convenient single-handed operation of connection and disconnection of a handle with different combinations of two or more side-by-side cord/pulley assemblies to adjust the total cord strength acting on the handle. It is another objective of the device, to provide pulley attachment members which are flexible enough to allow a wide range of pulley angles so a pulley can self-align with the tension direction of the cord, and with minimal wear on the pulley carabiner and pulley attachment member. It is another objective of the device to provide a pulley attachment member with a low-profile securing means on the opposite side of the structural member it is attached to, to allow a low-profile form-factor of the assembly when it is stowed in an upright position against a wall. It is a further objective of the device to provide a modular elastic cord and pulley system that allows fast and convenient exchanging of various elastic cord strengths.

Figure 36:
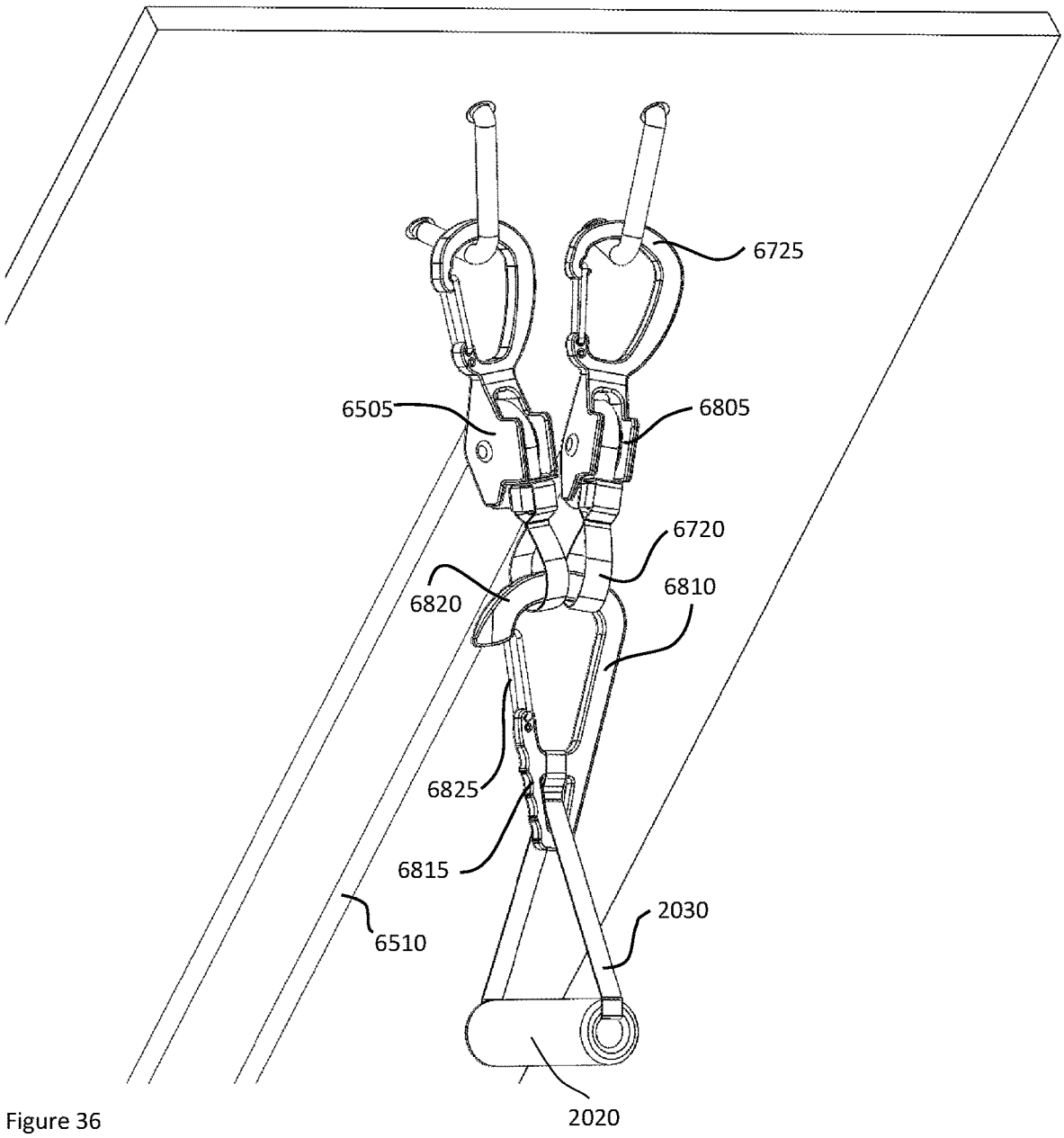
FIG. 36 is an isometric view of two pulleys each with its own cord, and a single handle connecting to both cords.

Shown in FIG. 33 is an exemplary non-limiting assembly which satisfies all of these objective as follows:

As shown in FIG. 36, a handle 2020 is assembled together with a latching hook 6810 (referred to here in a non-limiting way as a carabiner). The carabiner 6810 comprises a hook portion 6820, a latch mechanism 6825 to prevent unintended un-hooking, an integrated hand grip 6815 that projects below the bottom of the carabiner, and a handle 2020 and connecting strap 2030. The strap 2030 may be rigid or flexible and is shown here with a flexible strap.

The handle hook 6820 is hooked through a loop 6720 of flexible or rigid material that is connected to the end of the elastic cord 6510 after it passes through a pulley 6805. The termination of the elastic cord comprises a cord alignment means that fits into a pulley alignment feature that comprises an extension of the pulley housing and/or the pulley itself.

Figure 35:
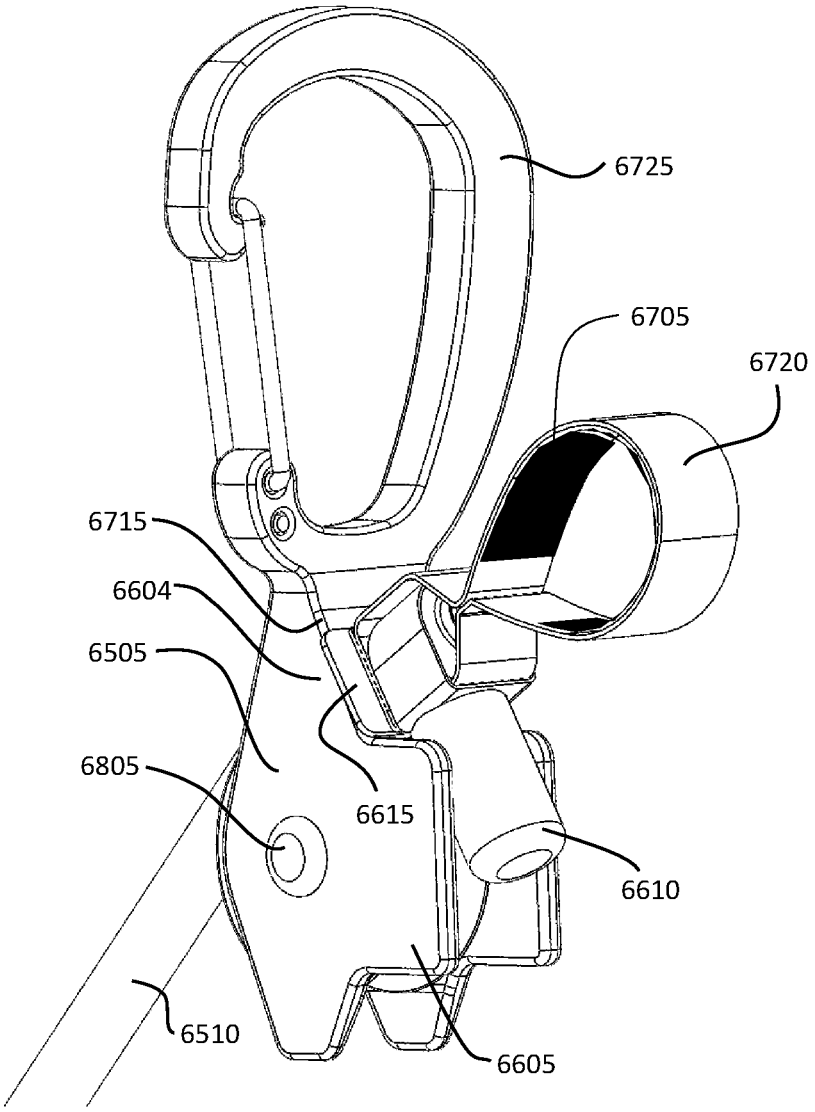
FIG. 35 is another closeup of the pulley of FIG. 34, with the handle removed from the cord to better show features of the cord.

It can be seen, in FIG. 35 and in FIG. 36, that the pulley housings 6505 also serve as a hand-graspable handle to allow the user to easily connect and disconnect a pulley/carabiner 6725 to and from the pulley attachment rope loop (or any other type of loop member) with a single hand.

A flat feature 6615 on the cord end may also be used as a stop to prevent the cord from further retraction into the pulley and to maintain a preferable alignment angle with the pulley housing.

As shown in FIG. 34 and FIG. 35 below, the end of the elastic cord 6510 may comprise a cord alignment means 6610 that fits into a pulley alignment feature 6605 that comprises an extension of the pulley housing 6505 and/or the pulley itself. A flat feature 6615 on the cord 6510 end may also be used as a stop to prevent the cord from further retraction into the pulley and to maintain a preferable alignment angle with the pulley housing 6505.

Cord-end alignment features are shown in FIG. 35 and preferably consist of one or more of the following:

Pulley frame protrusion 6605 on both axial ends of the pulley 6805 provide a location means on either side of an alignment protrusion 6610 which is secured to and oriented at an angle 90 degrees from the axis of the end of the elastic cord 6510. The protrusions can be at any angle and two are shown in this non-limiting exemplary embodiment. In FIG. 35 a first set 6605 are oriented with a resting position for the 6615 flat feature of the cord in the downward vertical position and a second set 6604 have a resting position for the flat feature 6615 of the cord oriented in the horizontal and slightly angled upward position. The user can decide which of these two positions to leave the flat feature 6615 of the cable end when hooking and un-hooking a handle carabiner 6810. A flat plate above the cord end, in this exemplary embodiment, provides a secure stop for the cord end against one of either of the two cord end stops. In FIG. 34 and FIG. 35, the cable ends are shown resting against a pulley frame protrusion which leaves the cable ends in the downward vertical position.

The pulley housing is rigidly attached to, or one piece with, a carabiner that is aligned with, as shown here, or at some other specified angle to the pulley axis so the pulley and carabiner will be at a consistent angle after attachment of the carabiner to the pulley attachment means on the fixed structure member. This enables ease of attaching and detaching the pulley from the fixed pulley attachment member by the user.

In the embodiment in FIG. 35, a stiffening member is sewn into the ID of the loop 6720 to maintain the shape of said loop 6720 to allow ease of hook insertion by the user. In this figure, the cord end is shown in an alternate seated position in a second landing 6715 on the pulley frame 6505.

Shown in FIG. 36 are two of the pulley assemblies 6805 side-by-side with both connected to a single handle/hook 6810. It can be seen here that the handle carabiner hook can easily be hooked onto the loops at the end of the cords with a single-handed operation. This is partly due to the large loop of webbing material (a rigid or flexible ring could be secured to the end of the cord with similar effect) and the fact that the loop on the end of the cord is consistently aligned by the alignment features which are detailed in FIG. 35. Ease of attachment with one hand of the handle hook to the cord-end loops is also partly a result of the downward extension 6815 of the handle carabiner that acts as a rigidly attached handle to the handle carabiner.

The fixed pulley attachment member is, in an embodiment, comprised of rope, such as, but not limited to, climbing rope to provide the desired range of flexibility with a quiet and esthetically pleasing appearance. The rope loop terminates at both ends in round bores in the fixed structure such as, but not limited to a ¾" thick plywood sheet of material. The bores are preferably tapered on the opposite side from the rope loop. During fabrication, a rope end is inserted into the flared bore and caused to expand by the insertion of a tapered plug made of a rigid material such as, but not limited to, plastic or aluminum. The tapered plug has a cap section that is larger than the flared opening of the hole to prevent the plug from pushing too far into the rope end. The plug also has a blind bore in the top of the plug and an array of through-holes in the blind bore that allow an epoxy applicator nozzle to be inserted into the plug. The nozzle is used to pump a metered volume of hardening compound such as quick-set epoxy into the blind bore and through the through-holes. The epoxy infiltrates the flared rope end and may flow out from under the top of the plug cap. When the epoxy hardens, it forms a rigid epoxy/rope fiber/tapered plug material composite plug that provides a secure, low profile and low-cost mounting means for the rope end in the fixed structure.

Figure 37:
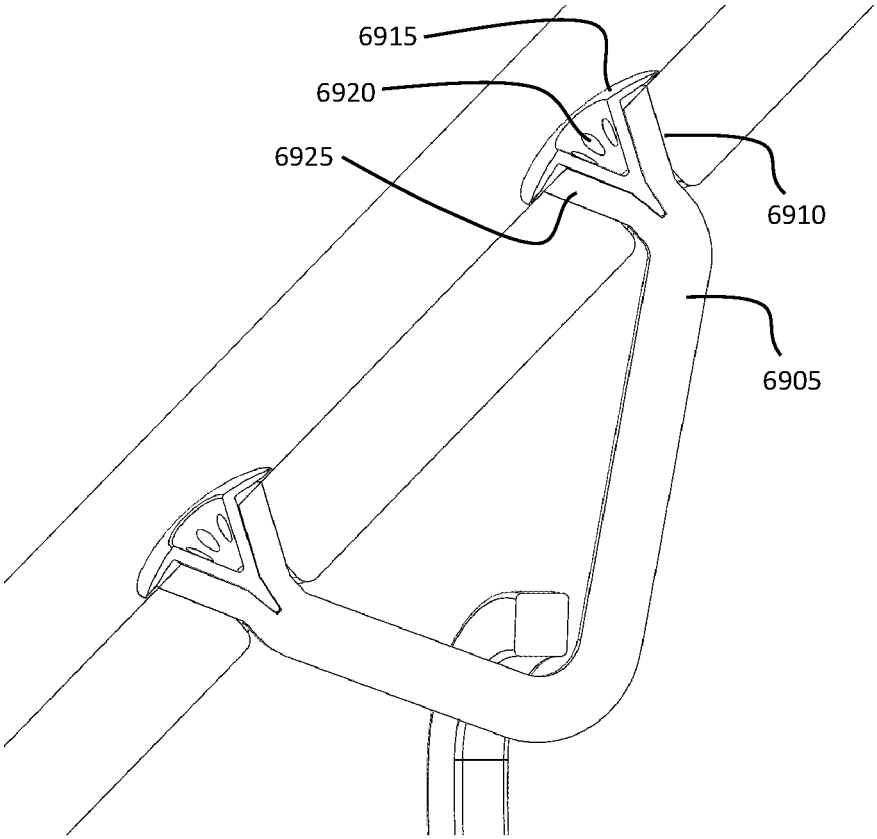
FIG. 37 is an isometric view of a rope loop anchored to a structure to receive a pulley.

A rope loop 6905 is shown in FIG. 37, inserted from the loop side through the small ends of two tapered bores 6910 in the fixed structure. Plugs 6915 having a central blind bore and an array of through holes 6920 are inserted into the rope ends 6925.

Figure 38:
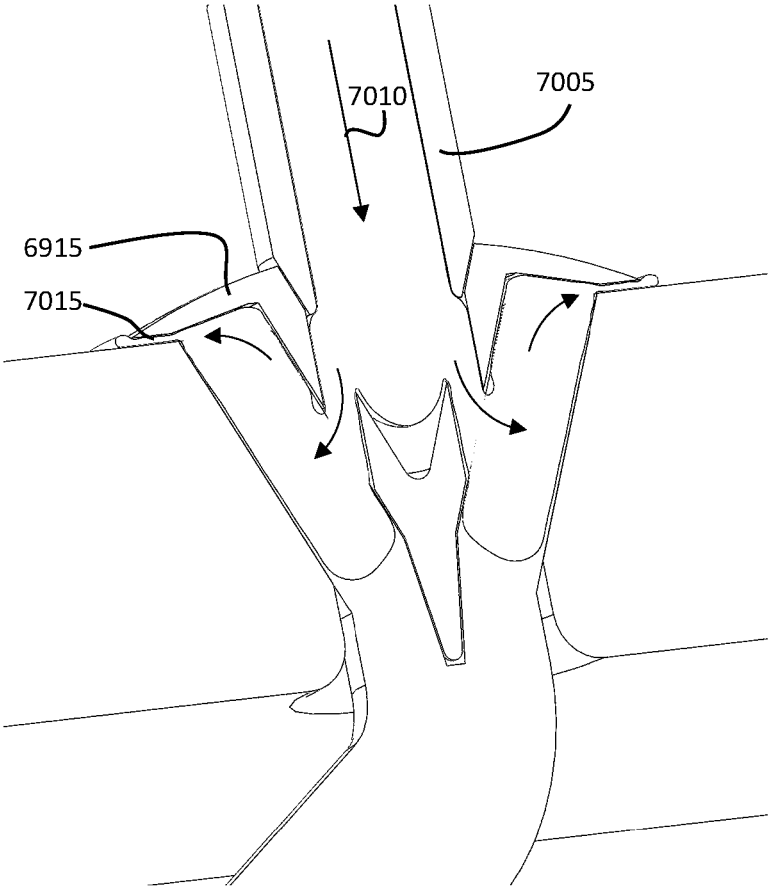
FIG. 38 is a closeup of an applicator supplying epoxy to an end of the rope loop of FIG. 37.

As shown here in FIG. 38, an applicator nozzle 7005 is inserted into the plug 6915 and quick set epoxy is injected into the plug, the flow of the epoxy shown by arrows 7010. The epoxy infiltrates the flared end of the rope 6925 and fills the void 7015 under the plug 6915. This void 7015 serves as an overflow chamber to ensure that more than enough epoxy is inserted into the rope end. After the epoxy is injected, the applicator nozzle 7005 is removed. When the epoxy hardens, it forms a solid tapered stop to prevent the rope from being pulled through the tapered bore.

Figure 39:
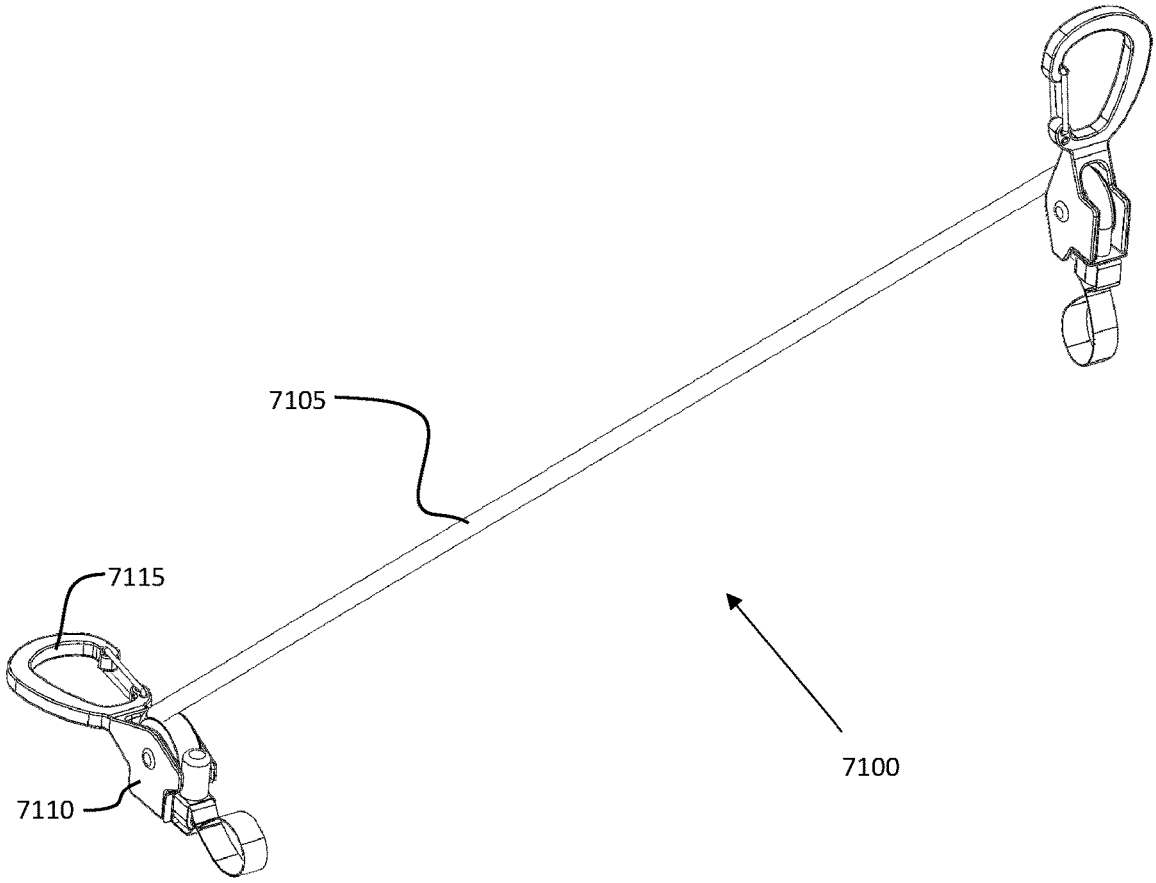
FIG. 39 is an isometric view of a preassembled assembly comprising a cord and two pulleys carrying the cord.

Shown in FIG. 39 is an assembly 7100 comprising an elastic cord 7105, pulleys 7110 at either end of the elastic cord, the pulleys each having a housing which are connected to attachment mechanisms such as hook 7115 that provides a convenient way to attach and detach different strengths of elastic cords. Prior art elastic cord and pulley systems are known that use pulleys and elastics in different configurations. It is common to these systems to have multiple cords side-by-side and a handle that can attach to one or more of them depending on how much tension the user wants to use. It is also common for these pulleys to be semi-permanently attached to the device such that switching cords is not as convenient as would be desired.

The inventors of the present device have found that methods of using the present device benefit greatly from fine-tuning the total elastic cord strength by switching one or more cords between or even during an exercise. One aspect of this is to have the ability to attach 4 or more cords side-by-side. Embodiments of the present device allow very fast attaching and detaching of the cord assemblies by including one or two pulleys that are pre-attached to each cord, and integrating a quick-attaching hook to each pulley so the user can detach a pulley from the pulley attachment member quickly and conveniently with one hand. By including two pulleys with the cord assembly with each of a range of elastic cords of various strengths (and possibly different lengths) and by combining a pulley and hook such as but not limited to a carabiner, to each pulley, it reduces the time and effort needed for a user to switch the cords.

By including the pulleys in the assembly of a cord that would be purchased by the user, the user can very quickly and with one hand, change the cords by unclipping the carabiner (that is fixed to the pulley housing) to and from the fixed pulley attachment loops. By contrast, if the cord assembly does not comprise pulleys at one or both ends, the user must thread the cord ends through a pulley that is fixed to the fixed structure using both of their hands. This is considered, by the inventors to be an inconvenient and time-consuming step that would detract from the simplicity of using and adjusting the device. Exercising of any type can take a lot of motivation. Aspects of this device and methods of using it reduce the level of motivation required by the user. The fast and convenient attachment and detachment of the cord assemblies as disclosed here, is, therefore, an important feature of the device to contribute to an overall workout experience that requires the least possible motivation to achieve an increased level of fitness and strength.

Figure 71:
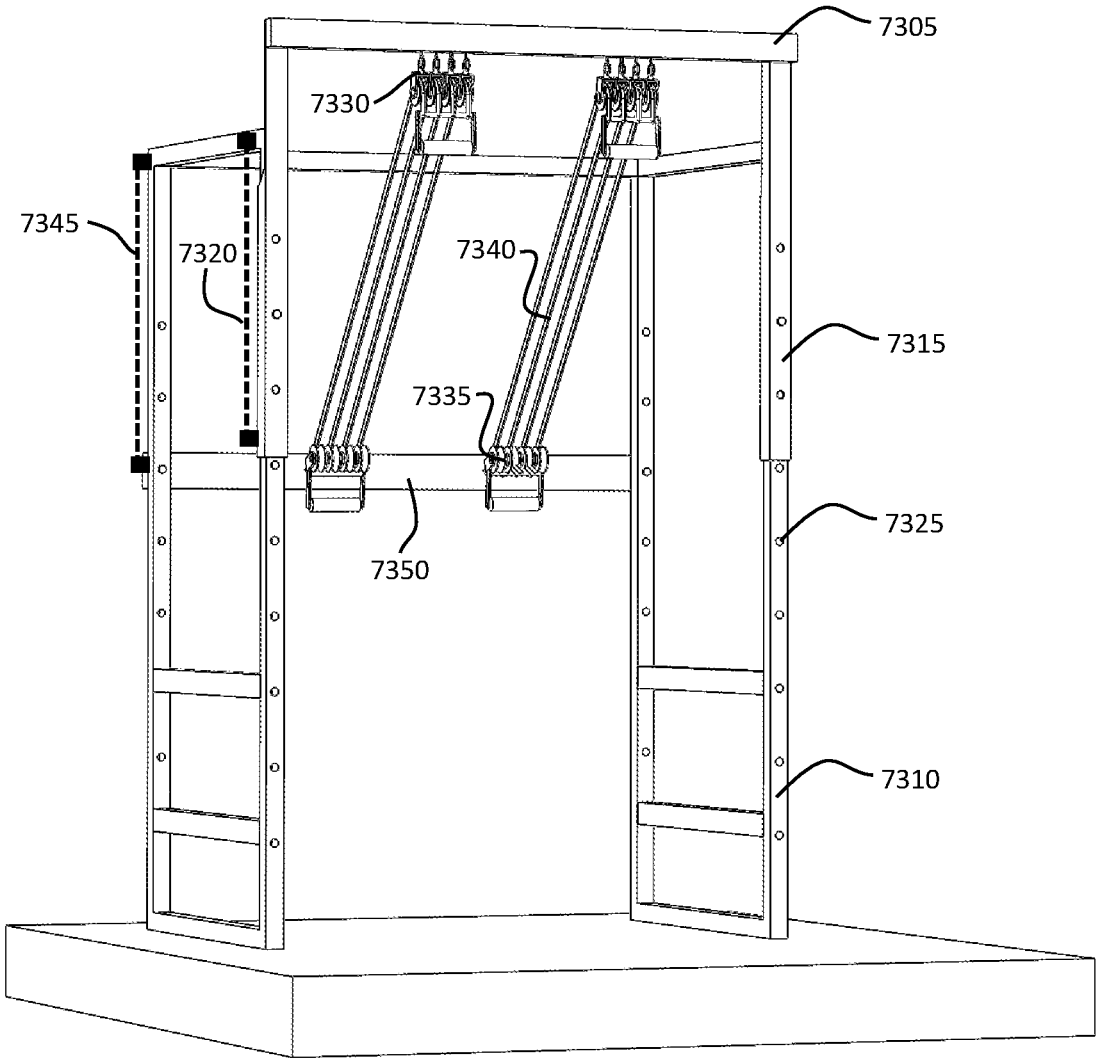
FIG. 71 is an isometric view of an embodiment of an exercise apparatus with an attachment having mounting points for overhead pulleys and designed to attach to a conventional squat rack.

Shown in FIG. 71 is a non-limiting exemplary embodiment of the present device with a simple attachment 7305 having mounting points for overhead pulleys 7330 and designed to attach to a conventional squat rack 7310 such which is commonly featured in weight gyms. As shown here, vertically sliding members 7315 comprise tubular structures, in this non-limiting embodiment they are shown as rectangular tubes, which completely or partially surround the existing squat rack tubes 7310 with enough internal telescoping clearance to allow vertical sliding of the sliding members by a user. Springs 7320, shown schematically in FIG. 71 may be used to support all or part of the mass of the sliding structure to reduce the mass which the user must lift during adjustment. The sliding members 7310 can make use of the holes 7325 in the rack and pins for height adjustment, including heights for the overhead pulleys above the height of the original squat rack as shown here. Other features for adjustment to fit a range of squat rack sizes are possible and anticipated by the inventors. A forward-mounted pulley attachment member 7335 may make use of an existing cross member 7350 on the squat rack, or it may be an additional member that is preferably easily adjustable vertically to provide a small amount of pre-tension in the elastic cords 7340 when the overhead-mounted pulley attachment member is adjusted and fixed in different vertical positions. This member may also be supported by a spring 7345 mounted to the squat rack frame 7310 as shown here schematically.

Figure 72:
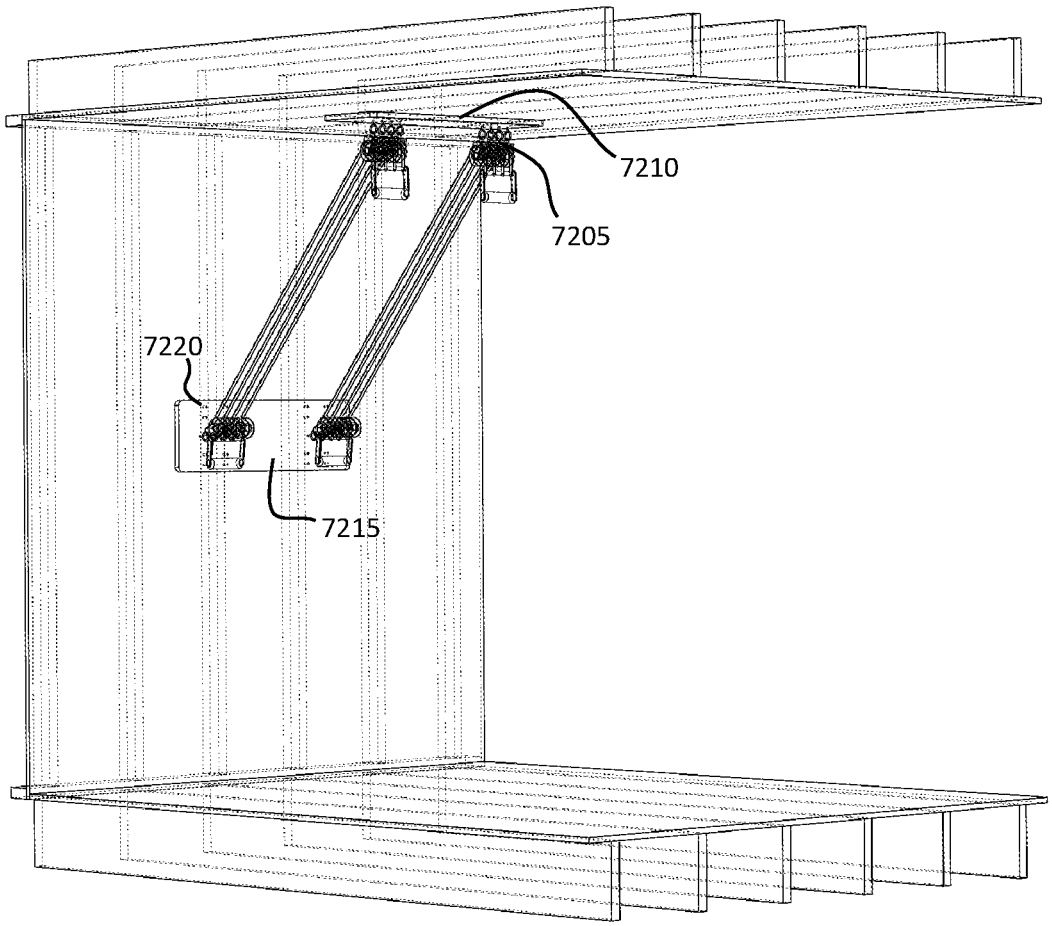
FIG. 72 is an isometric view of an embodiment of an exercise apparatus with pulley and elastic cord assemblies fixed to an overhead-mounted plate on a ceiling and a forward mounted plate on an adjacent wall.

Shown in FIG. 72 is a simple construction of the present device which consists of the pulley and elastic cord assemblies 7205 fixed to an overhead-mounted plate 7210 on a ceiling and a forward mounted plate 7215 on an adjacent wall. Predrilled holes 7220 (or marks to tell an installer where to drill holes) in the plates may be at, for example, 16" apart and 24" apart for north American homes to provide for easy attachment to wall and ceiling beams that are commonly at one of these widths. Other pre-drilled hole spacing may be used for other regions with different building codes. This embodiment of the device has the advantages of being lower cost and lighter weight and smaller to lower the cost of shipping.

In an embodiment shown in FIG. 18, additional fixed pulley attachment members 7405 are provided below (and possibly above, although not shown) the primary fixed pulley attachment members 7410. The primary fixed pulley attachment members 7410 are at a position that preloads the elastic cords 7515 by between 5% and 10% (although greater or lesser preloads can be used as well).

One or more alternate pulley attachment members may be provided for each pulley/cord assembly 7505. The alternate attachment point may be above the lower pulley attachments or below them as shown here. The benefit of these alternate attachments is to allow fine tuning of the elastic cord initial tension and force on the handle initially and through the range of motion of the handle.

Figure 19:
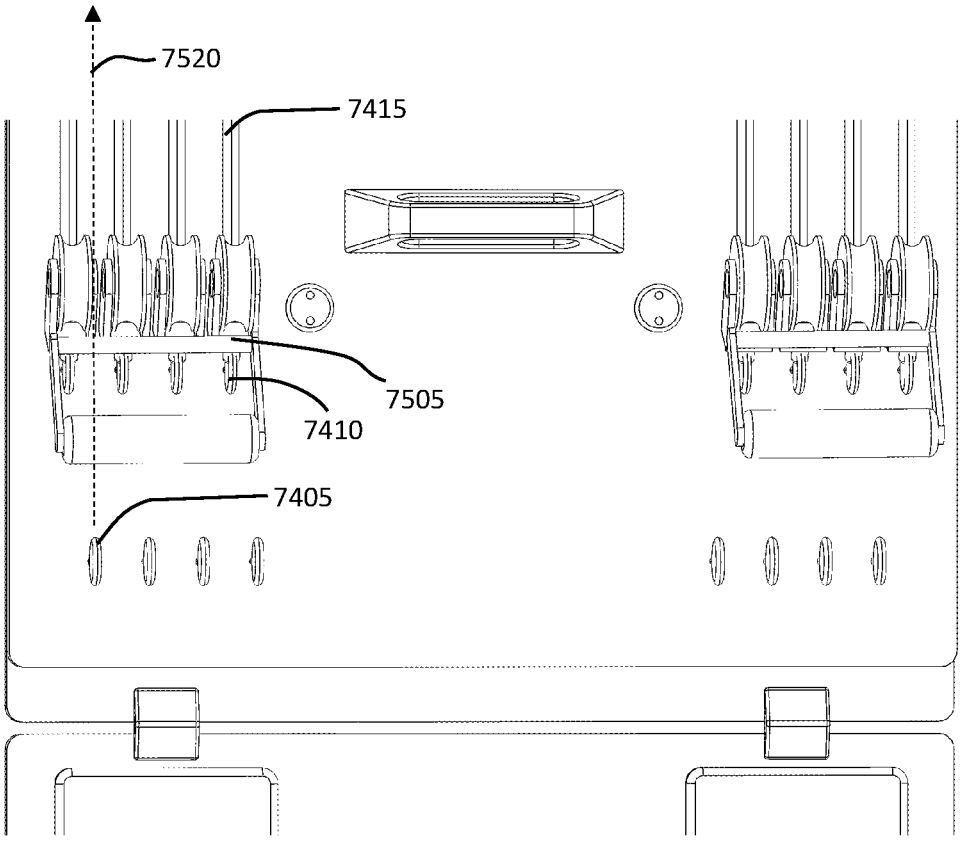
FIG. 19 is a front closeup view of the multiple forward pulley mounting locations of the embodiment of FIG. 18.

As shown in FIG. 19, the additional fixed pulley attachment members 7405 (which are shown as rigid eye bolts, here, but may be of many different types such as the rope loops shown in FIG. 37) are preferably offset, positioned between the primary attachment members 7410 above them so when a cord-pulley assembly 7505 is attached to a lower member, the cord 7415 will pass between two of the primary attachment members 7410 above it (as shown by the dashed arrow line 7520) without contacting the primary attachment member 7410 or a pulley assembly 7505 attached to them.

Figure 18:
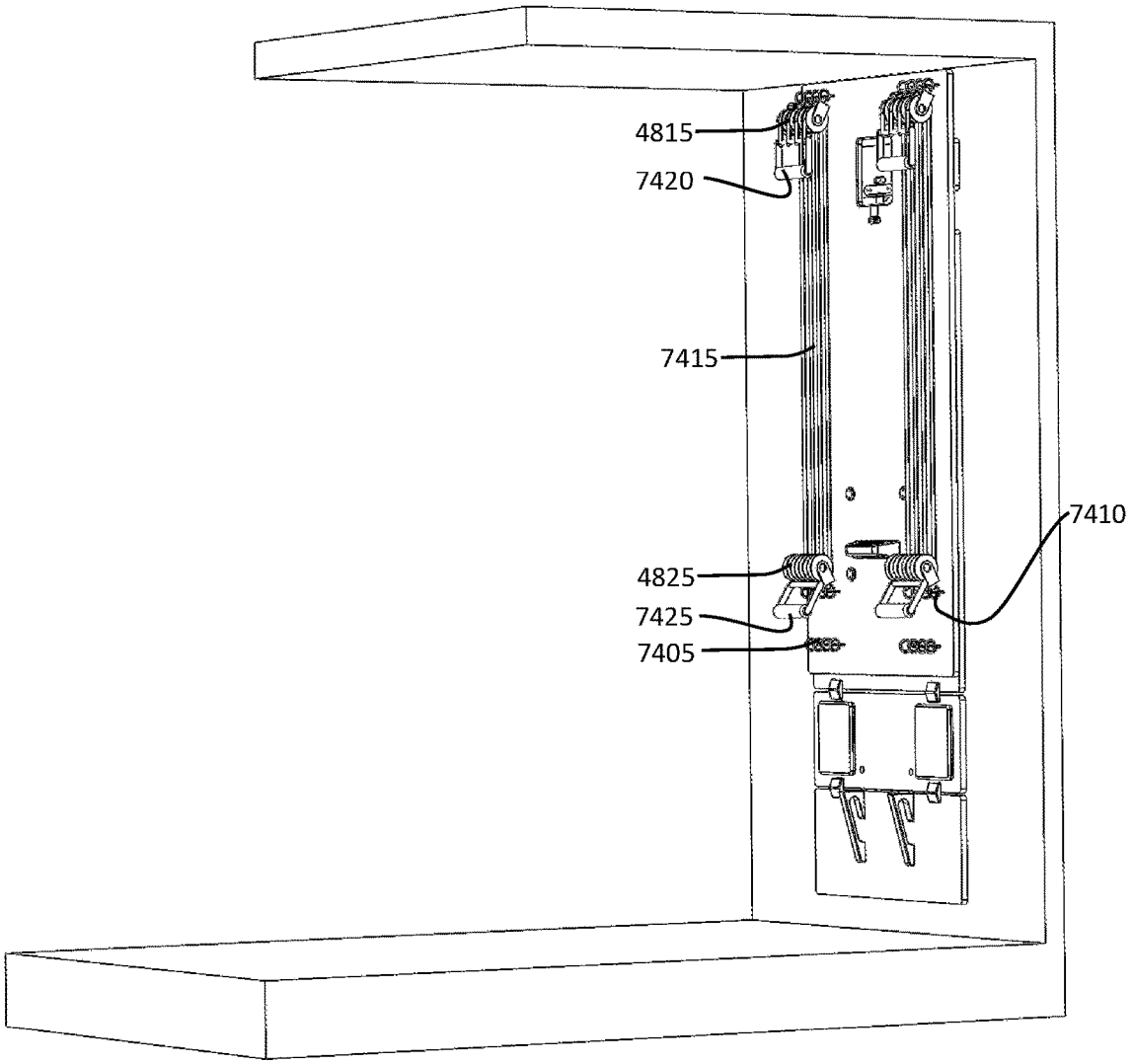
FIG. 18 is an isometric view of a stowable embodiment of an exercise apparatus having multiple forward pulley mounting locations, and shown in stowed position.
Figure 73:
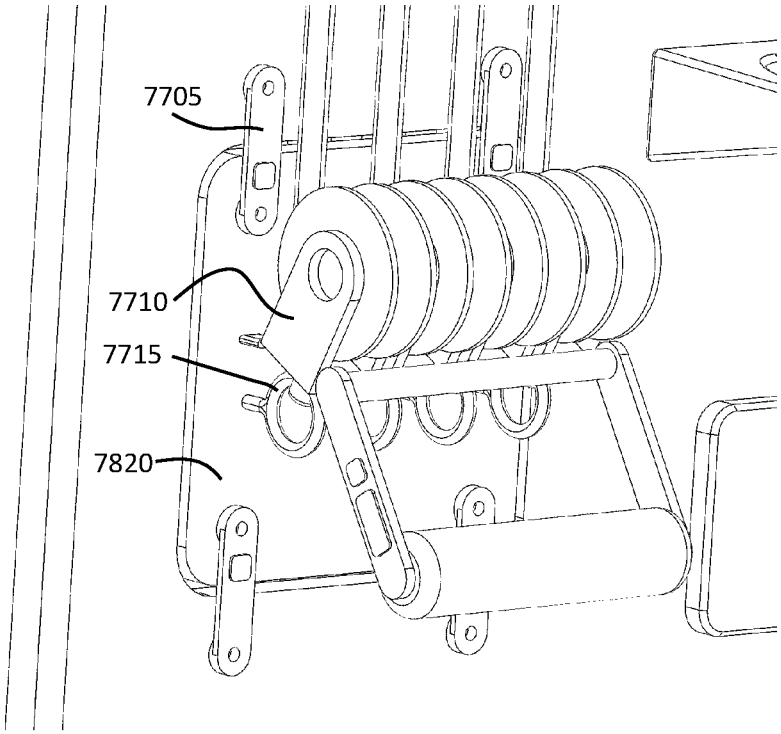
FIG. 73 is an close-up isometric view of an embodiment of FIG. 18 showing integrated load cells on a lower pulley fixed mounting area.

Shown in FIG. 73 is an embodiment of the device with integrated load cells 7705 on the lower pulley 7710 fixed mounting area 7715 of an exercise apparatus, such as the one shown in FIG. 18. Load cells could also be used in the upper pulley mounting areas or on the lower pulley fixed mounting areas. Alternatively, load cells could be used exclusively on the upper pulley mounting areas. It is shown that the lower fixed pulley attachment members are fixed to a plate that is fixed to the linear sliding member (it is understood that this pivoting/sliding structure is used as a non-limiting example and that many different structures may be used within the disclosure of the device). The plate is fixed to the main structure with preferably 4 bridges (but other numbers of bridges can be used as well). Each bridge is rigid but sufficiently flexible so a load cell (or other force sensor) mounted to the bridge will provide an input to the CPU when the load on the plate changes due to the user lengthening the elastic cords. The CPU will be programmed to determine the direction and magnitude of the force that is being exerted on them.

Together with the strength of cord in each of the pulleys (as determined by RFID tags on at least one pulley on each cord and a reader on at least one of the upper or lower fix pulley attachment members) the CPU will be able to determine the force applied by the user to the handle that is attached to those cords.

Alternatively, or in addition, a load cell or another force sensing device can be located directly on the handles with force data transmitted to the CPU through a wireless sender in or about the handle.

Alternatively, or in addition to one or both of the above, the handle can comprise a position sensor or reflector, etc. that can measure the distance of the handle from the pulleys, or a sensor combination that can determine the position of the handle in 3D or 2D space. This information can then be use by the CPU to determine the load on the handles without the use of a load cell because the distance of the handle from the pulleys it is being pulled through will correspond with a predetermined, known load on the cords that are attached to, based on the spring rate of each cord (which the CPU will know from the RFID tag on each cord/pulley assembly)

Figure 74:
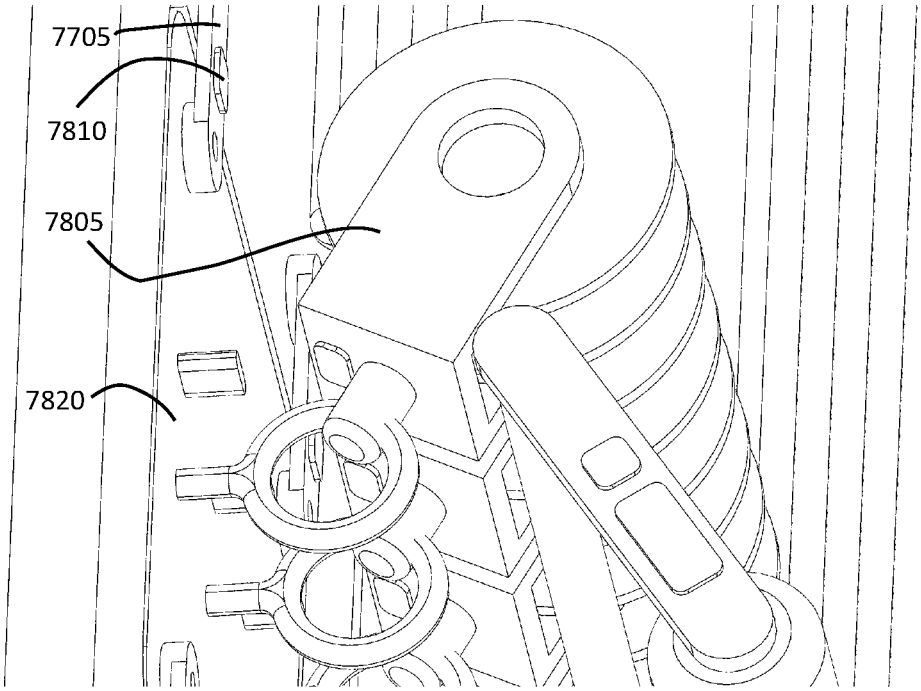
FIG. 74 is another isometric view of an embodiment of FIG. 73 showing RFID tags located on individual pulleys and RFID readers located on a main structure.

Shown in FIG. 74 is a close-up showing RFID tags located on the individual pulleys 7805 and RFID readers 7810 located on the main structure, which in this case comprises the floating plate 7820 that is mounted to the main structure with load cell bridges 7705.

Figure 75:
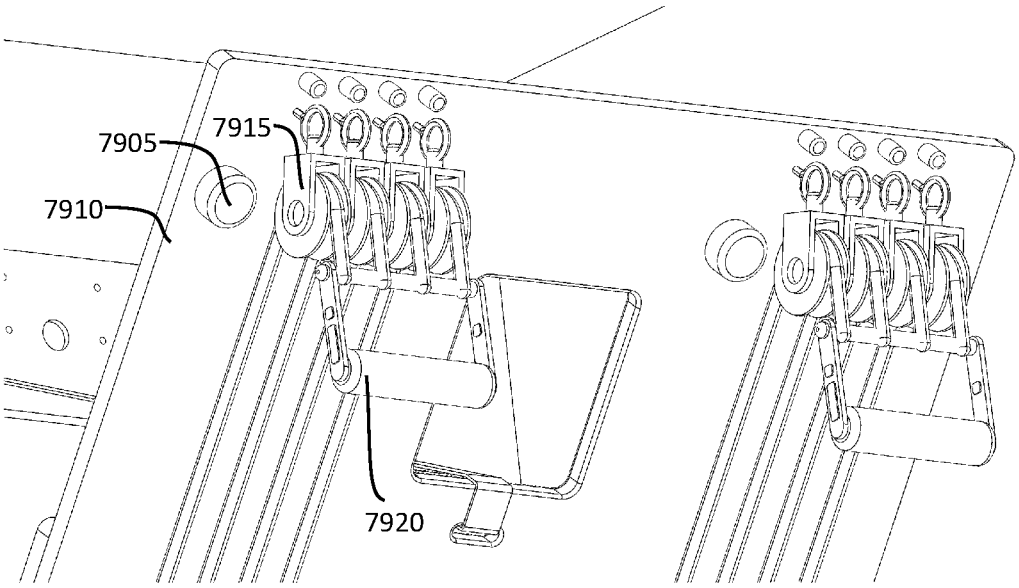
FIG. 75 is a partial isometric view of an embodiment of an exercise apparatus with a distance measuring sensor attached to a main structure near pulleys.

Shown in FIG. 75 as a non-limiting example is a distance measuring sensor 7905 such as but not limited to, an ultrasound/Bluetooth sensor/receiver attached to the main structure 7910 near the pulleys 7915 for that handle 7920. An ultrasound transmitter and electromagnetic or infrared transmitter is attached to a handle. Other combinations of transmitters and receivers can be used, as long as two of them emit a signal that have two different times of flight. The ultrasound emitter sends a pulse of ultrasound and at the same time, the EM transmitter sends a signal. The dual receiver receives both signals and determines, from the delay in the two signals reaching it, what the distance of the two sender units is from the receiver. In other words, the time of flight for the EM or infrared transmitter may be assumed to be instantaneous and then the time it takes for the ultrasound pulse to reach the receiver will be used to determine the distance of the handle from the receiver. The pulses can be sent at a high enough frequency to provide the CPU with position data at a high enough resolution to be useful, and at a frequency as low as possible to use lower power.

Alternatively, the pulleys may comprise a simple rotary encoder that sends a wireless signal to the CPU about the number of rotations. This will have a margin of error but if the counter resets every time the elastic cord is completely or nearly retracted, the variation is considered by the inventors to be acceptable for the application. The number of revolutions of the pulley for a given elastic cord strength can be determined through empirical testing.

Figure 76:
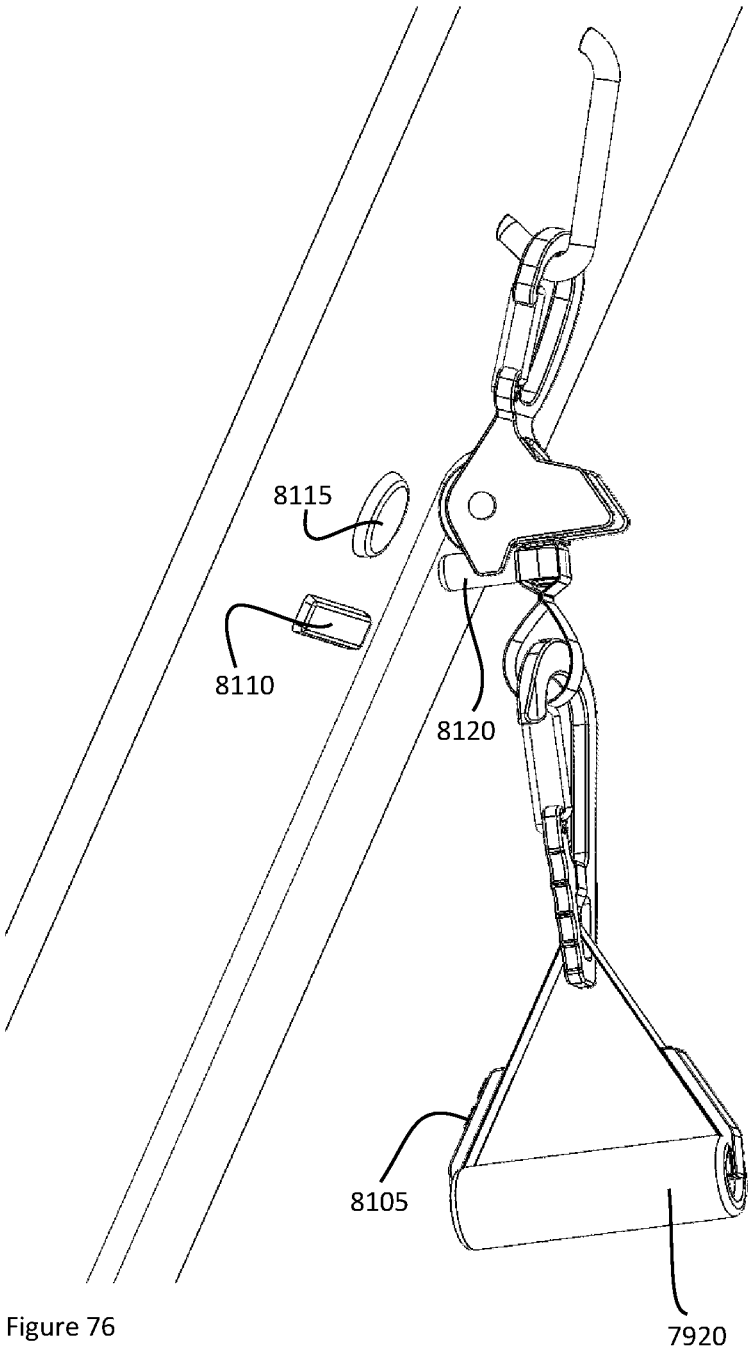
FIG. 76 is a partial isometric view of an embodiment of an exercise apparatus with a distance measuring sensor attached to a main structure near pulleys.

An embodiment of the device shown in FIG. 76 uses this combination of ultrasound and EM or IR senders on the handle 7920, as described above, along with a dual receiver 8110 near the pulleys for that handle (IE: the upper handles have receivers near the upper pulleys and the lower handles have receivers near the lower pulleys) will allow the CPU to determine (based on lookup tables or algorithm) what the tension is on the handle, but only if the user has connected the pulleys to the handles as determined by the app (because the app will inform the CPU of what cords are attached to the handle. But because there is a human in the loop, so to speak, the user may choose to attach a different combination of cords to the handle than the app suggests. In this case, the CPU may incorrectly calculate the force on the handles because it will assume that different cords are attached to the handles than are actually attached to it.

To eliminate this possibility, the following configuration provides the CPU and app with the following information: 1) Which cords are attached to the fixed pulley attachment members, 2) Which cords are attached to the handles.

The CPU and/or app is able to determine the following: 1) Real-time tension on the handles (Based on the spring rate of each cord attached to the handle combined with the distance of the handle from the docked position), 2) 1-dimensional position of the handles which is considered, by the inventors, to be adequate for determining the work, power, and other important metrics for tracking exercise with the device.

It does this with a minimum number of sensors which include: A) An ultrasound transmitter (or other relatively slow time of flight transmitter on a handle), B) An EM or IR transmitter (or other relatively fast time of flight transmitter on the same handle), C) An RFID tag 8120 on the end of the cord which is close enough to an RFID reader 8115 on the main structure near the pulley attachment members that the RFID can be read and identified when the handle is "docked" but is not readable (or detectable when the handle is not docked) when the handle is pulled away from the docked position by the user. In this way, the CPU and app will know which cords are mounted to the main structure because the RFID tags are close enough to the readers to register when they are docked. When the handle is pulled away from the docked position, the CPU will know that the handle is moving from the distance sensors, and it will also know which of the cords is not attached to the handle because the RFID reader for that cord will still register the RFID tag as being within range.

A close-up view of the above embodiment of sensors for the device is shown in FIG. 76. It is understood that the transmitters could be on the structure and the receivers could be on or near the handles.

In a non-limiting embodiment, a position-tracking indicator is worn on the user and may be used in combination with sensors on the structure of the device to determine the user's position. In a non-limiting example, the indicator is a reflective pendant worn around the neck of the user and used in combination with a camera or triangulating light sensor system. As the user moves from a squat to a standing position, the pendant would move along with the user's upper body. Similarly, the pendant would move along with the user's body during a sit-up motion. The indicator may alternatively be additionally affixed to an article of the user's clothing, such as to their shirt via a clip, mild adhesive, magnetic clip, Velcro, or other suitable means. The device may track the position of the top of the user's torso and may use the location of the person's torso to infer and track the orientation of the user's body during exercises. The indicator may also be used to estimate the location of the user's center of gravity. If the user is performing a known exercise, it may be possible to accurately track the user's movements with only one reflector on their person. However, additional indicators, for example located on their feet and or ankles, waist, and or head may be used for greater accuracy. By combining the extension of known elastic cords with body position of the user for a known exercise, these combination of sensor inputs would allow the app to estimate the amount of effort the user is exerting. For example, the device could track the user's progress through an exercise motion, caloric expenditure throughout an exercise, and level of muscle strain during an exercise.

In an embodiment, an app is provided with the device. Features of an example version of the app are as follows: When the user first uses the app, they will enter the following in a GUI INITIAL USER SETUP
- ENTER MASS
- ENTER HEIGHT
- CHOOSE FITNESS LEVEL FROM LIST ["I" INDICATES MORE INFO AVAILABLE TO HELP WITH THIS SELECTION]
- CHOOSE FITNESS GOALS FROM LIST [I]
- CHOOSE THE COLORS OF ELASTIC CORDS, FROM LIST, THAT USER HAS AVAILABLE
- ENTER SPECIAL NEEDS/DISABILITIES SUCH AS WHEELCHAIR OR PREFER SITTING TO STANDING
- CHOOSE WORKOUT PREFERENCES
  - a. TIME PER WORKOUT [i]
  - b. NUMBER OF WORKOUT SESSIONS PER WEEK [i]
  - c. NUMBER OF WORKOUTS PER MUSCLE PER WEEK [i]
- WHEN THE ABOVE INFO IS ENTERED, A WORKOUT PLAN IS PROPOSED BY THE APP
  - a. USER REVIEWS AND MODIFIES WORKOUT PLAN, IF DESIRED
    - i. AS THE USER MODIFIES ANY OF THE EXERCISES OR NUMBER OF SETS OR NUMBER OF REPS:
      - 1. THE APP DETERMINES, FROM A PRE-DETERMINED MATRIX, WHAT OTHER FACTORS WILL BE AFFECTED
        - a. USER HAS THE OPTION TO "FIX" CERTAIN VARIABLES SUCH AS TIME PER WORKOUT OR DESIRED REPS ETC. THE APP WILL THEN MAKE ADJUSTMENTS WITHIN THESE CONSTRAINTS AND PRESENT ERROR MESSAGES (WITH EXPLANATIONS) IF IT IS NOT POSSIBLE TO CREATE AN OPTIMAL PROGRAM WITH ALL OF THOSE LIMITATIONS The user then picks which "Day" they wish to start on and begin their personalized program

---

NON-LIMITING EXAMPLE OF APP INTERFACE INCLUDING USER INSTRUCTIONS AND APP CONTROL OF VARIABLES FOR A 6 DAY ON/1 DAY OFF PROGRAM FOR A 6 FT TALL ABLE-BODIED PERSON OF AVERAGE FITNESS WEIGHING 80 KG. FITNESS GOALS IN THIS EXAMPLE ARE HYPERTROPHY AND INCREASED CARDIO. EACH MUSCLE GROUP EXERCISED ONCE PER WEEK. ALL COLORS OF ELASTIC CORDS ARE AVAILABLE.

DAY 1 - Chin-up/Squats

OPTION TO WATCH:

a. EXPLANATION VIDEO
b. SCROLL THROUGH STILL PICTURES
c. SCROLL THROUGH ANIMATED IMAGES
    i. ARROWS AND LABEL ON SCREEN INDICATE THAT USER CAN SWIPE UP OR DOWN INSIDE IMAGE FRAME (SUCH AS ALONG THE SIDE OF IMAGE FRAME, OR ANYWHERE INSIDE FRAME) TO SHOW THE EXERCISE MOTION OF ANIMATED CHARACTER FROM START TO FINISH OF ONE REP OF THE EXERCISE
    ii. USER CAN SWIPE FROM SIDE TO SIDE (SUCH AS ALONG BOTTOM OF FRAME, OR ANYWHERE ON THE FRAME) TO SPIN ANIMATED SCENE ABOUT A VERTICAL AXIS FOR BETTER VISUALIZATION
    iii. USER CAN SWIPE UP/DOWN AND SIDE/SIDE INDIVIDUALLY OR DIAGONALLY FOR BOTH EFFECTS AT THE SAME TIME. THIS WILL CREATE AN INTERACTIVE EXPERIENCE THAT ALLOWS THE USER TO FULLY VISUALIZE THE MOTION AND TO FEEL LIKE THEY HAVE THEIR OWN PERSONAL VIRTUAL ASSISTANT
    iv. ANIMATED FIGURE PREFERABLY HAS VISIBLE MUSCLE GROUPS THAT ARE COLOR CODED TO SHOW WHICH UPPER ANDF LOWER BODY MUSCLES ARE RECRUITED SIMULTANEOUSLY DURING THE EXERCISE
    v. SELF-ASSIST OPTIONS WILL BE SEPARATE ANIMATIONS THAT SHOW A USER HOW TO USE A VARIATION OF THE BASIC MOTION TO ALLOW THE UPPER BODY TO PROVIDE MORE ASSISTANCE TO THE LOWER BODY

CLICK START a. APP DETERMINES, AND VISUALLY DISPLAYS ON APP SCREEN, THE CORD COLORS AND PREFERRED ORDER FROM LEFT TO RIGHT FOR CORDS ON MACHINE FOR THAT USER AND THE PARTICULAR EXERCISE.
    i. WIRELESS COMMUNICATION TO DEVICE CPU FROM PHONE OR TABLET ETC, INSTRUCTS CPU TO ENERGIZE LED COLORS AT EACH UPPER AND/OR LOWER FIXED PULLEY ATTACHMENT MEMBER TO MATCH VISUAL DISPLAY OF RECOMMENDED CORD COLORS ON APP.
b. USER CHOOSES TO ACCEPT OR FINE-TUNE PROPOSED CORD COLOR COMBINATION
    i. IF THE USER CHOOSES TO FINE-TUNE THE CORD COMBINATION, THE USER CAN SLIDE A SLIDER OR SPIN A SLIDER DIAL ON THE APP TO INCREASE OR DECREASE THE TOTAL TENSION OF THE CORDS. THIS FEATURE IS AVAILABLE AT ALL TIMES SO USER CAN FINE TUNE EACH EXERCISE AT ANY TIME BEFORE, DURING OR AFTER THE EXERCISE. FINE-TUNING WILL CONSIST OF THE APP INCREMENTALLY INCREASING OR DECREASING THE TOTAL STRENGTH OF THE CORD COMBINATIONS ACTING ON THE HANDLES
        1. IT WILL BE UP TO THE USER (OR AN ASSISTANT) TO CHANGE THE ELASTIC CORDS. CALCULATION OF THE COLORS OF CORDS THAT SHOULD BE ATTACHED TO THE MACHINE AND TO THE HANDLE IS DETERMINED BY THE APP.
        2. IN SOME CASES, SUCH AS TO REDUCE THE TOTAL TENSION, THE APP WILL LEAVE THE COLORS OF CORDS THE SAME AND SHOW A LOWER NUMBER (FOR EXAMPLE THREE INSTEAD OF ALL FOUR) CORDS CONNECTED TO THE HANDLES. AN LED "X" OR COLOR SUCH AS RED COULD BE USED TO SHOW THAT ONE OR MORE CORDS ARE NOT TO BE ATTACHED TO THE HANDLES. OR THE UNUSED CORD LED'S WILL SIMPLY NOT BE LIT.
        3. IN OTHER CASES, THE APP WILL REQUIRE ONE OR MORE OF THE CORDS TO BE SWITCHED OUT ON THE DEVICE WITH A DIFFERENT COLOR CORD.

4. THE APP ALGORITHM WILL DETERMINE AN INITIAL STARTING COLOR COMBINATION THAT WILL ATTEMPT TO REDUCE THE NUMBER OF ANTICIPATED CORD CHANGES FOR A TYPICAL ADJUSTMENT THAT WOULD BE TYPICAL FOR COMPLETION OF ALL THE SETS FOR THE EXERCISE. IN OTHER WORDS, INSTEAD OF SWITCHING CORDS ON THE DEVICE (REFERRED TO HERE AS DEVICE CORD COMBINATION CHANGES) PART WAY THROUGH THE EXERCISE, THE APP ALGORITHM WILL ATTEMPT TO MAKE ALL CHANGES WITH DIFFERENT COMBINATIONS OF CORD COLORS THAT IT ORIGINALLY RECOMMENDS SO THE USER ONLY NEEDS TO SWITCH WHICH OF THE EXISTING CORDS ARE ATTACHED TO THE HANDLES (REFERRED TO HERE AS HANDLE CORD COMBINATION CHANGES)
   a. ONE STRATEGY FOR REDUCING DEVICE CORD CHANGES IS FOR THE APP TO RECOMMEND FOUR SPECIFIC CORD COLORS BE ATTACHED TO THE DEVICE, AND TO INITIALLY USE ONLY TWO OR THREE OF THEM. THIS WAY THE USER CAN INCREASE OR DECREASE THE TOTAL CORD STRENGTH (ON THEIR OWN OR WITH THE RECOMMENDATION OF THE APP) BY ATTACHING THE HANDLE TO THE UNUSED CORD/S OR REDUCE THE TOTAL CORD STRENGTH ON A HANDLE BY REMOVING ONE OR TWO CORDS FROM A HANDLE.
5. USERS ARE FREE TO MAKE ANY CHANGES THEY WANT OUTSIDE OF THE APP RECOMMENDATIONS WITHOUT CONSULTING OR ENTERING ANYTHING INTO THE APP. IN THIS CASE, THE WIRELESS SENDER ON THE DEVICE WILL DETERMINE (SUCH AS BY READING A UNIQUE RFID ON A PULLEY HOUSING OF EACH CORD) THAT A DIFFERENT CORD IS BEING USED.
   a. IN THIS CASE, THE APP WILL ASK IF THIS IS THE USER'S INTENT AND IF THE USER CLICKS YES, THEN THE APP WILL ACCEPT THIS CHANGE AND ADAPT FROM THERE. OR IF THE USER MAKES A CHANGE AND THEN USES IT FOR A SET, THE APP WILL ASSUME THEY INTENDED TO MAKE THIS CHANGE AND WILL STORE THIS AS THE LAST COMBINATION THEY USED FOR THIS EXERCISE.
      i. STORING OF THE LAST CORD COMBINATIONS IS AN IMPORTANT FUNCTION OF THE APP BECAUSE IT WILL ALLOW THE APP TO RECOMMEND THE SAME CORD COMBINATION NEXT TIME THE USER DOES THE SAME EXERCISE SO THE USER DOESN'T HAVE TO REMEMBER THIS INFORMATION.
      ii. THE APP CAN ALSO TRACK THE USER'S PROGRESS AS THE GRADUALLY INCREASE THE CORD STRENGTH OR NUMBER OF REPS ETC TO KEEP TRACK OF FITNESS PROGRESSION AND TO RECOMMEND NEW SETTINGS OR EXERCISES.

THE APP WILL ALSO KEEP TRACK OF THE DATA, SUCH AS BUT NOT LIMITED TO, THE FOLLOWING FROM EACH EXERCISE SESSION SO IT CAN TRACK A NUMBER OF IMPORTANT METRICS.

a. SETS OF A PARTICULAR EXERCISE PER WORKOUT
b. REPS PER SET
c. TOTAL TIME UNDER TENSION
   i. THIS WILL BE COMBINED WITH MEASUREMENTS LIKE THE AVERAGE AND PEAK TENSION AND AVERAGE AND TOTAL POWER
      1. IT SHOULD BE NOTED THAT THE APP AND/OR CPU WILL MEASURE THE UPPER BODY TENSION DIRECTLY FROM THE TENSION ON THE HANDLES (WHICH MAY BE MEASURED DIRECTLY OR CALCULATED AS DESCRIBED LATER) WHILE THE LOWER BODY WORK AND POWER ETC. MUST BE CALCULATED BASED ON EMPIRICAL TESTING OF LOWER BODY OR CORE WORK AND POWER WITH TEST SUBJECTS OF A RANGE OF HEIGHTS AND WEIGHTS. THIS IS BECAUSE THE GROUND FORCE

-continued

WOULD NEED TO BE MEASURED WITH A FORCE PLATE TO KNOW THE ACTUAL WORK BEING DONE BY THE LOWER BODY. HOWEVER, THE EXPENSE AND COMPLEXITY OF A GROUND PLATE CAN BE MITIGATED BY DETERMINING THE GROUND FORCE FROM THE WEIGHT OF THE USER MINUS THE TOTAL HANDLE FORCE WITH THE ANGLE OF TENSION ASSUMED BY THE EXERCISE BEING PERFORMED (OR POSSIBLY BY TWO OR MORE DISTANCE SENSORS THAT DETECT THE POSITION OF THE HANDLES.

d. WHEN THE USER RETURNS TO THE SAME EXERCISE SEVERAL DAYS OR MORE LATER, THE APP WILL SUGGEST THE FINAL CORD COMBINATION FROM THE PREVIOUS WORKOUT. ALTERNATIVELY, IF THE USER HAS BEEN AWAY FROM THE DEVICE FOR AN EXTENDED TIME, THE APP MAY SUGGEST A REDUCED LOAD TO PREVENT INJURY.

i. THE APP WILL ALSO TRACK THE TOTAL WORK AND POWER AND POSSIBLY OTHER METRICS DURING THE NEXT EXERCISE AND GIVE THE USER A REAL-TIME COMPARISON WITH THE WORK AND POWER ETC. OF THE PREVIOUS WORKOUT. THIS WILL GIVE THE USER THE INFORMATION THEY NEED TO ACHIEVE A PROGRESSIVE OVERLOAD AS COMPARED TO THE PREVIOUS WORKOUT. ALTERNATIVELY, IF THE USER IS UNABLE TO ACHIEVE A PROGRESSION FROM THE PREVIOUS WORKOUT, THE APP MAY SUGGEST THAT THEY NEED TO GIVE THEMSELVES MORE RECOVERY TIME BETWEEN WORKOUTS OR CONSIDER IF THEY ARE GETTING ADEQUATE SLEEP OR NUTRITION FOR RECOVERY AND MUSCLE BUILDING OR FITNESS GAINS.

In order to achieve this level of exercise tracking, the device may use an array of sensors to track various parameters as follows:

CPU INPUTS

HANDLE POSITIONS RELATIVE TO UPPER AND/OR LOWER PULLEY/S

TENSION LOAD ON INDIVIDUAL CORDS

TOTAL TENSION ON EACH HANDLE

RATE OF CORD LENGTHENING AND SHORTENING

TO MEASURE INDIVIDUAL CORD ELONGATION, PULLEYS CAN HAVE A ROTATION COUNTER SUCH AS ONE OR MORE MAGNETS IN THE PULLEY AND A HALL EFFECT SENSOR TO COUNT PULLEY ROTATIONS. THREE SEQUENTIALLY UNEQUALLY SPACED MAGNETS WOULD GIVE THE CPU MORE INFORMATION TO DETERMINE THE DIRECTION OF ROTATION OF THE PULLEY. THIS ROTATIONAL INFORMATION IS SENT TO THE CPU THROUGH A WIRELESS CONNECTION AND THE CPU USES THIS INPUT TO DETERMINE THE TOTAL WORK DONE BY THE USER TO ELONGATE THAT INDIVIDUAL CORD. THIS COULD BE DONE IN COMBINATION WITH LOAD CELL DATA ON THE HANDLE OR DEVICE, OR IT WILL BE ENOUGH INFORMATION ON ITS OWN BASED ON EMPIRICAL TESTING OF THAT STRENGTH OF CORD MOVING THROUGH THAT STYLE OF PULLEY. THIS MAY ELIMINATE THE NEED FOR WIRELESS SENSING ON THE HANDLES, BUT IT WILL REQUIRE WIRELESS SENDERS ON EACH PULLEY WHICH MAY RESULT IN A GREATER NUMBER OF WIRELESS SENDERS AND RECEIVERS THAN JUST ONE IN EACH HANDLE.

A PROXIMITY SENSOR ON THE HANDLES OR ON THE MACHINE WHICH DETERMINES THE DISTANCE OF THE HANDLES FROM A PULLEY AREA WOULD ALLOW LOCATION OF THE HANDLES FOR THE CPU TO DETERMINE THE WORK DONE BY THE USER. A HANDLE POSITION SENSOR COULD USE A 3D SPACE LOCATION DEVICE OR IT COULD USE TWO PROXIMITY SENSORS WHICH WOULD JUST BE ABLE TO MEASURE THE ANGLE OF THE PULLEY RELATIVE TO THE DEVICE, OR THREE PROXIMITY SENSORS COULD DETERMINE THE DISTANCE OF THE HANDLE IN THREE DIMENSIONS. SOME SORT OF POSITIONAL MEASUREMENT OF THE HANDLES COULD REDUCE OR ELIMINATE THE NEED FOR LOAD CELLS ON THE PULLEYS OR PULLEY MOUNTING POINTS BECAUSE THE DISTANCE OF A HANDLE FROM A PULLEY WILL CORRESPOND TO A TENSION FOR EACH CORD BASED ON EMPIRICAL TESTING OF THE DIFFERENT CORD STRENGTHS AND AN RFID ON AT LEAST ONE OF THE PULLEYS ON A CORD. IF EACH CORD HAS TWO PULLEYS PERMANENTLY ASSEMBLED TO IT, THEN BOTH PULLEYS CAN HAVE AN RFID TAG AND ONLY ONE RFID READER IS NEEDED AT EITHER THE UPPER OR LOWER PULLEY ATTACHMENT POINT.

-continued

THE LOAD ON EACH INDIVIDUAL CORD CAN BE RECORDED BY THE CPU TO KEEP TRACK OF TOTAL TIME UNDER TENSION, TOTAL TENSION, AND NUMBER OF CYCLES TO PREDICT THE USEFUL LIFE OF THE CORDS (BASED ON EMPIRICAL TESTING OF THE VARIOUS CORD STRENGTHS PASSING THROUGH THE PULLEYS) WHEN A CERTAIN PERCENTAGE OF USEFUL LIFE IS REACHED, THE APP WILL ALERT THE USER TO DISCARD THAT CORD AND TO REPLACE IT WITH A NEW ONE.

a. A UNIQUE RFID AT EACH OF THE TWO PULLEYS ON A CORD IS USEFUL BECAUSE THE CPU WILL BE ABLE TO DETERMINE WHICH OF THE TWO PULLEYS IS CONNECTED AT THE UPPER OR LOWER PULLEY ATTACHMENT POINTS (EVEN IF THERE IS ONLY ONE RFID READER FOR THE TWO PULLEY ATTACHMENT POINTS FOR A CORD). THIS WILL BE USED BY THE CPU TO DETERMINE THE NUMBER OF CYCLES FOR EACH END OF THE CORD. THIS IS IMPORTANT BECAUSE IT IS ANTICIPATED BY THE INVENTORS THAT THE END OF THE CORD PASSING THROUGH A PULLEY WILL DETERIORATE FASTER THAN THE OTHER END WHICH IS PRIMARILY JUST STRETCHING BETWEEN THE PULLEYS.
   i. THE FATIGUE EFFECT OF BOTH ENDS OF A CORD BEING PULLED THROUGH BOTH PULLEYS SIMULTANEOUSLY WILL ALSO BE MEASURED EMPIRICALLY AND ENTERED INTO THE FATIGUE LIFE CALCULATED BY THE CPU FOR EACH INDIVIDUAL CORD.
   ii. IF PULLEYS ARE NOT PERMANENTLY ASSEMBLED TO THE CORDS, THE CORD ENDS THEMSELVES MAY COMPRISE AN RFID TAG.

With all of the above inputs, the CPU will be able to estimate a number of useful metrics for a user, including but not limited to, the following for an individual user. The estimates of user power and work (and other metrics such as, but not limited to, speed) may be based on a matrix (eg: look-up table) or algorithm which can be extrapolated from imperial testing of users with a range of heights and weights doing each exercise in the app. This empirical testing will use the sensors on the machine, as well as additional sensors such as a ground force plate the empirical testing user would stand or sit or lay on during the exercises to determine the total work done by the user's upper and lower body (or core) based on the handle tension and position data for a given height and mass of user.

The CPU would determine metrics such as:

Reps per set
Sets per exercise
Total mechanical work done during workout
Total power output of user
Muscle time under tension
Eccentric and concentric muscle contraction speed
Whether a user appeared to reach failure (based on lack of motion at a highly loaded point in the exercise)
One or more of the above could be used to calculate
a. Calories burned
b. Long term calories burned per day based on muscle requirements during recovery based on muscle mass gain expected from workout
c. Rest time between sets in a workout
d. Recovery time for a given muscle group from workout to workout
   i. This time between exercises could be a user preference with suggestions in the app for different fitness goals.

Figure 77:
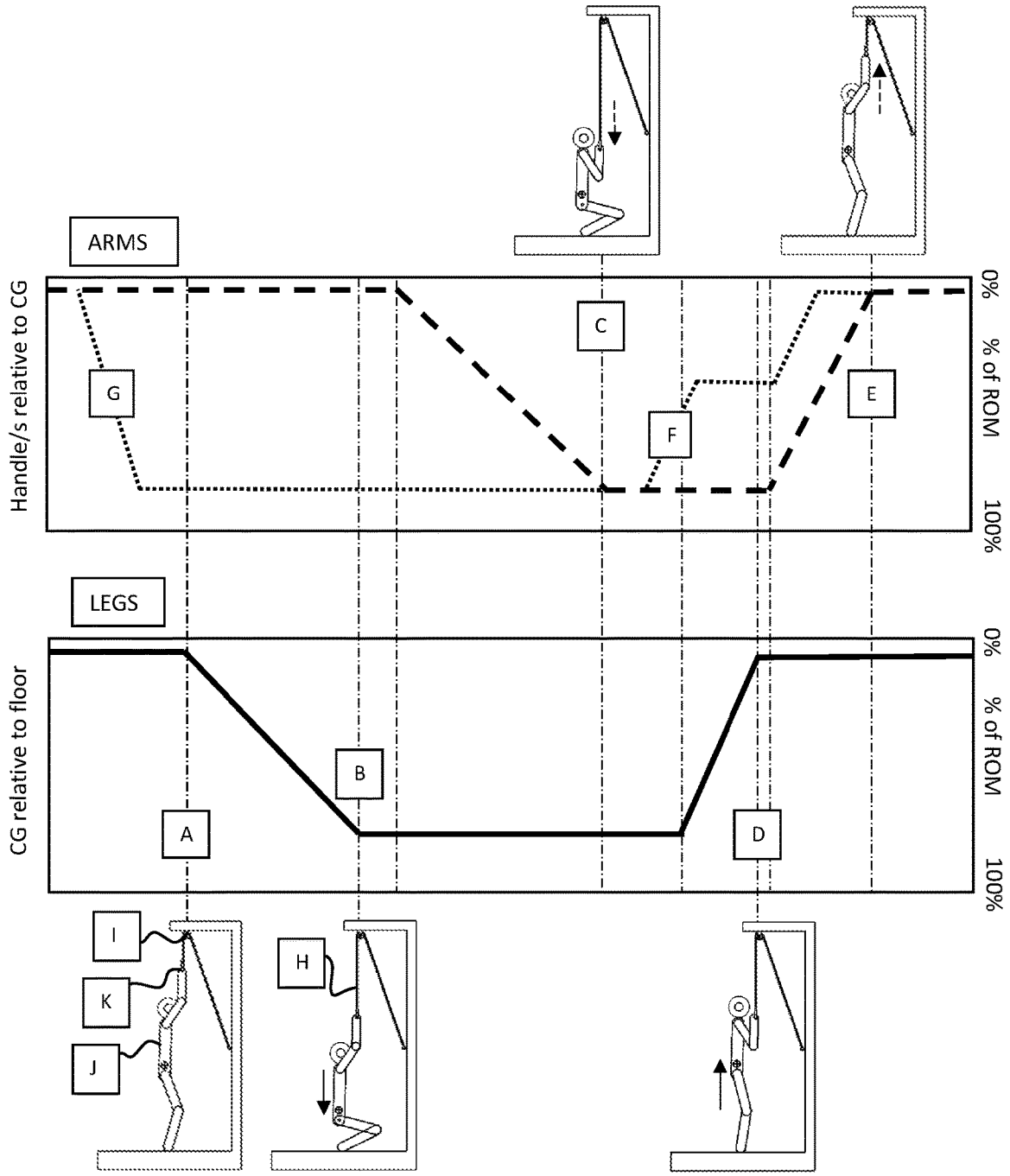
FIG. 77 shows a split graph showing a simplified embodiment of an exercise apparatus and values of % range of motion, center of gravity relative to floor, and handles relative to center of gravity.

In the split graph of FIG. 77 a non-limiting exemplary method of human muscle training with a simplified embodiment of the present device is shown. One or more overhead pulleys (I) are located above and at least an elbow or arm's length of the user (J) away from the vertical plane through a fixed pulley or other attachment for the first end of one or more cords, such as an elastic cord. The other end of the cord/s passes though one or more overhead pulley/s and is lengthened or stretched by the user (J) by means of a handle (K) at the end of the cords. At position (A) the user starts in the standing position below the overhead pulley/s with an arm or arms extended above their head to grasp one or two handles. The user then lowers their CG by bending their knees while keeping the handle above their head or shoulders. This stretches or lengthens and adds tension to the cord/s (H) which are configured to provide increased resistance to lengthening with increased lengthening. When the user reaches 25%, 50%, 75% of their knee bending ROM as shown at position (B) they then pull on the handle/s to move the handle/s downward relative to their CG through 25%, 50%, 75% of their elbow ROM as shown at position (C). This adds additional tension to the cord/s and provides assistance to the leg muscles against the effect of gravity acting on the user's body. The user then straightens their legs to raise their CG as shown at position (D). This is done with less load on the legs than during the lowering phase because there is more tension in the elastic cord/s as a result of the chin-up motion at position (C). This is considered to be beneficial for muscle training because the legs are more heavily loaded during the negative (eccentric contraction) phase of the method of exercise from position (A) to position (B). The user then raises their arms above their head or shoulders to or near to the original starting position as shown at position (E), and the user is ready to repeat the sequence of motions.

By using variations of this combination of motions, a higher number of reps per set is made possible than if a person were just doing bodyweight squats or just doing bodyweight chin-ups. This is partly because the strain on the muscles and joints is reduced due to the sharing of the load between the upper and lower body muscle groups. It is also because one or the other of the upper or lower body muscle groups can "assist" the other as the other approaches failure near the end of the set. A higher number of reps near failure is believed by many people in the fitness industry to more effectively promote an increase in muscle strength and/or hypertrophy. By using embodiments of the device together with methods of exercise disclosed here, the user can choose to increase the load on their lower body muscle group, at any time during the lower body ROM, by raising the overhead-mounted handles, relative to their CG as shown, for example, by the dotted line at (F). By doing so, the lower body muscles must support more of the bodyweight of the user. In contrast, the user can choose to decrease the load on their lower body muscle group, at any time during the lower body ROM, by lowering the handles, relative to their CG as shown by the dotted line at (G). By doing so, the upper body must support more of the bodyweight of the user and so it is able to assist the lower body more. It has been shown through experimentation that the average user will quickly and intuitively figure out a coordination of upper and lower body vertical movements which shares the load between upper and lower body muscle groups in a way that both muscle groups can reach a similar level of exhaustion or failure or near-failure at a similar time near the end of a set.

The split graph of FIG. 77 is a non-limiting exemplary method of muscle training with the device. Many variations of these combinations of movements are possible and anticipated by the inventors. They include variations such as but not limited to, double leg or single leg squats, "sissy" squats, calf raises, and etc. For the upper body, the user can do many different exercises to train the upper body muscles and assist the lower body muscles. These include but are not limited to, a chin-up motion or a pull-up or straight or bent arm inverted flys or tricep dip motions. These and other upper and lower body exercises can be combined with embodiments of the present device for a range of important benefits including to decrease the time needed for a workout and to increase the enjoyment of the workout. A number of these are included in the method section of this disclosure.

Figure 78:
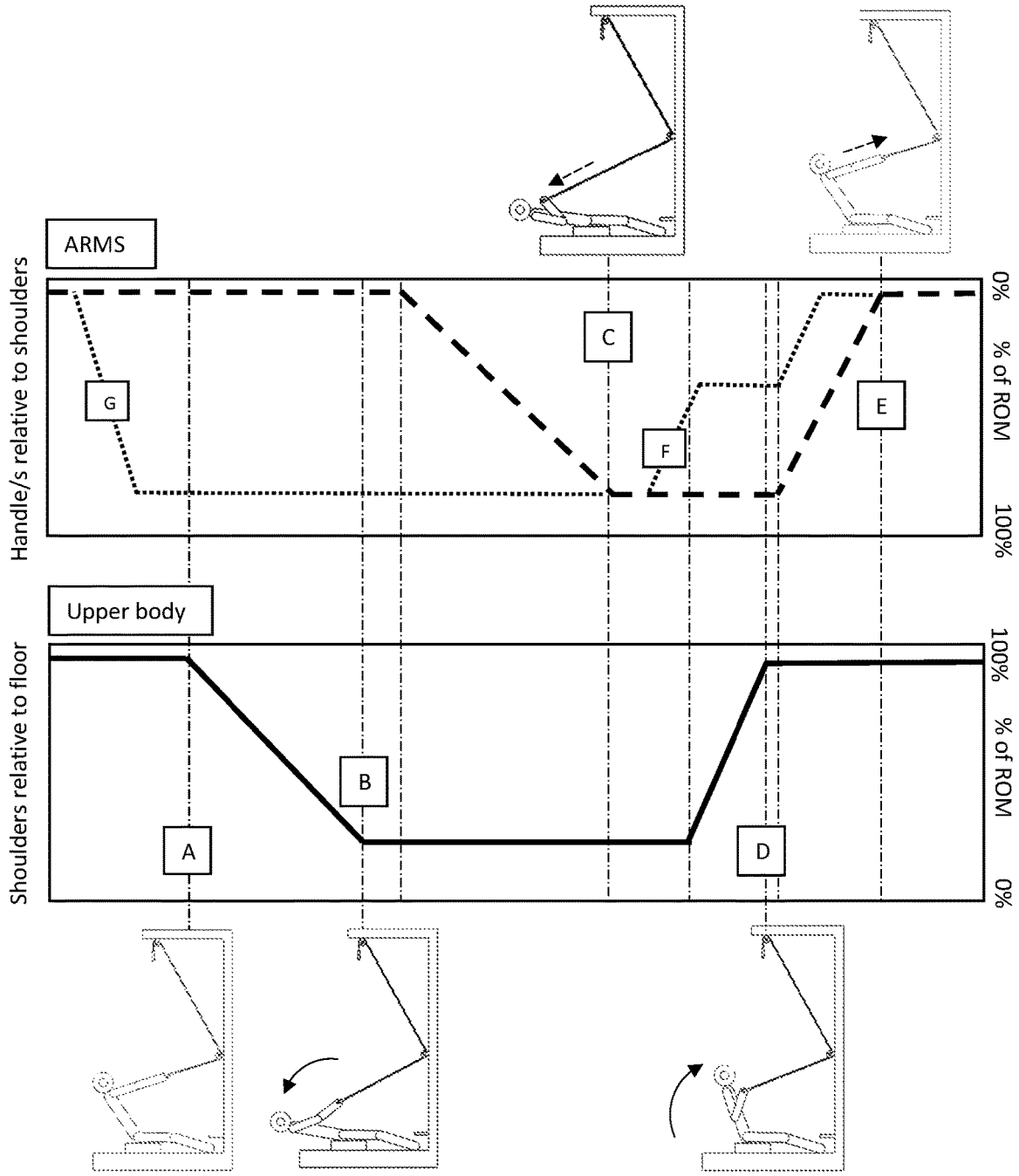
FIG. 78 shows a split graph showing a simplified embodiment of an exercise apparatus and values of % range of motion, shoulders relative to floor, and handles relative to shoulders.

In the split graph of FIG. 78, below, a non-limiting exemplary method of human muscle training with a simplified embodiment of the present device is shown. One or more forward mounted pulleys are located preferably within the downward vertical reach of a standing user at a height which does not require the user to bend at the waist to grasp the pulley as shown in FIG. 17. One or more cords, such as but not limited to an elastic cord, passes through the forward-mounted pulley/s and is fixed by some means above the forward mounted pulley/s. the cord/s are configured to provide increased resistance to lengthening with increased lengthening The lower end of the cord/s is stretched or lengthened primarily horizontally by said user, through and away from the forward-mounted pulleys by the user by means of a handle at the end of the cord/s. At position (A) the user starts in the sitting position facing the forward-mounted pulley/s with an arm or arms extended toward the forward-mounted pulleys while grasping the one or two handles. The user then lowers their shoulders relative to the floor by straightening at the waist and while keeping their arms reasonably straight. This stretches or lengthens and adds tension to the cord/s. When the user reaches 25%, 50%, 75% of their waist straightening ROM as shown at position (B) they then pull on the handle/s in a bicep curl motion, relative to their upper body, to move the handle/s upward relative to their CG and through 25%, 50%, 75% of their arm ROM toward their shoulders as shown at position (C). This adds additional tension to the cord/s and provides assistance to the core muscles against the effect of gravity acting downward on the user's upper body. The user then bends at the waist in a sit-up motion to raise their shoulders as shown at position (D). This is done with less load on the core muscles than during the lowering phase because there is more tension in the cord/s as a result of the bicep curl motion at position (C). This is considered to be beneficial for muscle training because the core muscles are more heavily loaded during the negative phase of the method of exercise from position (A) to position (B). The user then straightens their arms to the original starting position as shown at position (E), and the user is ready to repeat the sequence of motions.

By using variations of this combination of motions, a higher number of reps per set is made possible than if a person was just doing body weight sit-ups or just doing body weight bicep curls. This is partly because the strain on the muscles and joints is reduced due to the sharing of the load between the upper and lower body muscle groups. It is also because one or the other of the upper body or core muscle groups can "assist" the other as it approaches failure near the end of the set. A higher number of reps near failure is believed, by many people in the fitness industry, to more effectively promote an increase in muscle strength and/or hypertrophy. By using embodiments of the device together with methods of exercise disclosed here, the user can choose to increase the load on their core muscles, at any time during the core ROM, by straightening their arms to reduce the length of the cords which extend from the forward-mounted pulleys, as shown, for example, by the dotted line (F). By doing so, the core muscles must support more of the upper body weight of the user. In contrast, the user can choose to increase the load on their arms and bicep muscles, at any time during the lower body ROM, by pulling the handle/s closer to their shoulders as shown by dotted line (G). By doing so, the upper body must do more work and at the same time support more of the upper body weight of the user. It has been shown through experimentation that the average user will quickly and intuitively figure out a coordination of upper body and core muscle movements which shares the load between upper body and core muscle groups in a way that both muscle groups can reach a similar level of exhaustion or failure or near-failure at a similar time near the end of a set.

The split graph above is a non-limiting exemplary method of muscle training with the device. Many variations of these combinations of movements are possible and anticipated by the inventors. They include variations such as but not limited to, conventional sit-ups, side raises, and back extensions with the user facing away from the forward-mounted pulleys, to load the core muscles. For the upper body, the user can do a curl motion or a shoulder fly motion or any type of lift that pulls the handles in the general direction of their shoulders. Examples of these are included in the method section of this disclosure.

Figure 79:
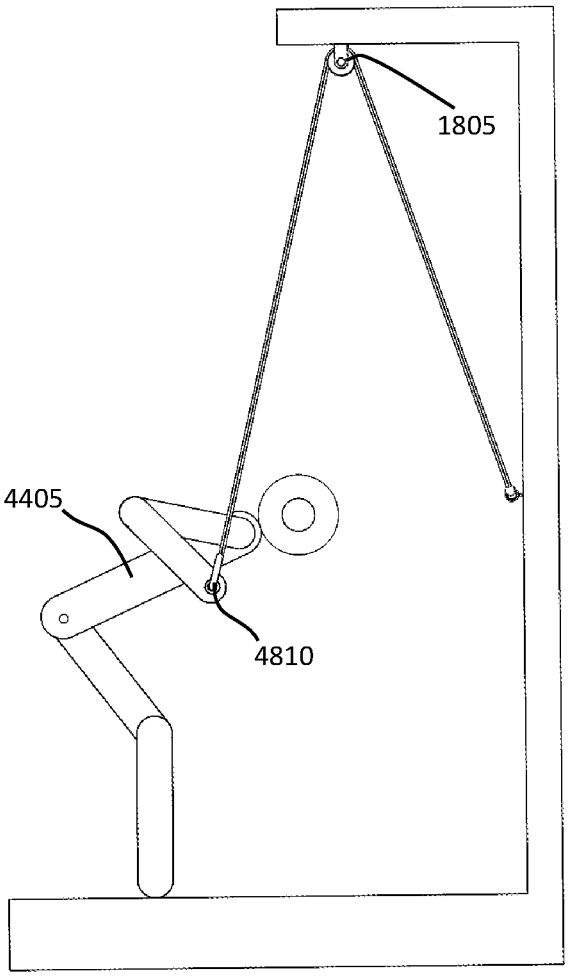
FIG. 79 is a side view of an embodiment of an exercise apparatus with a user in a first position of a lower back/triceps exercise.
Figure 80:
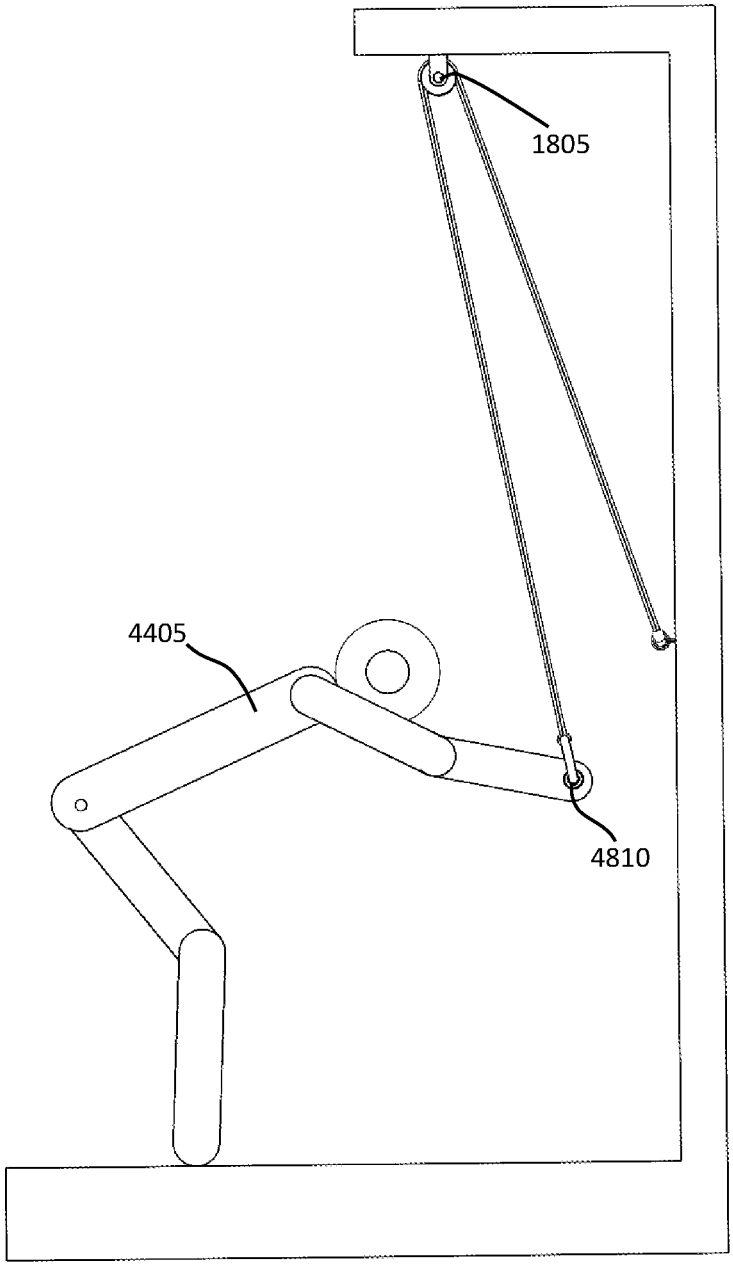
FIG. 80 is a side view of an embodiment of FIG. 79 with the user in a second position of the lower back/triceps exercise.

In a combination exercise variation shown in FIG. 79 and FIG. 80, and otherwise similar to the exercise shown with a more upright posture in FIGS. 66-70, the user 4405 may bend forward at the hips to engage the muscles of their lower back. In this case, the lower back and triceps can be exercised simultaneously. Furthermore, during this exercise the user may lower the handles 4810 to provide additional assistance to their lower back muscles against the effect of gravity, or alternatively raise the handles to reduce the assistance to their lower back muscles. In this way the user 4405 can for example intuitively adjust the handle 4810 height toward the end of a set so the tricep muscles and lower back muscles both reach a similar level of fatigue by the end of the set.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. An exercise apparatus comprising:

a support structure including a wall plate and a hinged portion, the wall plate configured to be mounted to a wall;

one or more forward pulleys arranged to be connected to the support structure;

one or more overhead pulleys arranged to be supported by the hinged portion;

the hinged portion hingedly connecting to the wall plate below a height of the one or more overhead pulleys, the hinged portion having a slidable member arranged to extend the hinged portion in length to adjust a distance between the one or more overhead pulleys and the hinged connection of the hinged portion to the wall plate;

the one or more overhead pulleys being arranged to be supported in use of the exercise apparatus in an overhead pulley position displaced horizontally 16" or more, 17" or more, 18" or more, 19" or more, 20" or more, 21" or more, 22" or more, 23" or more, 24" or more, 25" or more, 26" or more, 27" or more, 28" or more, or 29" or more from the one or more forward pulleys, the position of the one or more forward pulleys being 16" or more, 17" or more, 18" or more, 19" or more, 20" or more, 21" or more, 22" or more, 23" or more, 24" or more, 25" or more, 26" or more, 27" or more, 28" or more, or 29" or more vertically lower than the one or more overhead pulleys;

one or more forward user interfacing elements each connected to a respective forward pulley cord carried by a respective forward pulley of the one or more forward pulleys, each of the one or more forward user interfacing elements being biased in use of the exercise apparatus towards the respective forward pulley by tension of the respective forward pulley cord; and one or more overhead user interfacing elements each connected to a respective overhead pulley cord carried by a respective overhead pulley of the one or more overhead pulleys, each of the one or more overhead user interfacing elements being biased in use of the exercise apparatus towards the respective overhead pulley by tension of the respective overhead pulley cord.

2. The exercise apparatus of claim 1 in which in use of the exercise apparatus displacement of each of the one or more overhead user interfacing elements away from the respective overhead pulley increases the tension of the respective overhead pulley cord, and in which for each of the one or more overhead user interfacing elements, displacement from halfway to the floor, from a docked position, to all the way to the floor increases the tension of the respective overhead pulley cord by at least 10%, 20%, 30%, 40%, 50%, 60%, 70%, 80%, 90% or 100%.

3. The exercise apparatus of claim 1 in which the respective overhead pulley cord of each of the one or more overhead user interfacing elements is elastic.

4. The exercise apparatus of claim 3 in which the respective overhead pulley cord of each of the one or more overhead user interfacing elements is the respective forward pulley cord of a corresponding one of the one or more forward user interfacing elements, interaction of the corresponding one of the one or more forward user interfacing elements with the respective forward pulley carrying the respective forward pulley cord preventing the corresponding one of the one or more forward user interfacing elements from being able to be pulled back past the respective forward pulley by the respective forward pulley cord.

5. The exercise apparatus of claim 1 in which the hinged portion is limited in range of motion by a connection to said wall.

6. An exercise apparatus for use by a user, the exercise apparatus comprising:

a wall plate configured to be mounted to a wall;

a hinged portion;

one or more overhead pulleys arranged to be supported by the hinged portion in an overhead pulley position displaced horizontally 16" or more, 17" or more, 18" or more, 19" or more, 20" or more, 21" or more, 22" or more, 23" or more, 24" or more, 25" or more, 26" or more, 27" or more, 28" or more, or 29" or more from the wall plate when deployed/in use;

the hinged portion hingedly connecting to the wall plate below a vertical height of the overhead pulley position, the hinged portion being slidably extendable in length to adjust the overhead pulley position; and one or more overhead user interfacing elements each connected to a respective overhead pulley cord carried by a respective overhead pulley of the one or more overhead pulleys, each of the one or more overhead user interfacing elements being biased in use of the exercise apparatus towards the respective overhead pulley by tension of the respective overhead pulley cord.

7. The exercise apparatus of claim 6 in which the hinged portion is limited in range of angular motion by a connection to said wall.

8. The exercise apparatus of claim 6 further comprising one or more forward pulleys arranged to be connected to the wall plate or hinged portion, and one or more forward user interfacing elements each connected to a respective forward pulley cord carried by a respective forward pulley of the one or more forward pulleys, each of the one or more forward user interfacing elements being biased in use of the exercise apparatus towards the respective forward pulley by tension of the respective forward pulley cord.

9. The exercise apparatus of claim 8 in which the overhead pulley position is displaced horizontally 16" or more, 17" or more, 18" or more, 19" or more, 20" or more, 21" or more, 22" or more, 23" or more, 24" or more, 25" or more, 26" or more, 27" or more, 28" or more, or 29" or more from the one or more forward pulleys when deployed.

10. The exercise apparatus of claim 8 in which in use of the exercise apparatus displacement of each of the one or more forward user interfacing elements away from the respective forward pulley increases the tension of the respective forward pulley cord.

11. The exercise apparatus of claim 10 in which the respective forward pulley cord of each of the one or more forward user interfacing elements is elastic, and the respective forward pulley cord of each of the one or more forward user interfacing elements is the respective overhead pulley cord of a corresponding one of the one or more overhead user interfacing elements, interaction of the corresponding one of the one or more overhead user interfacing elements with the respective overhead pulley carrying the respective overhead pulley cord preventing the corresponding one of the one or more overhead user interfacing elements from being able to be pulled back past the respective overhead pulley by the respective overhead pulley cord.

12. The exercise apparatus of claim 8 in which the respective overhead pulley cord of each of the one or more overhead user interfacing elements is elastic, and the respective overhead pulley cord of each of the one or more overhead user interfacing elements is the respective forward pulley cord of a corresponding one of the one or more forward user interfacing elements, interaction of the corresponding one of the one or more forward user interfacing elements with the respective forward pulley carrying the respective forward pulley cord preventing the corresponding one of the one or more forward user interfacing elements from being able to be pulled back past the respective forward pulley by the respective forward pulley cord.

13. The exercise apparatus of claim 6 in which in use of the exercise apparatus displacement of each of the one or more overhead user interfacing elements away from the respective overhead pulley increases the tension of the respective overhead pulley cord.

14. An exercise apparatus for use by a user, the exercise apparatus comprising:

a wall plate configured to be mounted to a wall;

a hinged portion;

one or more overhead pulleys arranged to be supported by the hinged portion in an overhead pulley position displaced horizontally 16" or more, 17" or more, 18" or more, 19" or more, 20" or more, 21" or more, 22" or more, 23" or more, 24" or more, 25" or more, 26" or more, 27" or more, 28" or more, or 29" or more from the wall plate when deployed/in use;

the hinged portion hingedly connecting to the wall plate below a vertical height of the overhead pulley position;

one or more overhead user interfacing elements each connected to a respective overhead pulley cord carried by a respective overhead pulley of the one or more overhead pulleys, each of the one or more overhead user interfacing elements being biased in use of the exercise apparatus towards the respective overhead pulley by tension of the respective overhead pulley cord; and one or more forward pulleys arranged to be connected to the wall plate or hinged portion, and one or more forward user interfacing elements each connected to a respective forward pulley cord carried by a respective forward pulley of the one or more forward pulleys, each of the one or more forward user interfacing elements being biased in use of the exercise apparatus towards the respective forward pulley by tension of the respective forward pulley cord, the respective forward pulley cord of each of the one or more forward user interfacing elements being elastic so that in use of the exercise apparatus displacement of each of the one or more forward user interfacing elements away from the respective forward pulley increases the tension of the respective forward pulley cord, and the respective forward pulley cord of each of the one or more forward user interfacing elements is the respective overhead pulley cord of a corresponding one of the one or more overhead user interfacing elements, interaction of the corresponding one of the one or more overhead user interfacing elements with the respective overhead pulley carrying the respective overhead pulley cord preventing the corresponding one of the one or more overhead user interfacing elements from being able to be pulled back past the respective overhead pulley by the respective overhead pulley cord.

15. An exercise apparatus for use by a user, the exercise apparatus comprising:

a wall plate configured to be mounted to a wall;

a hinged portion;

one or more overhead pulleys arranged to be supported by the hinged portion in an overhead pulley position displaced horizontally 16" or more, 17" or more, 18" or more, 19" or more, 20" or more, 21" or more, 22" or more, 23" or more, 24" or more, 25" or more, 26" or more, 27" or more, 28" or more, or 29" or more from the wall plate when deployed/in use;

the hinged portion hingedly connecting to the wall plate below a vertical height of the overhead pulley position;

one or more overhead user interfacing elements each connected to a respective overhead pulley cord carried by a respective overhead pulley of the one or more overhead pulleys, each of the one or more overhead user interfacing elements being biased in use of the exercise apparatus towards the respective overhead pulley by tension of the respective overhead pulley cord; and one or more forward pulleys arranged to be connected to the wall plate or hinged portion, and one or more forward user interfacing elements each connected to a respective forward pulley cord carried by a respective forward pulley of the one or more forward pulleys, each of the one or more forward user interfacing elements being biased in use of the exercise apparatus towards the respective forward pulley by tension of the respective forward pulley cord;

in which the respective overhead pulley cord of each of the one or more overhead user interfacing elements is elastic, and the respective overhead pulley cord of each of the one or more overhead user interfacing elements is the respective forward pulley cord of a corresponding one of the one or more forward user interfacing elements, interaction of the corresponding one of the one or more forward user interfacing elements with the respective forward pulley carrying the respective forward pulley cord preventing the corresponding one of the one or more forward user interfacing elements from being able to be pulled back past the respective forward pulley by the respective forward pulley cord.

* * * * *